US009015885B2

(12) United States Patent
Chapin

(10) Patent No.: US 9,015,885 B2
(45) Date of Patent: Apr. 28, 2015

(54) TRAVELING WAVE AIR MATTRESSES AND METHOD AND APPARATUS FOR GENERATING TRAVELING WAVES THEREON

(71) Applicant: William Lawrence Chapin, Huntington Beach, CA (US)

(72) Inventor: William Lawrence Chapin, Huntington Beach, CA (US)

( * ) Notice: Subject to any disclaimer, the term of this patent is extended or adjusted under 35 U.S.C. 154(b) by 0 days.

(21) Appl. No.: 14/179,791

(22) Filed: Feb. 13, 2014

(65) Prior Publication Data

US 2014/0223665 A1 Aug. 14, 2014

Related U.S. Application Data

(60) Provisional application No. 61/771,083, filed on Mar. 1, 2013, provisional application No. 61/764,060, filed on Feb. 13, 2013.

(51) Int. Cl.
*A47C 27/10* (2006.01)
*A61G 7/057* (2006.01)

(52) U.S. Cl.
CPC ..... *A47C 27/10* (2013.01); *A61G 7/05776* (2013.01)

(58) Field of Classification Search
CPC .... A47C 27/083; A47C 27/10; A47C 27/081; A47C 27/082; A61G 7/05769; A61G 7/05776; A61G 7/015
USPC ..... 5/499, 609, 674, 706, 708, 710, 713, 5/715
See application file for complete search history.

(56) References Cited

U.S. PATENT DOCUMENTS

| | | | | |
|---|---|---|---|---|
| 4,637,083 | A * | 1/1987 | Goodwin | 5/689 |
| 4,947,832 | A | 8/1990 | Blitzer | |
| 5,243,723 | A * | 9/1993 | Cotner et al. | 5/710 |
| 5,267,364 | A * | 12/1993 | Volk | 5/713 |
| 5,983,429 | A * | 11/1999 | Stacy et al. | 5/713 |
| 6,030,353 | A * | 2/2000 | Van Brunt | 601/150 |
| 6,036,662 | A * | 3/2000 | Van Brunt et al. | 601/41 |
| 6,108,843 | A * | 8/2000 | Suzuki et al. | 5/713 |
| 6,439,264 | B1 * | 8/2002 | Ellis et al. | 137/596.2 |
| 6,671,911 | B1 * | 1/2004 | Hill et al. | 5/713 |
| 7,137,160 | B2 * | 11/2006 | Hand et al. | 5/607 |
| 7,901,193 | B2 * | 3/2011 | Evans et al. | 417/442 |
| 8,122,545 | B2 | 2/2012 | Wilkinson | |
| 8,286,282 | B2 * | 10/2012 | Kummer et al. | 5/615 |

(Continued)

OTHER PUBLICATIONS

AOFEITE Catalog, Medical Devices, 2013, p. 13, AOFEITE Medical Devices Co. Ltd. , Shijiazhuang City, China.

(Continued)

*Primary Examiner* — Timothy D Collins
*Assistant Examiner* — Richard G Davis
(74) *Attorney, Agent, or Firm* — William L. Chapin

(57) ABSTRACT

An air mattress apparatus includes an air mattress which comprised of an array of air bladder cells that are individually inflatable to quiescent pressure levels which provide comfortable support for the body of a human, and a pressure-pulse generator controlled by a wave sequence generator for introducing into ordered patterns of air bladder cells a wave-like time sequence of air pressure pulses which vary quiescent pressure levels in the cells, the pressure wave resulting in a traveling wave of support force variation which travels over the surfaces of the pulsed air bladder cells, thus inhibiting formation of bedsores. The wave pattern may optionally simulate water waves and/or rocking motions of a boat to produce relaxing effects.

53 Claims, 33 Drawing Sheets

(56) References Cited

U.S. PATENT DOCUMENTS

| | | | | |
|---|---|---|---|---|
| 8,533,879 | B1 * | 9/2013 | Taylor | 5/713 |
| 8,801,635 | B2 * | 8/2014 | Hovorka | 600/587 |
| 2002/0099409 | A1 * | 7/2002 | Hui | 606/201 |
| 2004/0261184 | A1 * | 12/2004 | Flick | 5/713 |
| 2008/0040860 | A1 * | 2/2008 | Price et al. | 5/710 |
| 2008/0313816 | A1 * | 12/2008 | Bohm et al. | 5/713 |
| 2010/0306924 | A1 * | 12/2010 | Kummer et al. | 5/710 |
| 2011/0296621 | A1 * | 12/2011 | Mckenna | 5/671 |
| 2013/0146216 | A1 * | 6/2013 | Mileti | 156/197 |
| 2014/0173825 | A1 * | 6/2014 | Chiang et al. | 5/421 |

OTHER PUBLICATIONS

AOFEITE Item No. AFT-1029 Operation Directions, AOFEITE Medical Devices Co. Ltd. , Shijiazhuang City, China.

* cited by examiner

CELL NUMBER
1
2
3
4
5
6
63
T1
T2
TIME
INITIAL QUIESCENT PRESSURE
T3
T4
SELECTABLE RANGE OF QUIESCENT PRESSURE AFTER PULSE
T5
T6
PULSED PRESSURE
T7
T8
T9
T10
T11
T12
CELL INFLATION PRESSURE
0
1
2
3
4
5
6
7
TIME, SECONDS OR MINUTES

CELL NUMBER
PRESSURE PULSE SEQUENCE ALONG FORCE GRADIENT VECTOR
1
2
3
4
5
6
7
8
9
10
11
12
12345
163A
T1
T2
163B
T3
T4
163C
T5
T6
163D
T7
T8
CELL INFLATION PRESSURE
0
0
1
2
3
4
5
6
TIME, SECONDS OR MINUTES 400
402
406
408-1
AIR MATTRESS MODULE
403
404-1
401
WAVE GENERATOR MODULE
410
WAVE SEQUENCE GENERATOR
411
412-1
412-10
+12V
413
414
PRESSUR PULSE GENERATOR
115V
115V RTN
RTN
415
416
419
122
CONTROL ELECTRONICS
420
PS
+12V
115V
115V
421
422
417
418
405
408-20
AIR MATTRESS INTERFACE MODULE
409-1
407-1
407-20
409-20
1/20
2/20
3/20
4/20
5/20
6/20
7/20
8/20
9/20
10/20
11/20
12/20
13/20
14/20
15/20
16/20
17/20
18/20
19/20
20/20
AIR MATTRESS
404-20

FIG. 17, Part 1 of 2
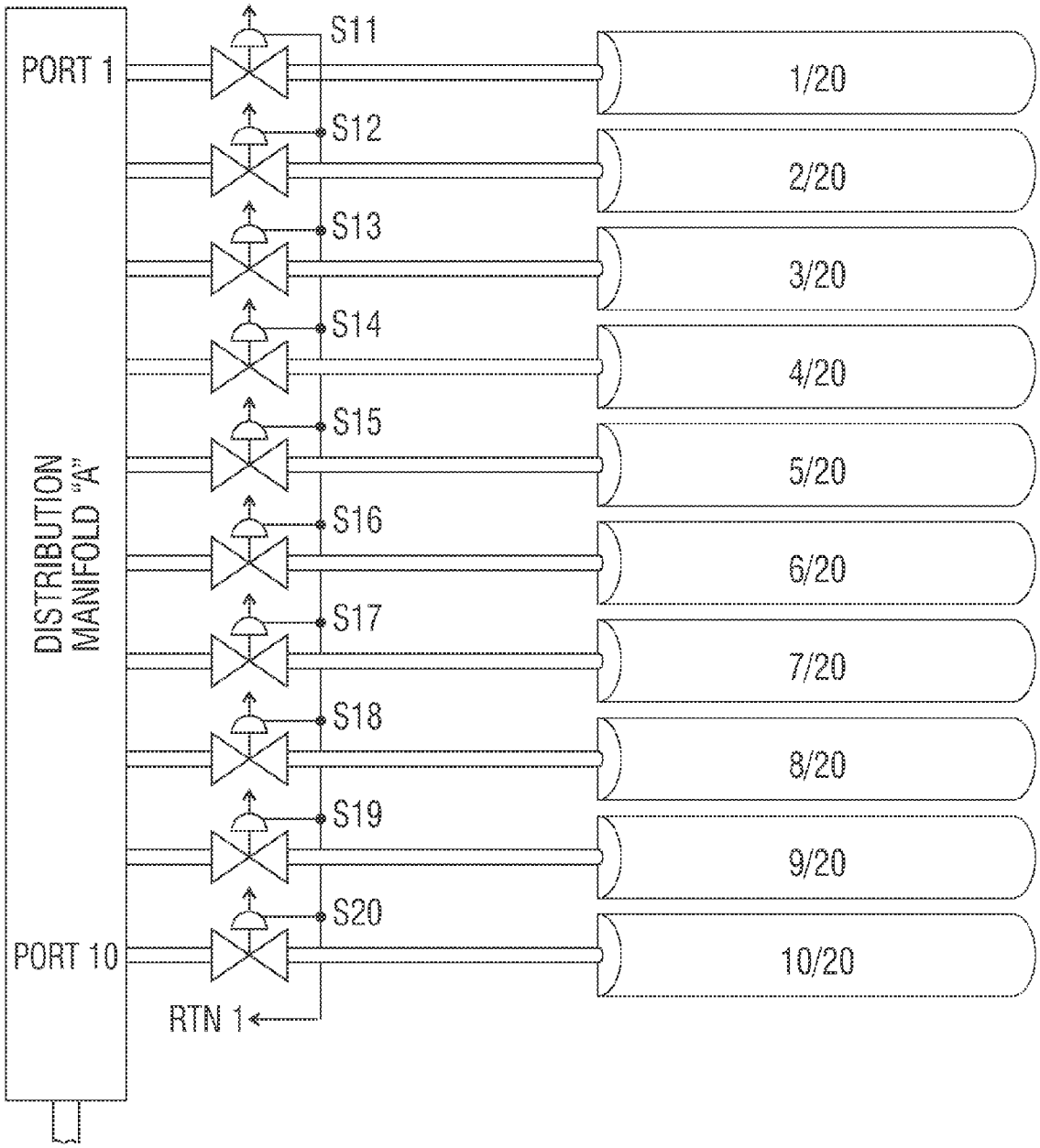

FIG. 17, Part 2 of 2
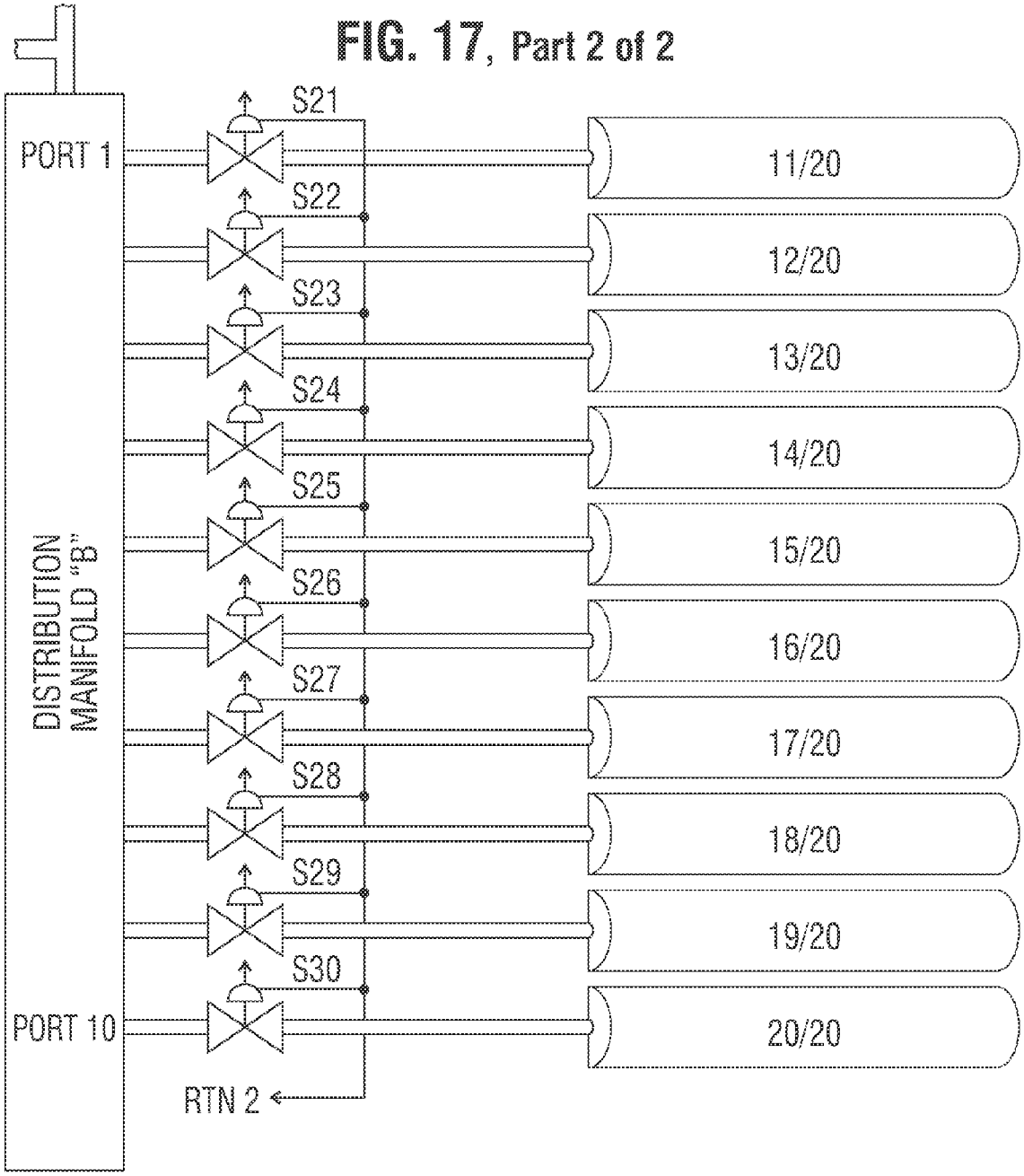

FIG. 18, ACTIVE DEFLATION: RECIRCULATING PUMP (DASHED: VENTING PUMP)
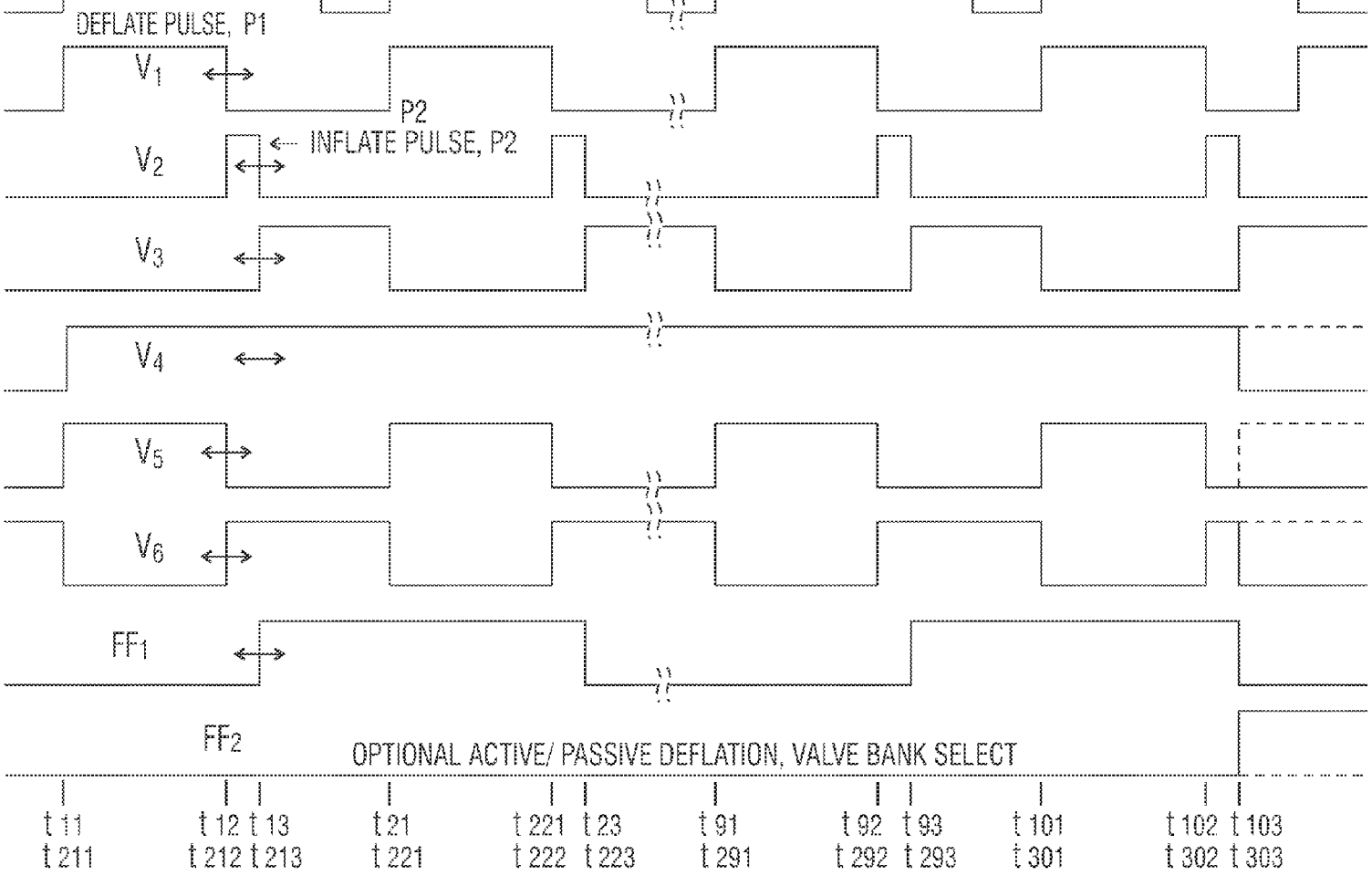

FIG. 19, PASSIVE DEFLATION
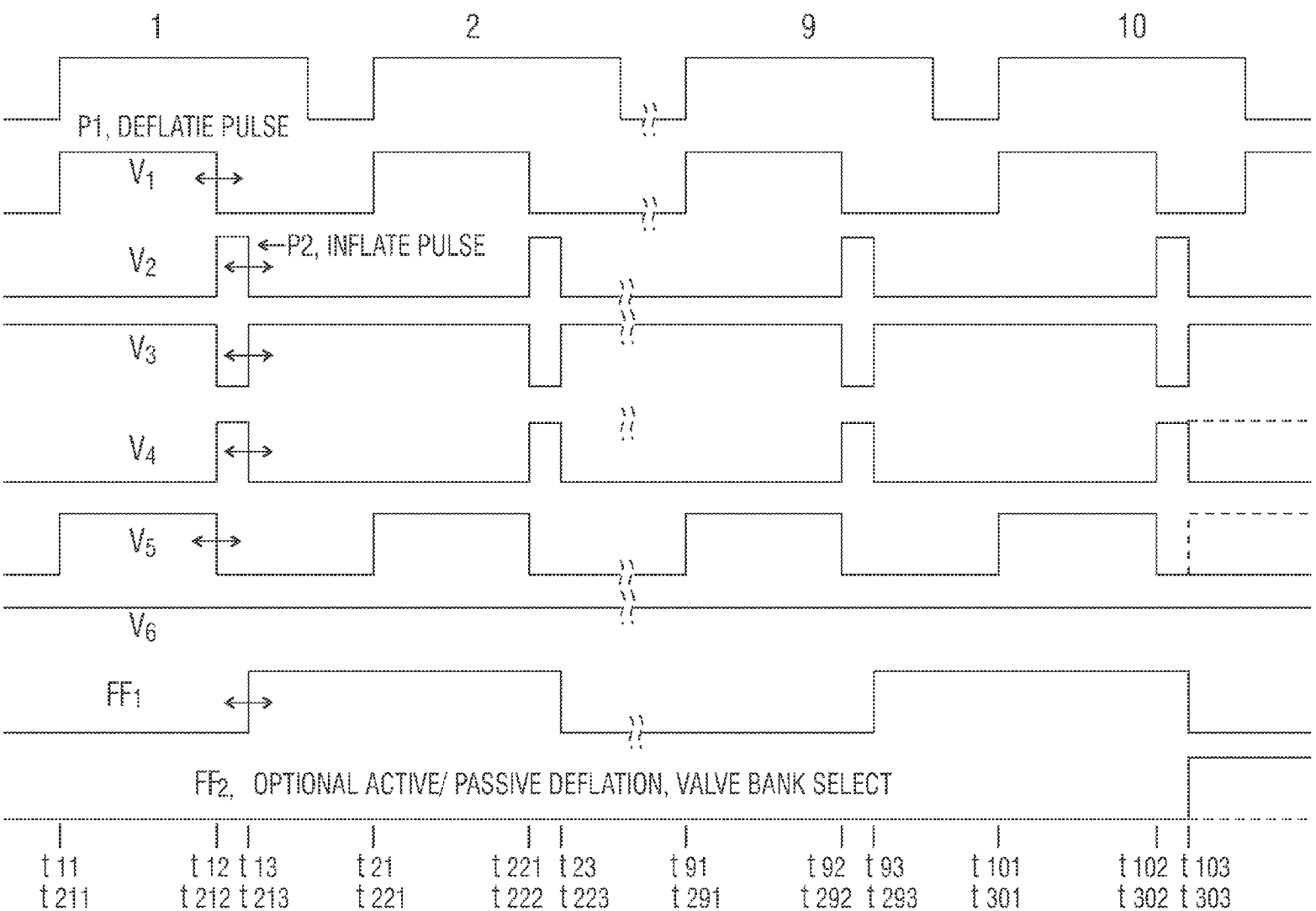

TRAVELING WAVE AIR MATTRESSES AND METHOD AND APPARATUS FOR GENERATING TRAVELING WAVES THEREON

The present application claims priority to the following U.S. Provisional Patent applications 61/764,060, filed Feb. 13, 2013, U.S. 61/771,083, filed Mar. 1, 2013.

BACKGROUND OF THE INVENTION

A. Field of the Invention

The present invention relates to mattresses of the type used to support a recumbent human. More particularly, the invention relates to novel air mattresses which use a matrix array of air bladder cells that are individually inflatable and deflatable in time varying sequences which cause quiescent support forces for a human body lying on the mattress to have superimposed thereon spatially moving, time varying traveling waves of support force which correspond to traveling waves of air pressure pulses input to the air bladder cells. The body support forces waves can be programmed to travel longitudinally, laterally or obliquely on the upper support surfaces of the air bladder cells, according to pre-determined patterns which can be used to minimize formation of decubitus sores on a patient's body and alternatively to simulate comforting motions such as floating on a rolling water wave, or rocking in a boat, which simulations may optionally be accompanied by appropriate music and/or environment-simulating sounds.

B. Description of Background Art

Pressure sores, which are also known as decubitus ulcers or bed sores occur in the outer tissues of a person's body if they are subjected to relatively large pressures and/or shear forces for long periods of time. Such sores are caused by reduction in blood circulation caused by surface force pressures which exceed the person's capillary blood pressure. The problems with bed sores forming on the skin of persons with medical conditions which require them to be in relatively immobile positions on a hospital bed or in a wheel chair can be severe, resulting in painful, difficult to treat conditions, loss of limbs, or even death.

For the foregoing reasons, hospitals, nursing homes and other such health care providers which provide care giving to ailing or elderly people are keenly aware of the necessity to carefully monitor people under their care to prevent formation of bed sores. A commonly used method to minimize the possibility of bed sore formation is to turn the patient periodically, i.e., to re-adjust the patient's position on a bed mattress or in a wheel chair so that long-term pressures can be relieved from parts of a patient's body. However, turning invariably results in renewed higher pressures on other parts of the body, so the turning process must be repeated usually at least on a daily basis.

Presumably in response to a perceived need to reduce problems of bed sore formation, a variety of devices and methods have been proposed to reduce long-term, large force or pressure concentrations on a person's body. For example, Cottner et al, in U.S. Pat. No. 5,243,723, Sep. 17, 1993, Multi-Chambered Sequentially Pressurized Air Mattress With Four Layers discloses an air mattress which has two lower layers constantly pressurized at about 1 psi gauge, and two upper layers that each have serpentinely shaped, transversely disposed interdigitated membrane areas which are cyclically and alternately pressurized with varying air pressure in a push-pull fashion which creates a standing wave of variation in support force for a patient, with the intended purpose of minimizing formation of decubitus sores. The standing waves produced by alternate inflation and deflation of adjacent interdigitated members shifts support forces up and down, leaving the average maximum reaction support force concentrations on parts of a patient's body unchanged.

The present invention was conceived of to provide air mattresses which provide traveling waves of support-forces for the body of a person supported by the mattress, which can reduce maximum force concentrations.

OBJECTS OF THE INVENTION

An object of the present invention is to provide a traveling wave air mattress apparatus which includes an inflatable air mattress that has a multiplicity of hermetically isolated air bladder cells and a pressure pulse generator which dynamically varies inflation pressures in the cells to thus create a traveling wave of support-force which travels on the upper surface of the mattress.

Another object of the invention is to provide a traveling wave air mattress apparatus which includes a mattress that has a multiplicity of laterally disposed, hermetically isolated air bladder cells, and an air pressure pulse generator which sequentially varies air pressure in the cells to thus create longitudinally traveling body support-force waves on the upper surfaces of the air bladder cells.

Another object of the invention is to; provide a traveling wave air mattress comprised of a planar matrix of air bladder cells which are hermetically isolated from one another, and a pressure pulse generator for varying air pressures in the cells by pressure pulses which are applied sequentially to individual cells or groups of cells to create on the upper surfaces of the cells traveling waves of support-force for the body of a person supported by the mattress, the traveling waves being directable longitudinally, laterally or obliquely on the surface of the mattress.

Another object of the invention is to provide a traveling wave air mattress which has a matrix of air bladder cells, each of which has associated therewith a surface reaction force-sensor, the sensors being useable to calculate a gradient vector of surface reaction forces measured by the sensors, and a pressure pulse generator for directing waves of negative pressure pulses to air bladder cells along the path of the gradient vector to thus create a traveling wave of support force reduction which travels in the direction the gradient vector.

Another object of the invention is to provide a traveling wave air mattress apparatus which has a multiplicity of individually inflatable and deflatable air bladder cells which are hermetically isolated from one another, and a wave generator including a pressure pulse generator and selector values which introduces a wave of air pulses into selected cells to thus create a traveling wave of support force reduction directed along the gradient path.

Another object of the invention is to provide a traveling wave air mattress apparatus which has a multiplicity of individually inflatable and deflatable air bladder cells which are hermetically isolated from one another, and a wave generator which includes a pressure pulse generator and selector valve mechanism which introduces pulses of air pressure into selected air bladder cells in a sequential fashion that produces a traveling pressure wave in the air bladder cells which in turn causes the upper surfaces of the air bladder cells to produce thereon a corresponding traveling wave of support force for a body supported on the upper surface of the air mattress.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a method and apparatus for alleviating formation of bed sores or decubitus sores on parts of the body of a person such as a medical patient who is supported in a relatively immobile recumbent position on a hospital bed for long periods of time. The apparatus according to the present invention includes an air mattress which is constructed from individually inflatable and deflatable air bladders cells which are arranged in a rectangular array having an upper horizontal patient support surface. The individual air bladder cells are inflated to suitable quiescent pressure levels which provide comfortable support for the body of a recumbent patient. Preferably, the quiescent or bias pressure levels of the several air bladder cells are individually adjusted to values which minimize the sum of maximum reaction force concentrations exerted on the body of a patient, as measured by an array of force or pressure sensors which is associated with the array of air bladder cells.

According to the invention, air pressure in each of the cells is cyclically varied in a manner which causes the support forces afforded by the mattress to a human body to have superimposed on quiescent static or bias values time-varying components to thus produce traveling waves of support force superimposed on the static support forces. The traveling wave component of the support force is produced by varying in a pre-determined time sequence air pressure in sequences of individual air bladder cells according to pre-determined programs which control pressurized air inlet to and exhausted from individual air bladder cells via electrically controlled valves.

For example, to produce a traveling wave of support force reduction which travels from the head-end towards the foot-end of the mattress, air pressure in a laterally disposed zone of air bladder cells located at an end of the longitudinal axis of the mattress near the patient's head is momentarily reduced to produce a pressure reduction pulse, followed by a reduction of air pressure in longitudinal zones successively closer to the foot-end of the mattress, and so forth, until a pressure reduction pulse occurs in the longitudinal zone of air bladder cells nearest the foot-end of the mattress. The traveling pressure wave pulse cycle and resultant traveling support force wave cycle can be activated intermittently, such as once every hour, continuously in groups of several cycles periodically or in response to sensor measurements of reaction forces exerted on a patient.

In a preferred embodiment of the invention, the air bladder cell matrix will have at least two and preferably three parallel longitudinally disposed zones located side-by-side, and preferably have 4 or more laterally disposed zones. For example, a 3 column×4 row array of 12 air bladder cells which has four longitudinally arranged, laterally disposed zones each three cells wide enables traveling support force waves to be propagated longitudinally, i.e., head-to-foot, or foot-to-head, laterally, i.e., left-to-right and right-to-left, and obliquely.

Under computer program control, the air pressure in individual air bladder cells, or in groups of cells, such as in all or some of the cells in a row or column, can be temporarily varied from quiescent values of air pressure in a wide variation of time sequences to thus produce a wide variety of waves of patient support forces which travel over the upper surface of the mattress. The traveling support wave patterns can be optimized to alleviate or minimize the formation of decubitus sores which can result from long periods of large static support pressures on parts of a patient's body.

In a simple example, the pressure in all three of the laterally arranged air bladder cells in the first, head-end longitudinal zone of a 3×4 matrix air mattress may be reduced from quiescent steady state values by a pulse of negative air pressure input to the cells in that zone for a period of several seconds. At the end of the first air pressure pulse, air pressures in the cells may be restored to their original bias or quiescent values, which have been previously adjusted to provide comfortable support of a patient.

After an initial pressure pulse has been applied to a first air bladder cell or group of cells, similar pressure reduction pulses are applied to longitudinal zones 2, 3 and 4. This sequence of air pressure reduction pulses results in a traveling wave of support forces reduction which travels from the head-end to the foot-end of the mattress.

The traveling waves of air pressure reduction pulses in the air bladder cells can be performed as a single cycle, at pre-determined times, repeated for several cycles, or performed continuously for pre-determined time periods. Also, the time interval between an air pressure reduction pulse in one zone of air bladder cells and the initiation of a negative or pressure pulse in a next zone in a pre-selected spatial sequence need not be zero, as it would be in a traveling wave which characterizes water waves, but may, for example, have a finite, selectable, value. In other words, the duty cycle of a pulse generator used to activate air pressure control valves to thus apply a sequence of air pressure pulses to a sequence of air cell bladder zones can be as small as desired. Or, put another way, the time interval between successive pressure pulses applied to successive cells or group of cells, can be as long as desired.

According to the invention, traveling waves of air pressure pulses which decrease for pre-determined time intervals and repetition rate, the maximum reaction force concentrations on parts of a human body can be programmed to travel longitudinally from head-to-toe, as described in the simplified example above, or in the opposite, toe-to-head longitudinal direction on the mattress surface. As stated above, longitudinal traveling body support force waves are produced by varying the air pressure simultaneously in each air bladder cell in a first transverse row of cells, subsequently varying the air pressure in the air bladder cells in a longitudinally adjacent row of cells, and so forth, until the wave of support forces on parts of a patient's body has traversed the entire length or a selected segment of the length of the mattress.

In an exactly analogous fashion, air pressure in laterally adjacent or spaced apart longitudinally disposed columns of adjacent air bladder cells may be varied to produce laterally traveling waves of body support forces. Also, by sequentially varying air pressure in obliquely located air bladder cells, obliquely traveling waves of body support forces may be generated using the traveling wave air mattress according to the present invention.

According to another aspect of the present invention, a force sensor array is optionally provided which has an individual surface reaction force sensor that is associated with each individual air bladder cell, in vertical alignment with the cell. The array of reaction force sensors, which produce electrical signals proportional to reaction forces exerted by the mattress on various parts of a patient's body supported by the individual cells, may be used to create a map of body reaction force concentrations.

The measured values of reaction forces may also be used to create a segmented measured reaction force gradient vector. The reaction force gradient vector may then be used to calculate a path sequence for producing a traveling wave of air pressure in a sequence of air bladder cells along the reaction force gradient vector.

Since a measured reaction force gradient vector may not necessarily include all of the air bladder cells in an array, and may in some cases be directed between non-adjacent air bladder cells, traveling waves of air pressure may be directed individually to only a small number of the total air bladder cells in an array, some or all of which cells may be non-adjacent. In this way, patient body support reaction forces exerted by the air mattress may be momentarily and periodically reduced in an efficient manner which does not require varying air pressure in all of the air bladder cells in an array.

For example, if reaction force sensors determine that a maximum reaction force is exerted by a first cell, and the force gradient vector from that maximum is directed through three additional cells, some of which may be non-adjacent, an air pressure wave need be directed only to those four air bladder cells to thus create a traveling support force reduction wave which travels over just the four cells. For reasons stated above, the four cells need not necessarily be vertically or horizontally aligned, or adjacent to one another.

According to the invention, a basic embodiment of the traveling wave air mattress, which need not have reaction force sensors, may also be programmed to simulate relaxing motions. Thus, longitudinal traveling support pressure waves in the mattress may be programmed to simulate motions corresponding to floating on a surf wave, and may be accompanied by surf sounds. Also, laterally traveling support force pressure waves can be programmed to simulate gentle rolling or rocking motions of a boat and may be accompanied by water sloshing sounds and/or sounds simulating creaking oarlocks.

BRIEF DESCRIPTION OF THE DRAWINGS

FIG. 17 is a partly diagrammatic view of a fourth type of air mattress interface module and inflatable air mattress which together with the wave generator module of FIG. 13 comprise a third variation of a third embodiment of a traveling wave air mattress according to the present invention.

FIG. 18 is a timing diagram showing a first, active-deflation operating mode of the wave generator of FIG. 13.

FIG. 19 is a timing diagram showing a second, passive-deflation operating mode of the wave generator module of FIG. 13.

DESCRIPTION OF THE PREFERRED EMBODIMENTS

Figure 1:
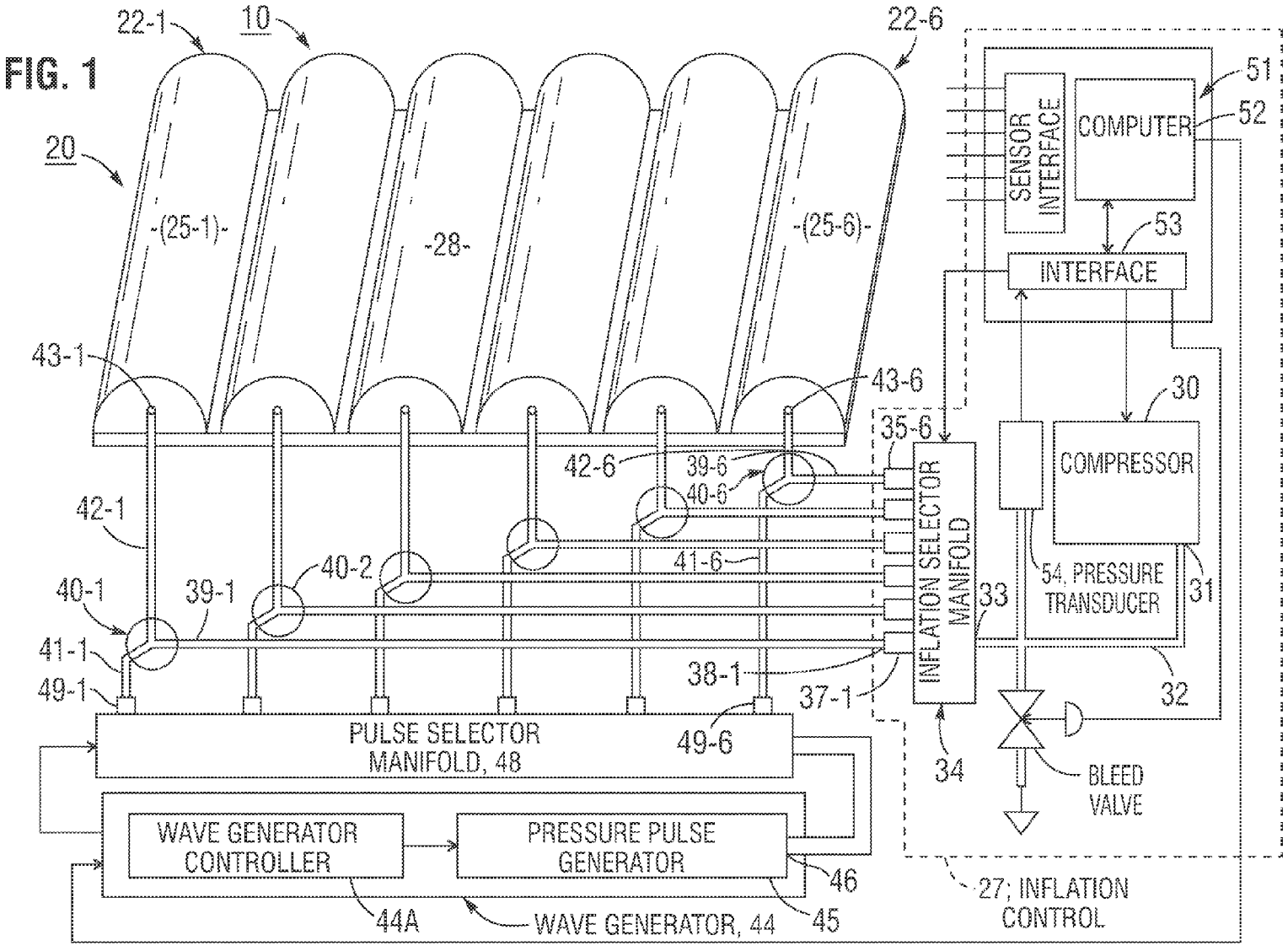
FIG. 1 is a partly schematic, partly perspective view of a traveling wave air mattress apparatus according to the present invention.

FIG. 1 is a perspective, partly diagrammatic view of a basic embodiment 10 of a traveling wave air mattress apparatus according to the present invention. The apparatus includes an air mattress 20 and a mattress inflation control apparatus 27. As shown in FIG. 1, mattress 20 has in upper plan view an outline shape similar to that of a typical hospital mattress, i.e., a longitudinally elongated rectangle having a length of about 80 inches and a width of about 30 to 36 inches. However, the exact dimensions and shape of mattress 20 are not critical, and may differ from the example given.

As shown in FIG. 1, mattress 20 has a generally flat rectangular base panel 21 which may be made of a sheet of a durable flexible plastic material such as polyurethane or polyvinyl. Base panel 21 has protruding upwards therefrom a longitudinally arranged series of laterally elongated, rectangular plan view air bladder cells 22. As shown in FIG. 1, each air bladder cell 22 extends from the left-hand longitudinally disposed edge 23 to the right-hand edge 24 of mattress 20. As is also shown in FIG. 1, when air bladder cells 22 are inflated, e.g., to a pressure of about 1 psi gauge, the cells have in a vertical longitudinal sectional view generally the shape of a laterally elongated semi-cylinder which has an arcuately curved, convex upper semi-cylindrical surface 25 that extends upwards from base panel 21.

Figure 2A:
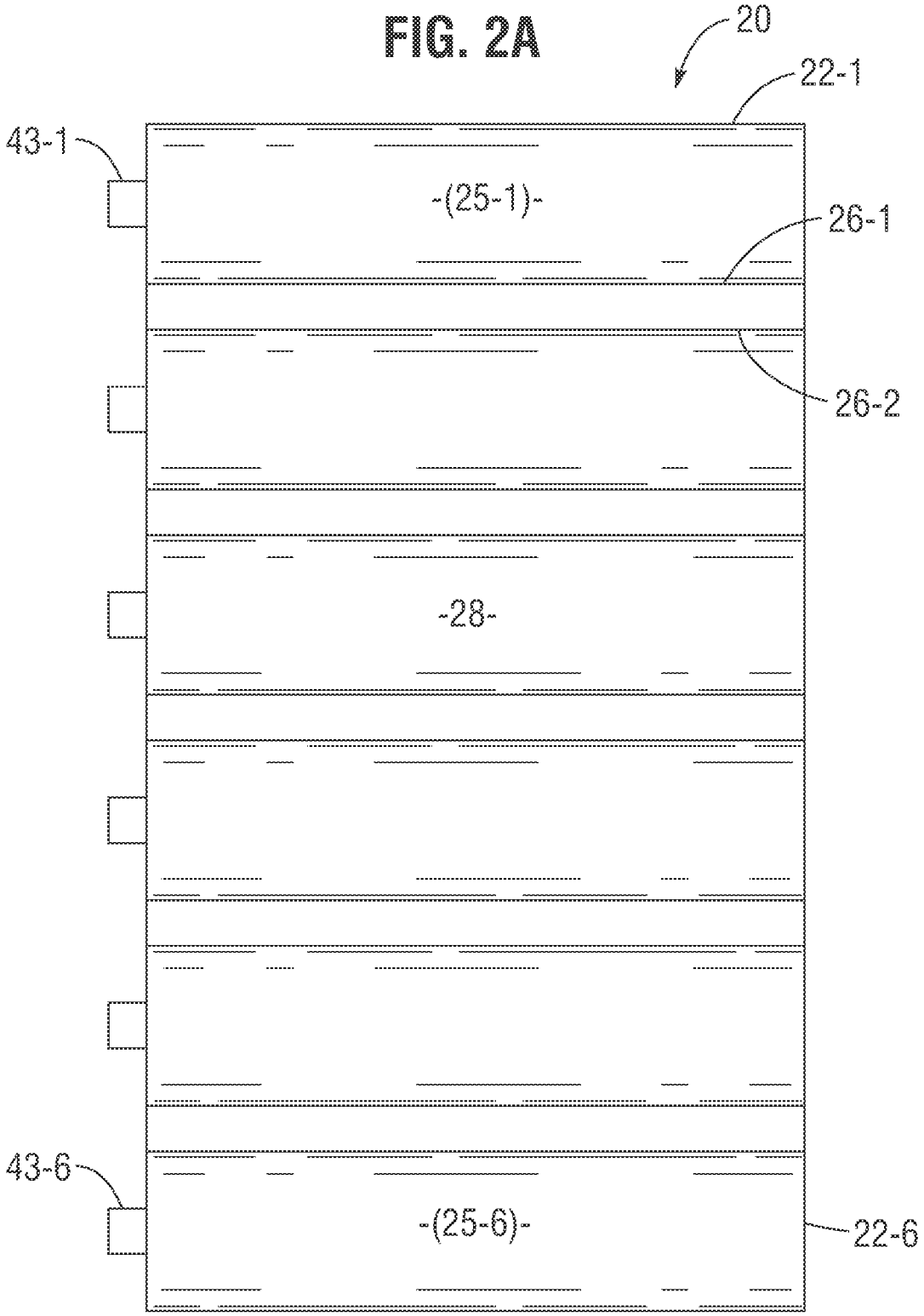
FIG. 2A is a fragmentary, partly diagrammatic upper plan view of an air mattress component of the air mattress apparatus of FIG. 1.

Although the transverse cross-sectional shape and size of air bladder cells 22 is not critical, a typical size and shape for use in a 80 inch×36 inch mattress having 6 laterally disposed air cells would be a semi-cylinder having a base diameter of about 13 inches and a length of about 36 inches, as shown in FIGS. 1 and 2A.

Confronting laterally disposed edges 26 of the air bladder cells 22 may contact each other, or as shown in FIGS. 1 and 2A, edges 26 may optionally be spaced longitudinally apart a short distance, e.g., 1 inch.

Referring to FIG. 1, it may be seen that traveling wave air mattress apparatus 10 includes a mattress inflation control apparatus 27 for inflating and deflating air bladder cells 22 to individual pressure levels which provide comfortable support for a person supported by mattress 20. Apparatus 10 also includes a wave generator apparatus 44 for varying air pressure in inflatable air bladder cells 22 in a manner which results in a traveling wave of support-force to propagate on the upper surface 28 of the mattress formed by the upper surfaces 25 of air bladder cells 22. Preferably mattress 20 is enclosed by a soft fabric mattress cover, and an optional thin layer of foam rubber between the upper surface of air bladder cells 22 and an inside surface of the mattress cover.

According to the invention, wave generator apparatus 44 is used to produce a traveling wave of support force for the body of a person supported on the upper surface 28 of mattress 20 by sequentially varying the air pressure in selected paths of individual air bladder cells 22, for example from the head-end to the foot-end of the mattress, in predetermined time sequences.

As shown in FIG. 1, mattress inflation level control apparatus 27 includes a source of pressurized air 30, which is preferably an air compressor but may optionally be a tank containing a pressurized gas such as air or nitrogen. Air pressure source 30, which is preferably a compressor driven by an electric motor 55, has an outlet port 31 connected through an outlet tube 32 to the inlet port 33 of a manifold 34. Manifold 34 has multiple outlet ports 35, e.g., six outlet ports 35-1, 35-2, 35-3, 35-4, 35-5 and 35-6, which are individually connected through tubes to the inlet ports 36-1 through 36-6 of a group of cell selector valves 37-1 through 37-6.

Each cell selector valve 37, which may be a simple on/off gate valve, has an outlet port 38 which is connected to a first, upper inlet tube port 39 of a Y-tube coupler 40. Each Y-tube coupler 40 has a second, lower inlet tube port 41 and an outlet tube port 42 which is connected to an inflation port 43 of an individual air bladder cell 22. Thus for example, outlet tube port 42-1 of Y-tube coupler 40-1 is connected with air pressure-tight fittings to air inlet port 43-1 of the first, head-end air bladder cell 22-1 of traveling wave air mattress 20, and so forth.

As will be explained in further detail below, each cell inflation selector valve 37 is controlled by electrical signals issued by an electronic control module 51 to inflate and deflate individual air bladder cells 22 to quiescent values which provide comfortable support for a person reclining on mattress 20.

Referring still to FIG. 1, it may be seen that wave generator apparatus 44 includes a pressure pulse generator 45 for creating negative and optionally positive pulses of air pressure in an outlet port 46 which are conducted to second, lower inlet port tubes 41 of Y-tube couplers 40. The output port 46 of pressure pulse generator 45 communicates with a source of pressurized air, such as a closed chamber part of a cylinder located on a side of a piston or diaphragm which is longitudinally movable in the cylinder in response to forces exerted on the piston by a linear actuator.

Wave generator apparatus 44 includes a wave generator controller 44A for issuing electrical command signals to pressure pulse generator 45 and other components of the wave generator apparatus. Wave generator controller 44A is preferably a computer or programmable logic controller (PLC), and preferably communicates with or is optionally replaced by a computer 52 of inflation control apparatus 27.

The magnitude of the negative air pulses need not be any greater than the maximum intended inflation pressure of any air bladder cell 22. For example, if the intended maximum inflation pressure of any of air bladder cells 22-1 through 22-6 is 1 psi, the negative pulse-generating capability of pressure pulse generator 45 should be sufficient to draw all of the air from an air bladder cell 22, e.g., about 1.38 cubic feet, within a pre-determined maximum time limit, e.g., 10 seconds. In actuality, the exhaustion rate of pressure pulse generator 45 may be less, since operation of the invention envisions only a fractional reduction of the pressure in an air bladder cell 22 from a quiescent value, e.g., one-half.

According to the invention, after a negative pressure pulse has been applied to an air bladder cell 22, the air pressure in that cell may be changed to a quiescent or bias valve different than pressure at the beginning of the pulse, but is typically restored to the original bias pressure valve. In either case, a single pressure pulse generator 45 within wave generator 44 may be used in conjunction with pulse selector valve array 47 to route negative or positive pulses of air pressure to selected air bladder cells 22. Thus, as shown in FIGS. 1 and 2, pressure pulse generator 45 has a single outlet port 46 which is connected through a manifold 48 and pressure pulse selector valves 49 of valve array 47 to second, lower inlet port tubes 41 of selectable Y-tube couplers 40. Each pulse selector valve 49, which may be a simple on/off gate valve, is controlled by electrical signals issued by wave generator controller 44A.

Referring to FIG. 1, it may be seen that mattress inflation control apparatus 27 includes an electronic control module 51 for adjusting the static or quiescent inflation pressure levels of air bladder cells 22 to values which provide comfortable support to a person lying on the upper surface 28 of air mattress 20, and for controlling functions of wave generator 44.

As shown in FIG. 1, electronic control module 51 preferably includes a computer 52 or a similar programmable electronic component such as a microprocessor or programmable logic controller (PLC) which emits through an interface module 53 command signals for actuating various components of the apparatus 27, such as compressor 30, cell inflation selector valves 37 and optionally pulse selector valves 49. Computer 52 also receives through interface module 53 various feedback signals such as valve configuration and compressor outlet pressure from a pressure transducer 54, etc.

Depending upon whether mattress system 10 is to be configured as a relatively inexpensive, relaxation-inducing system, or a precision therapeutic system for use in hospitals and similar locations, the system 10 may include less or more complexity and cost-increasing components. For example, while a low-cost traveling wave mattress 20 intended for recreational or relaxation purposes according to the present invention would not require body support-force sensors, embodiments of the invention intended for use in hospital environments would desirably include a force sensor array that used at least one force sensor associated with each air bladder cell of the mattress, to monitor reaction support forces exerted by the air bladder cells on the body of a patient.

Figure 2B:
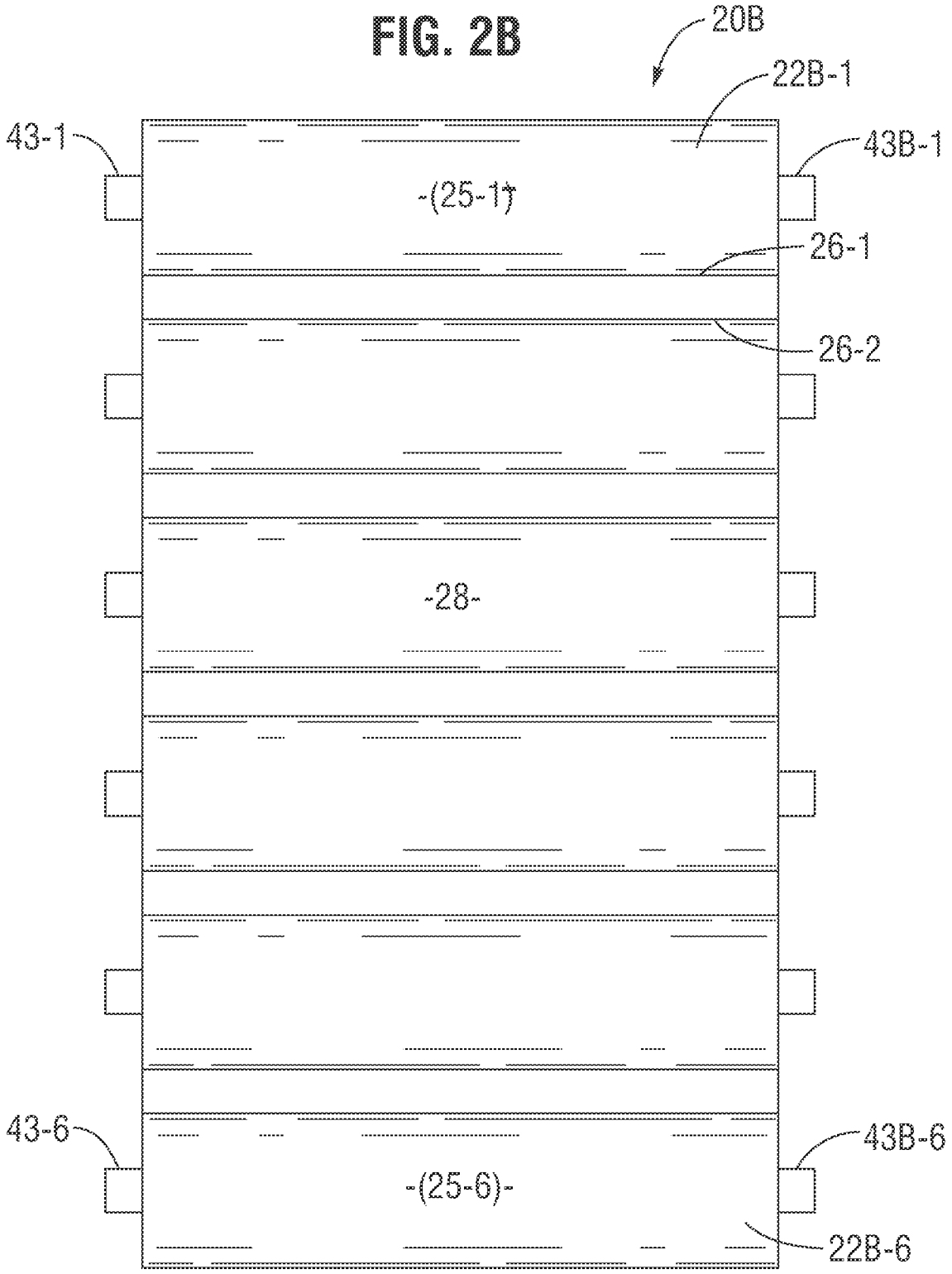
FIG. 2B is a fragmentary, partly diagrammatic upper plan view of a first modification of the air mattress of FIG. 2A.

FIG. 2B illustrates a modification 10B of the traveling wave air mattress 10 according to the present invention. As shown in FIG. 2B, each of the air bladder cells 22B of modified air mattress 20B has in addition to inlet port 43 a second inlet port 43B for connection directly to a separate pulse selector valve 49. This construction eliminates a requirement for Y-tube couplers 40, since each cell pulse selector valve 37 may be connected directly to a separate bladder cell inflation port 43B. However, the embodiment which employs Y-couplers as shown in FIGS. 1 and 2A is preferred, because it minimizes the number of tubes connected to mattress 20.

Figure 3A:
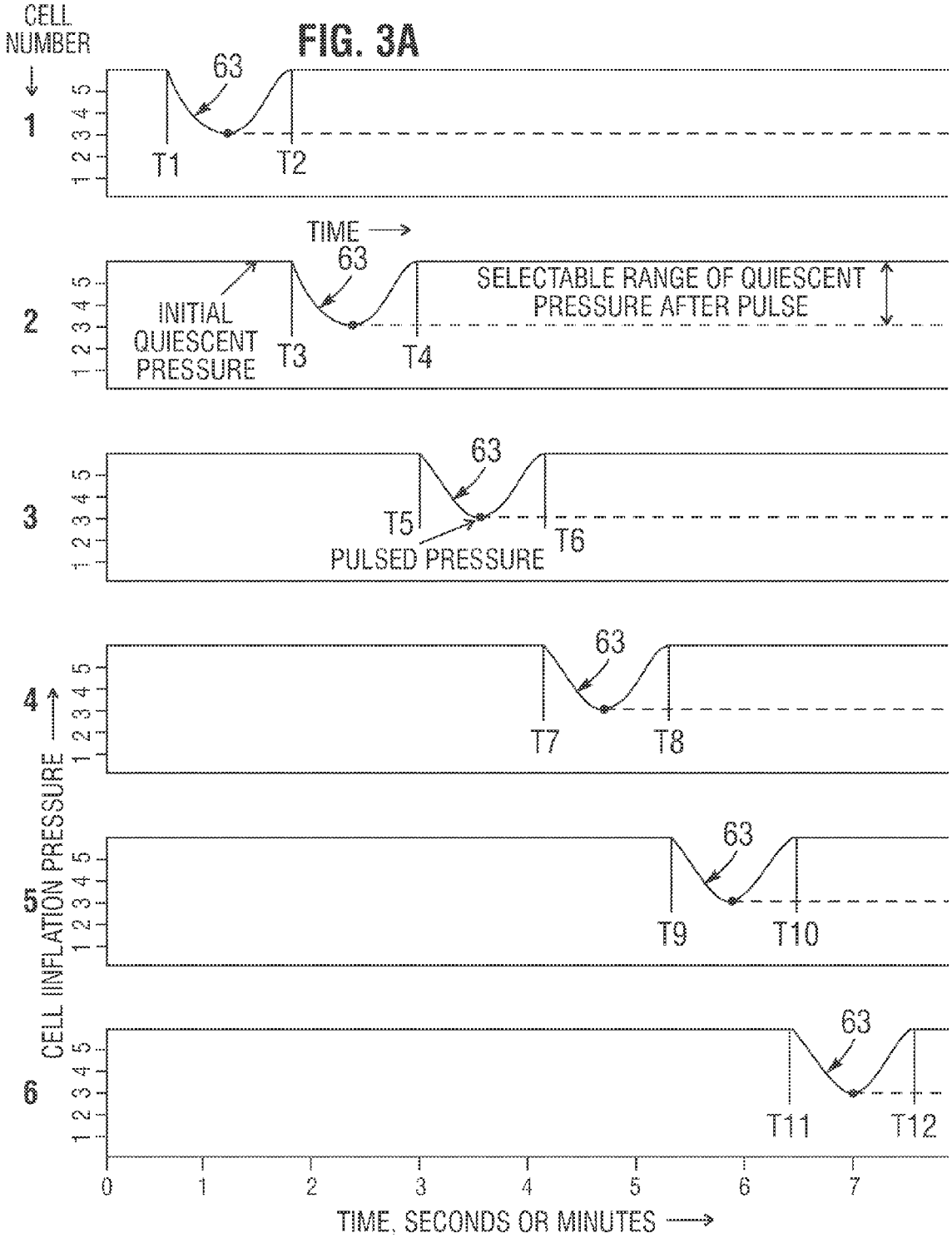
FIG. 3A is a timing diagram showing relative timing and amplitudes of negative air pressure pulses and traveling support force waves of the apparatus of FIG. 1.

FIG. 3A is a timing diagram showing a typical pattern of variation of air pressure in individual transverse rows of air bladder cells 22 of the basic, relaxational embodiment of traveling wave air mattress system 10 shown in FIGS. 1 and 2A.

Referring to FIG. 3A, mattress inflation control apparatus 27 is first directed by computer 52 to switch on electrical power to drive motor 55 of air compressor 30. By employing command signals issued from computer 52 through interface module 53 to air bladder cell selector valves 37, individual air bladder cells 22-1, 22-2, 22-3, 22-4, 22-5 and 22-6 may be inflated to pre-determined air pressure values monitored by compressor pressure transducer 54. As shown in FIG. 7B, the initial quiescent or bias values of pressure to which individual air bladder cells 22 are inflated need not all be the same.

After the individual air bladder cells 22-1 through 22-6 have been inflated to pre-determined quiescent values, command signals may be initiated by computer 52 and issued through interface module 53 and a wave generator controller 44A to initiate operation of wave generator 44. For example, a first step in the operation of wave generator 44 would be to actuate a first pressure pulse selector valve 49 of pressure pulse generator 45 to thus provide an air flow path between outlet port 46 of pressure pulse generator 45 through lower inlet port tube 41-1 of Y-tube coupler 40-1 to air inlet port 43-1 of first air bladder cell 22-1.

Next, as shown in line 1 of FIG. 3A, pressure pulse generator 45 is powered on at a time T1 in response to a command signal from computer 52. Applying power to pressure pulse generator 45 causes a solenoid, pneumatic actuator cylinder or stepper motor-driven linear actuator to move a diaphragm or piston 57 in a closed cylinder 58 which has on a first active side 59 of the piston 57 a port 46 connected through a pulse selector valve 49 of pulse selector valve array 47 to the second, lower inlet port tube 41-1 of Y-junction coupler 40-1 connected to inflation port 43-1 of air bladder cell 22-1. Pressure pulse generator 45 may also have located on a second, down-stroke side of piston 57 a second, storage chamber 61, which may be optionally connected through air-tight fittings and an optional valve to a pneumatic accumulator 62.

As shown in FIG. 3A, a first air pressure pulse 63 emitted by pressure pulse generator 45 and conducted to a first air bladder cell 22-1 has generally an amplitude which varies as a function of time as the negative half of a sine wave. However, the shape of air pressure pulse 63 may optionally be varied under computer control to approximate that of a rectangle, trapezoid, triangle, or other such shape.

The magnitude of air pressure pulse 63 is variable under computer control to a desired value, but typically would be about half or less than the maximum quiescent or bias pressure level in a given air bladder cell or group of air bladder cells. For example, for a quiescent air pressure level of 1 psi in a cell 22 of mattress 20, the amplitude of air pressure pulse 63 would typically be about 0.5 psi or less.

Figure 3B:
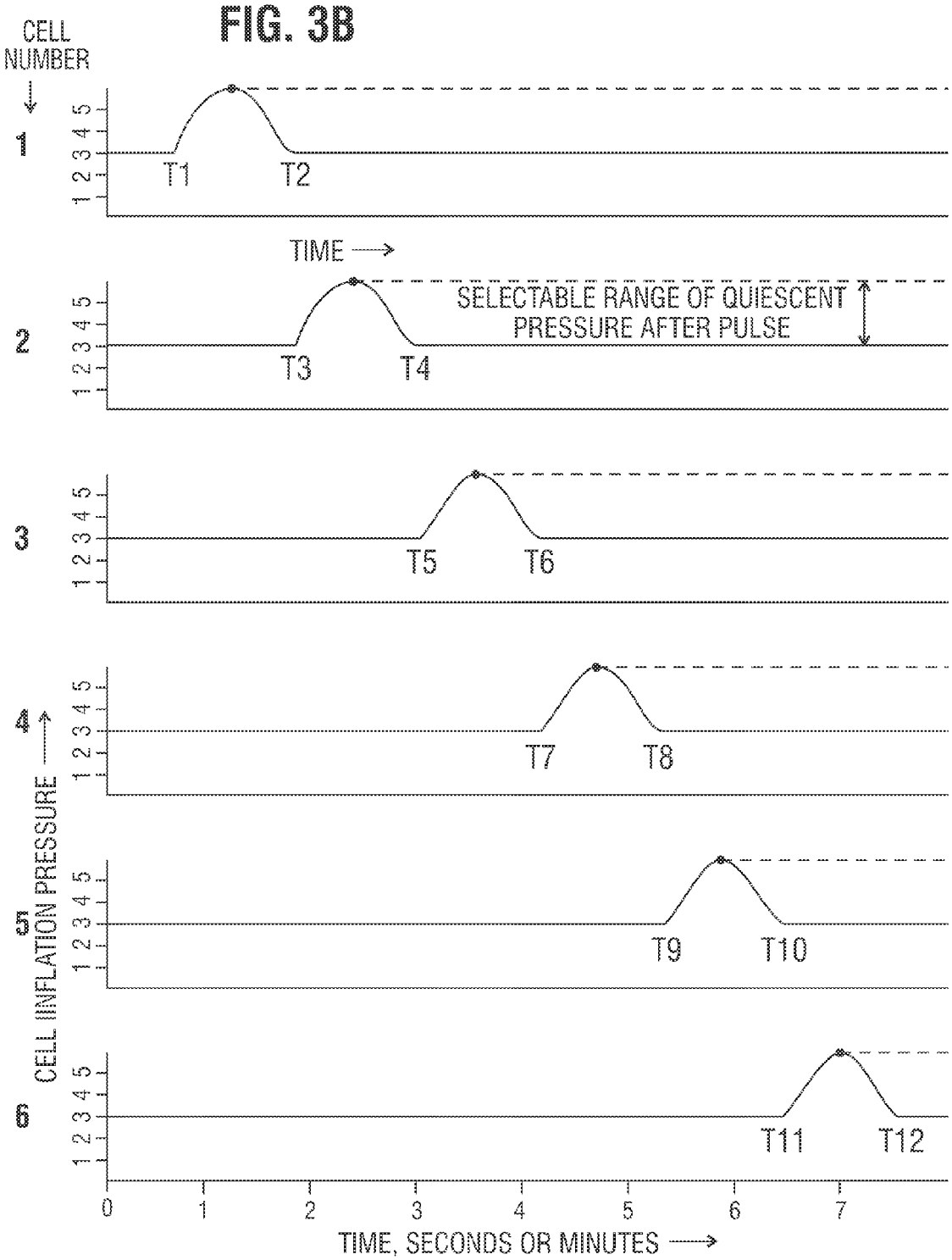
FIG. 3B is a timing diagram similar to FIG. 3A but showing positive pressure pulses and traveling support force waves.

As shown in FIG. 3A, first air pressure pulse 63 is a negative-going pulse that temporarily reduces the air pressure in air bladder cell 22-1. It is envisioned that for use of mattress 20 in hospital beds or other such therapeutic applications, the pulse of air pressure produced by pressure pulse generator 45 would typically be negative, to thus temporarily reduce the reaction force exerted on a patient's body by a particular air bladder cell 22 or a group of air bladder cells 22. However, as shown in FIG. 3B, the pulse generator 45 can be configured and commanded to alternatively produce positive-going pressure pulses, for applications such as relaxational uses of mattress 20.

The period of pulse 63 may be adjusted to any suitable value under computer control. Thus, the time interval between the beginning, T1 and the end, T2 of pressure pulse 63 shown in line 1 of FIG. 3A can be any desired value, e.g., several seconds to several minutes or longer.

Referring now to line 2 of FIG. 3A, it may be seen that pulse generator 45 is used to apply a second air pressure pulse 64 in a sequence of air pressure pulses to a second air bladder cell 22-2 at a programmable time T3. Beginning time T3 of second pulse 64 may be coincident with the end of pulse 63, or delayed to occur at any desired programmable time period later than T2, e.g., 1 second, several seconds, or longer. In exactly the same manner, successive air pressure pulses 65, 66, 67 and 68 may be applied to air bladder cells 22-3, 22-4, 22-5 and 22-6, which cells are located progressively further towards the foot-end of air mattress 20 from the head-end air bladder cell 22-1.

As shown in lines 1-6 of FIG. 3A, a negative pressure wave is produced in a continuous sequence of air bladder cells 22-1 through 22-6 to thus produce a traveling wave of reduction in support force for the body of a person supported by air mattress 20. However, it should be understood that characteristics of the traveling pressure wave produced by pressure pulse generator 45 of pressure wave generator 44 and hence characteristics of traveling body force support waves may readily be modified in real time by suitably programming computer 52. For example, referring to FIGS. 2A and 9, the traveling pressure wave may be programmed to skip over selected air bladder cells, such as even cells 22-2, 22-4, by not applying negative pressure pulses to those cells. In fact, apparatus 10 may be programmed to produce sequences of air pressure pulses which travel in any arbitrary path between air bladder cells 22.

As may be readily understood, as shown in FIG. 3B, the pressure pulses produced by pressure pulse generator 45 may optionally be positive-going rather than negative-going, provided the quiescent pressure levels of air bladder cells 22 are initially adjusted to values less than maximum inflation levels.

Also, pressure wave generator 44 may optionally be directed by computer 52 to produce overlapping pressure pulses, parts of which are applied simultaneously to more than two cells or zones of cells to thus produce an overlapping body support-force wave. For example, referring to FIG. 3A, the initiation time T3 of a of second air pressure pulse 64 may occur between beginning and ending times T1 and T2 of first air pressure pulse 63, to thus produce a composite traveling support wave pulse which begins at T1 and ends at T4, and is longer than the individual pulses shown in FIG. 3A.

As shown by the dashed lines in FIGS. 3A and 3B, the pulse generator 45 may be programmed to cause some or all of the air bladder cells 22 that have received a pulse of air to retain the pressure level in the cell at its maximum changed value, or at a value intermediate between the initial quiescent level and the maximum changed level.

Pressure wave generator 44 may also be directed by computer 52 to produce two or more traveling support force waves which travel simultaneously on the upper surface 28 of mattress 20. Thus, for example, by programming computer 52 to direct wave generator 44 to sequentially apply air pressure pulses to longitudinally descending and ascending pairs of air bladder cells, a first traveling wave of support force may be launched on upper surface 28 an air mattress 20, which travels from the head-end to the foot-end of the mattress, and a second traveling wave of support force launched simultaneously, which travels from the foot-end to the head-end of the mattress. The foregoing pair of simultaneous traveling support waves may be produced by simultaneously applying pulses of air pressure to the following pairs of cells; (22-1 and 22-6), (22-2 and 22-5), (22-3 and 22-4), (22-3 and 22-4), (22-2 and 22-5), and (22-1 and 22-6).

Figure 4:
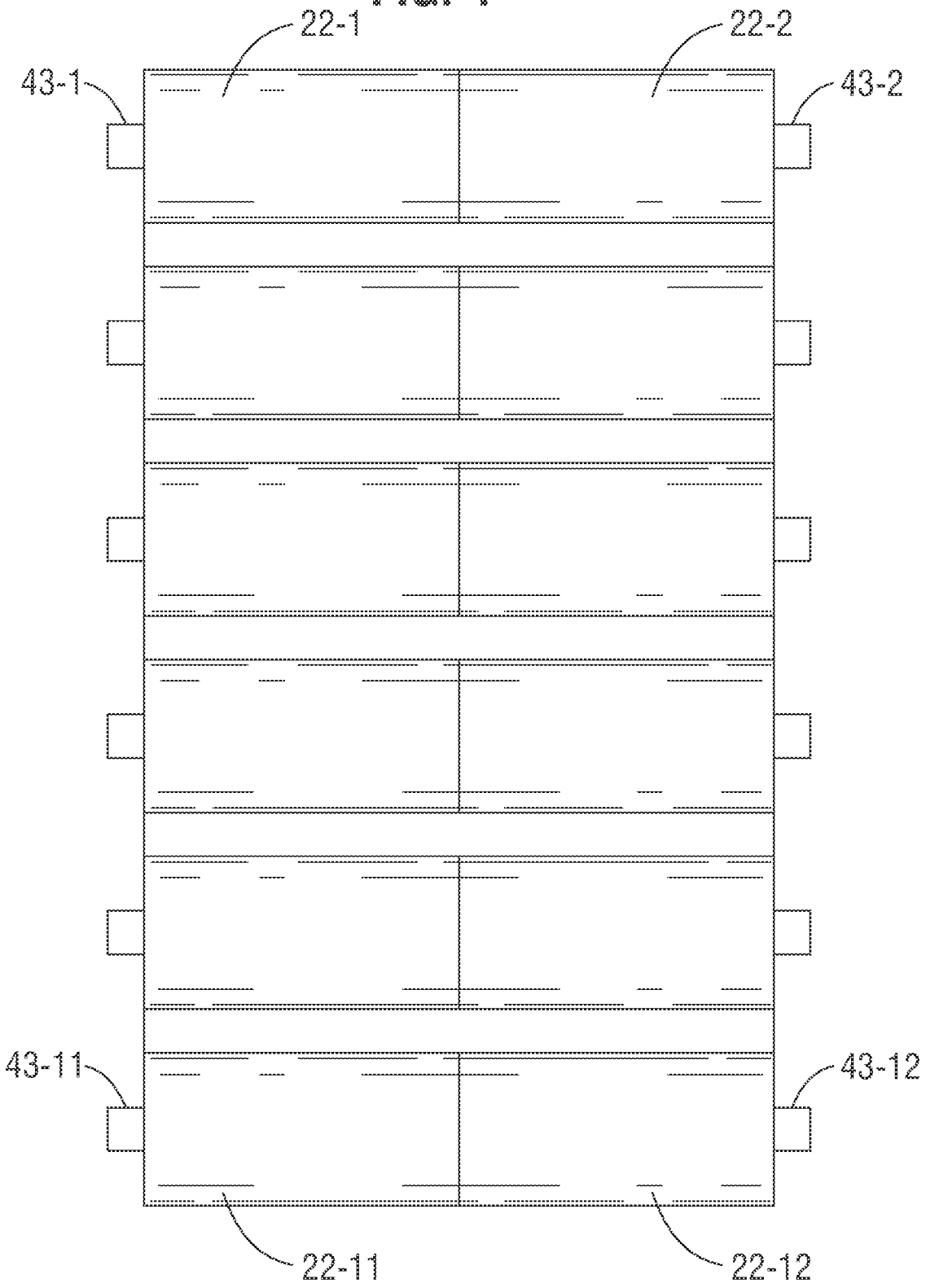
FIG. 4 is a view similar to that of FIG. 2B, but showing a modification of the air mattress having a second arrangement of individual inflatable air cells.

FIG. 4 illustrates another modification 20C of air mattress 20 shown in FIGS. 1 and 2A, which has six transversely disposed rows, each having 2 side-by-side air bladder cells 22C, for a total of 12 air bladder cells.

Figure 5:
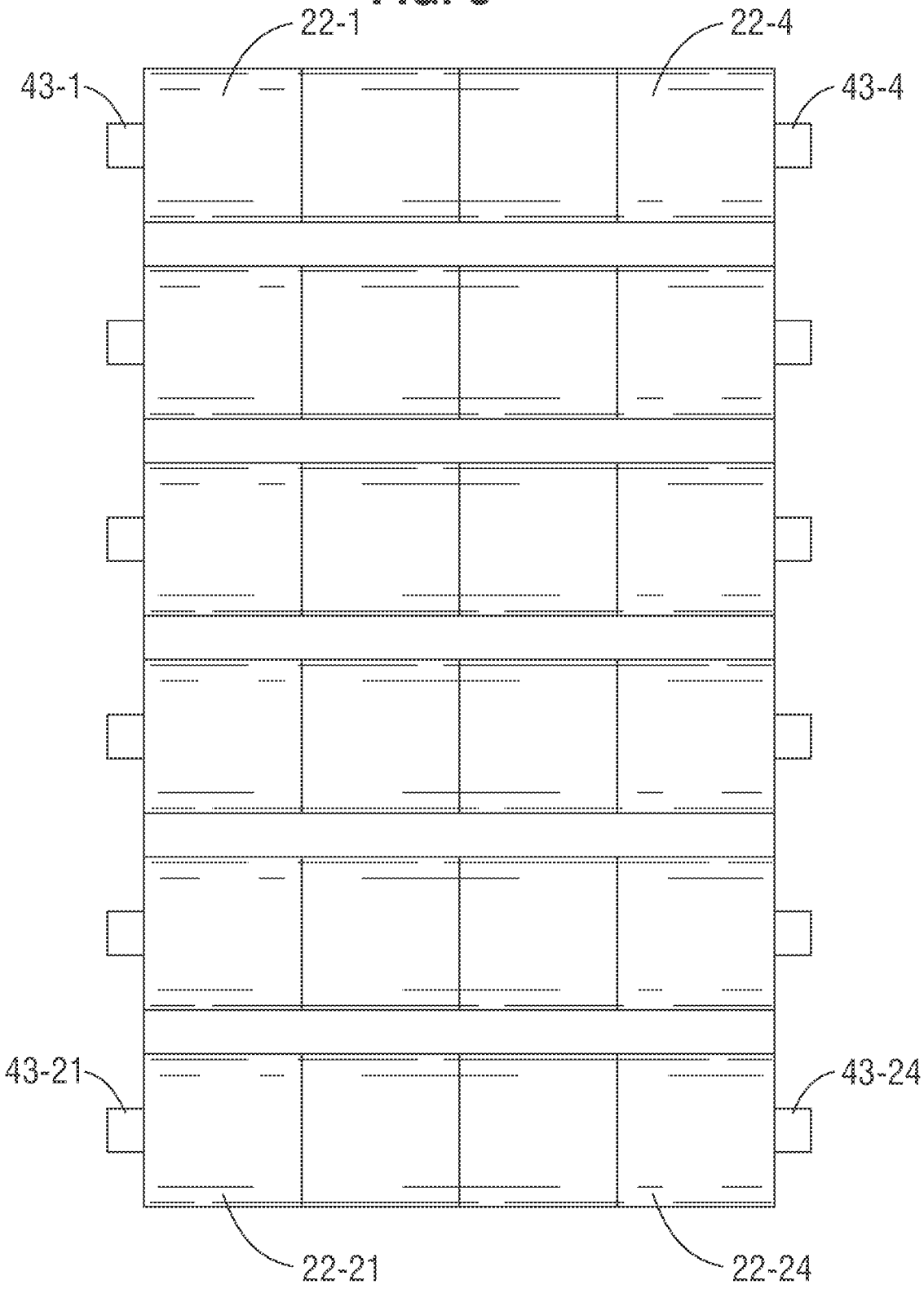
FIG. 5 is a view similar to FIG. 4, showing a third arrangement of air cells.

FIG. 5 illustrates another modification 20D of air mattress 20 shown in FIGS. 1 and 2A, which has six transversely disposed rows of 4 side-by-side air bladder cells 22D, for a total of 24 air bladder cells.

As discussed above, the traveling wave air mattress apparatus according to the present invention may be programmed to launch pairs of support force waves which travel simultaneously in opposite directions on the upper surface of the air mattress. From this discussion, it will be readily understood that pressure wave generator 44 may be directed by computer 52 to produce laterally moving traveling support force waves on the surface of an air mattress having multiple columns of air bladder cells, such as the mattresses shown in FIGS. 4 and 5. Moreover, it will be readily understood that according to the present invention, two or more traveling support waves may be simultaneously launched on the mattresses having multiple columns, and these waves can include simultaneously existing pairs of longitudinally traveling waves, laterally traveling waves, or combinations of simultaneous longitudinally and laterally traveling waves.

As shown in FIG. 1, wave generator apparatus 44 may be used as an accessory with an existing air mattress apparatus which includes a multi-cell air mattress 20 and an associated inflation control apparatus 27, by interconnecting the wave generator apparatus to the inflation control apparatus using Y-couplers 40. In this accessorized configuration, computer 51 of inflation controls module 51 can provide a signal to wave generator controller 44A indicating when adjustment of quiescent air pressures in air bladder cells 22 has been achieved by the inflation control apparatus 271, whereupon pulse pressure sequences causing traveling wave support force waves may be initiated by pressure pulse generator 45.

Figure 6:
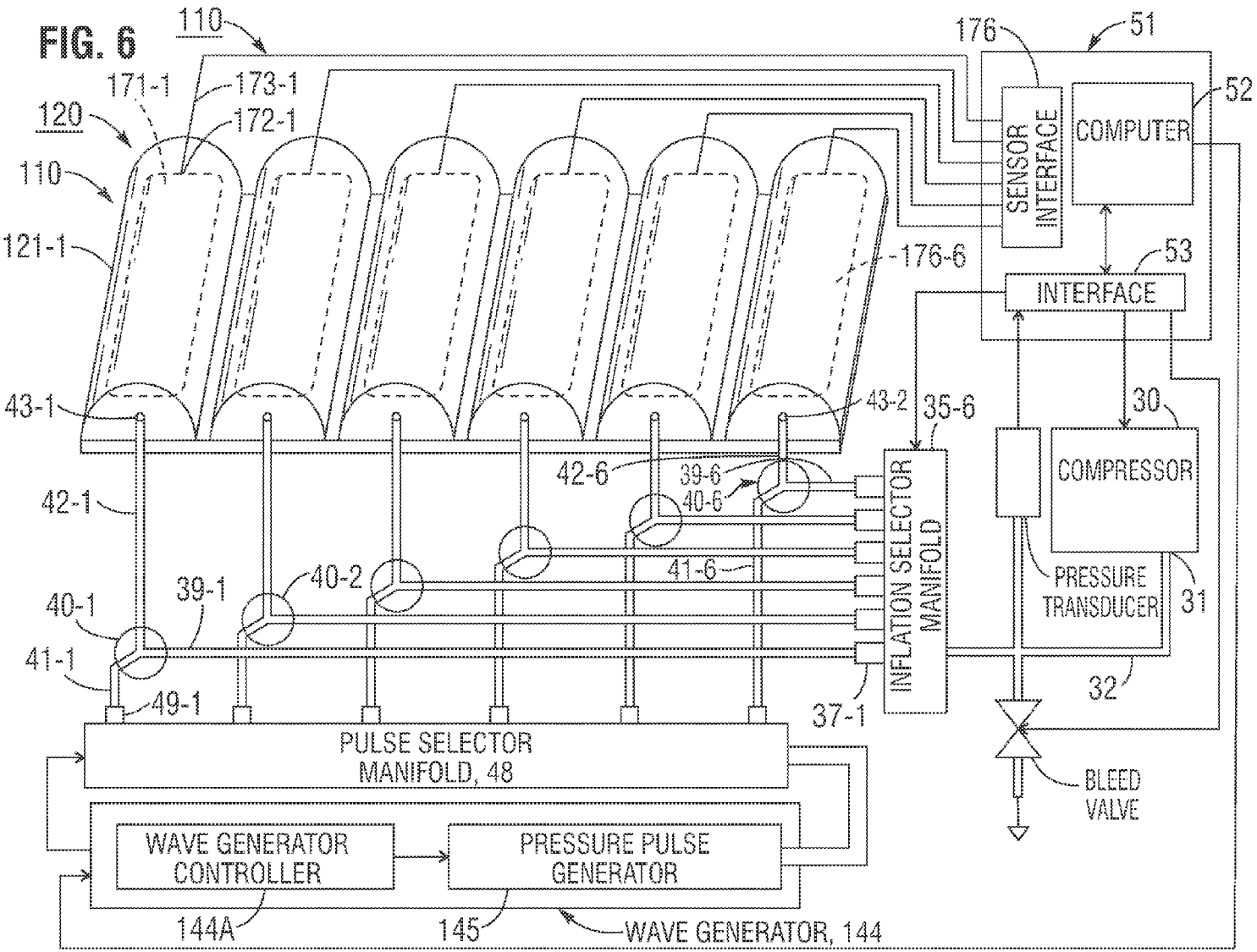
FIG. 6 is a partly schematic, partly perspective view of a modification of the traveling wave air mattress of FIG. 1, which is suitable for use in health care facilities.
Figure 7A:
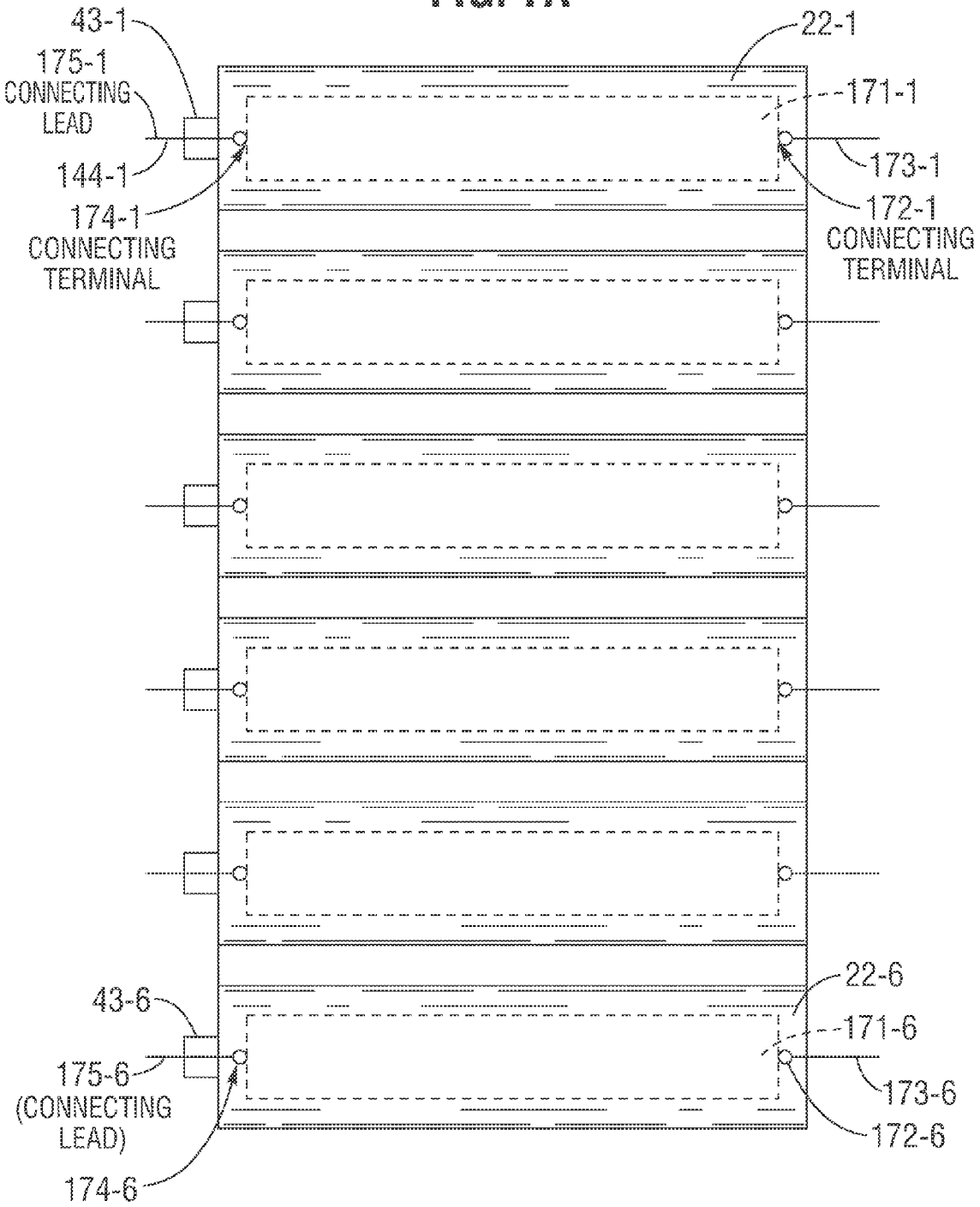
FIG. 7A is a partly diagrammatic upper plan view of an air mattress component of the air mattress of FIG. 6.
Figure 7B:
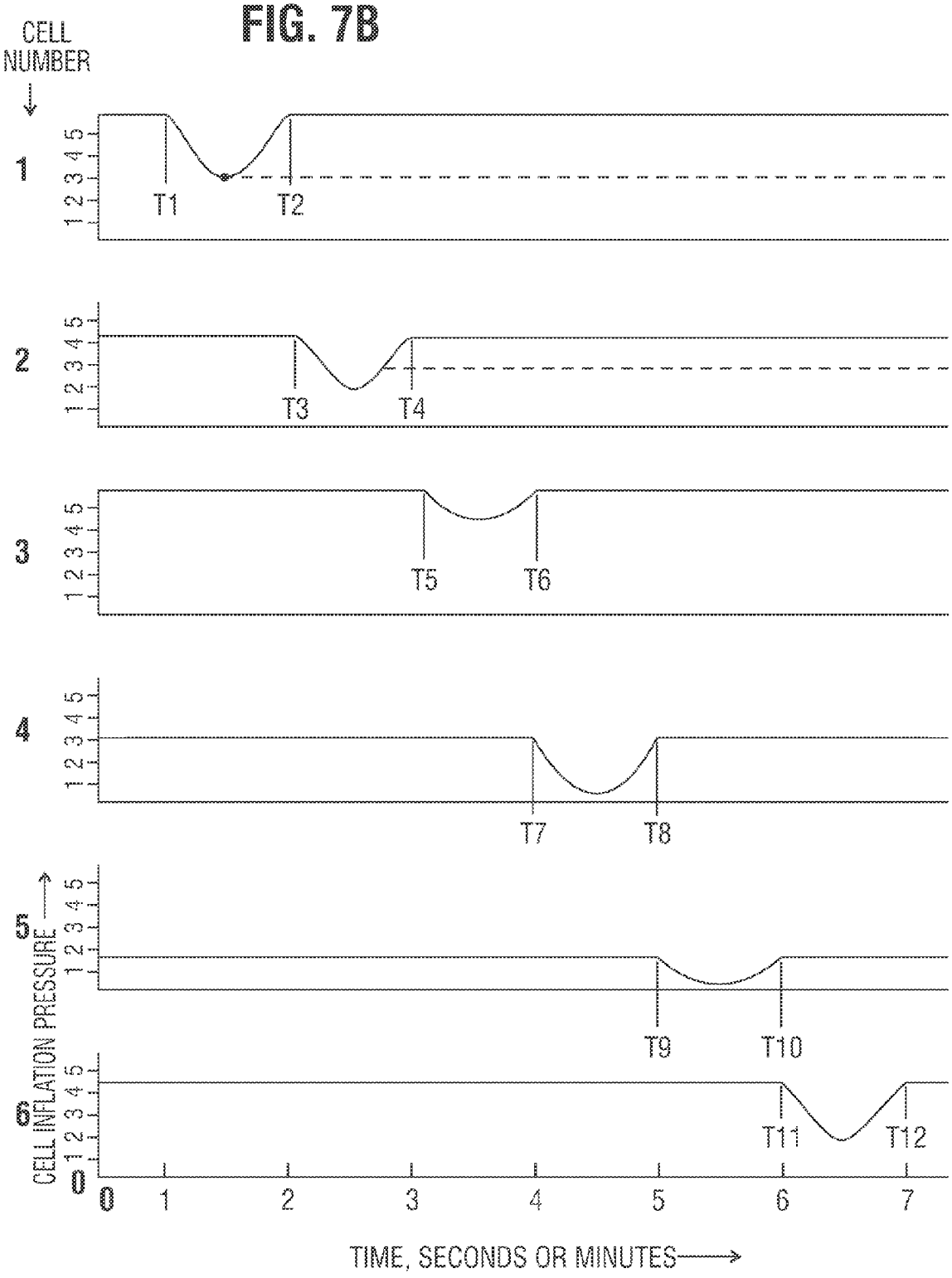
FIG. 7B is a timing diagram showing relative timing of pressure pulses and traveling support force waves of the apparatus of FIG. 6.

FIGS. 6 and 7A illustrate an embodiment 110 of a traveling wave air mattress according to the present invention, which is a modification of the basic embodiment 10 and is suitable for use in hospitals, nursing homes and similar facilities.

As shown in FIGS. 6 and 7A, modified traveling wave apparatus 110 includes a mattress 120 which may be similar in construction to the basic mattress embodiment 20 shown in FIG. 1 and described above. For ease of explanation, the mattress shown in FIGS. 6 and 7 is shown to have 6 transversely disposed, non-subdivided air bladder cells. However, mattress 120 actually includes a rectangular matrix of air bladder cells 122 as shown in FIGS. 4 and 5, rather then a single column of transversely disposed rows of air bladder cells, which enables air pressure and hence body support forces to vary only in a single, longitudinal head-to-toe direction.

According to the invention, air mattress 120 intended for use in hospitals would have as shown in FIG. 4 at least two and preferably three or four separate laterally disposed columnar zones of air bladder cells, as shown in FIG. 5.

As shown in FIGS. 5, 6 and 7A, an example air mattress 120 has six different transversely disposed, longitudinally ordered zones which span the head-to-toe length of the mattress. Each of the six transversely disposed rows of air bladder cells 122 is partitioned into four rectangular air bladder cells, each of which is hermetically isolated from all other air bladder cells.

Thus, in the example embodiment of air mattress 120 shown in FIGS. 5 and 6, there is a rectangular matrix array of 24 rectangularly-shaped air bladder cells 122-1 through 122-24, each of which is hermetically isolated from all of the other air bladder cells in the array. This construction enables each of the air bladder cells 122-1 through 122-24 to be separately inflated and deflated to individually adjustable bias or quiescent levels.

Apparatus 110 also has an inflation control apparatus 127 and a pressure wave generator 144 that enables air pressure pulses to be applied to individual air bladder cells 122 or groups of cells, in any desired combination and sequence.

Preferably, as shown in FIG. 6, traveling wave air mattress 110 includes a force sensor array 170. Force sensor array 170 is comprised of a group of individual flexible surface reaction force sensors 171-1 through 171-24, each of which is fastened in vertical alignment with a separate one of air bladder cells 122-1 through 122-24. Each sensor 171-1 through 171-24 is a two-terminal device which has a first output terminal 172-1-172-24 that is connected to an individual lead wire 173-1 through 173-24. Each sensor 171 also has a second output terminal 174-1-174-24 which is connected to an individual lead wire 175-1 though 175-24. Alternatively, the sensors 171-1 through 171-24 may be interconnected in an X-Y matrix, using 6 row-connector lead wires 176-1 through 176-6, and 4 column-connector lead wires 177-1 through 177-4. In either arrangement, the lead wires are used to connect sensors 171 to a sensor interface module 176 of inflation control apparatus 127.

Sensors 171-1 through 171-24 of sensor array 170 are used to monitor reaction support forces exerted on various parts of the body of a person supported by air bladder cells 122-1 through 122-24 of traveling wave air mattress 120.

Monitoring of reaction support forces exerted on a patient's body is performed when a patient first lies down on mattress 120, and the air bladder cells 122-1 through 122-24 are inflated to quiescent or bias values which provide comfortable support to the patient; ideally by reducing reaction support forces which are above a certain desired maximum by reducing air pressure in some cells and increasing air pressure in other cells.

At a pre-determined time after initial adjustment of quiescent air pressure levels in air bladder cells 122-1 through 122-24, computer 152 of inflation control apparatus 127 generates pre-determined patterns of pressure pulses which when applied to the air bladder cells, result in production of traveling waves of patient body-support forces that travel on the upper surface 28 of the mattress.

The magnitude, shape, timing and other characteristics of air pressure pulses generated by pressure pulse generator 145 may in general be similar to those of the pulses described above for the basic embodiment 10 of the traveling wave air mattress. However, since the air bladder cells 122-1 through 122-24 of air mattress 120 have distinct laterally separated as well as longitudinally separated locations, traveling pressure waves and hence traveling body support-force waves can be directed laterally and obliquely as well as longitudinally on the surface of the mattress. Moreover, as will be explained in detail below, surface reaction force sensor array 170 of air mattress apparatus 110 may be used to calculate in real time paths for reaction force support waves which can minimize long-term large-magnitude reaction forces which might be exerted on a patient's body, and thus prevent formation of decubitus sores.

Figure 8:
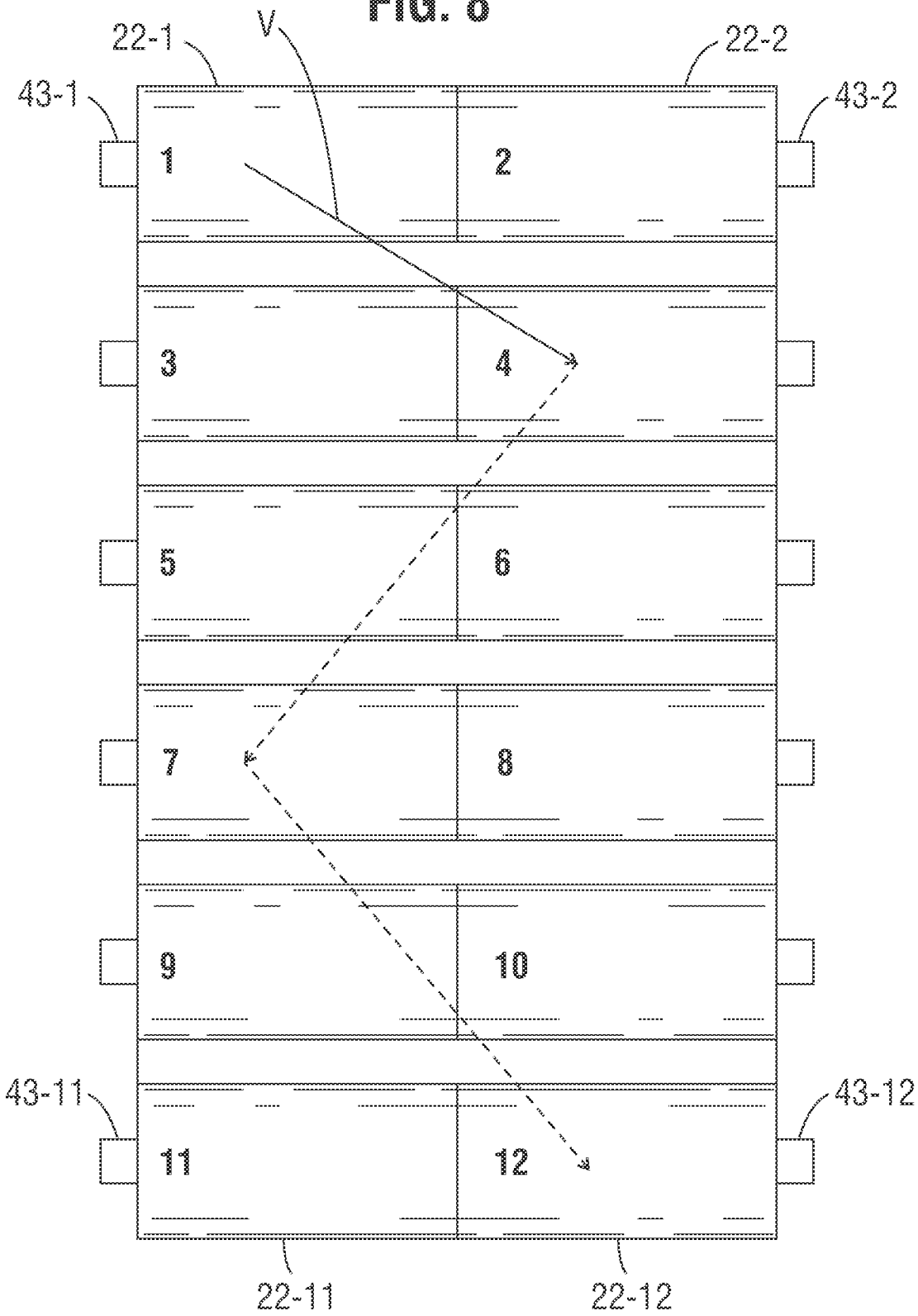
FIG. 8 is a diagrammatic upper plan view of a two-column by six row modification of the air mattress of FIG. 7A, showing a hypothetical reaction force gradient vector thereof.

An example of calculating a beneficial path of a traveling pressure support wave in response to reaction force measurements using sensor array 170 may be understood by referring to FIG. 8 and Table 1.

FIG. 8 is a diagrammatic upper plan view of a two-column by six row modification or part of air mattress 120. As shown in FIG. 5, there are twelve air bladder cells 122-1 through 122-12, each of which has attached to and in vertical alignment therewith a separate one of an array of surface reaction force sensors 171-1 through 171-12, which are used to produce a pressure map of surface reaction forces exerted on a patient's body. Hypothetical example values of measured patient body support reaction forces are listed in Table 1. As shown in FIG. 8, a surface reaction force gradient vector is constructed using the pressure/force map values of Table 1. The tail end of the gradient vector is located in air bladder cell number 122-1, since the highest surface reaction force, 1.5 kilopascals (kPa) was measured by sensor 171-1 in cell 122-1.

The second highest reaction force of 1.4 kPa was measured in cell number 122-4, so the first segment of the gradient vector V is directed from cell 122-1 to cell 122-4.

The third highest reaction force of 1.3 kPa was measured in cell number 122-7, so the second segment of gradient vector V is directed from cell 122-4 to cell 122-7.

The fourth highest reaction force of 1.1 kPa was measured in cell number 122-12, so the third segment of gradient force vector V is directed from cell 122-7 to cell 122-12.

According to the invention the segmented gradient force vector V measured and calculated as above is used to direct computer 52 to generate a pressure reduction wave which is applied consecutively to air bladder cells 122-1, 122-4, 122-7 and 122-12, thus producing a traveling surface support reaction force reduction wave which follows the measured reaction force gradient.

TABLE 1

| CELL NUMBER | MAX REACTION FORCE, kPa |
|---|---|
| 1 | 1.5 |
| 2 | 1.0 |
| 3 | 0.9 |
| 4 | 1.4 |
| 5 | 0.8 |
| 6 | 0.8 |
| 7 | 1.3 |
| 8 | 0.9 |
| 9 | 0.9 |
| 10 | 0.9 |
| 11 | 1.0 |
| 12 | 1.1 |

Figure 9:
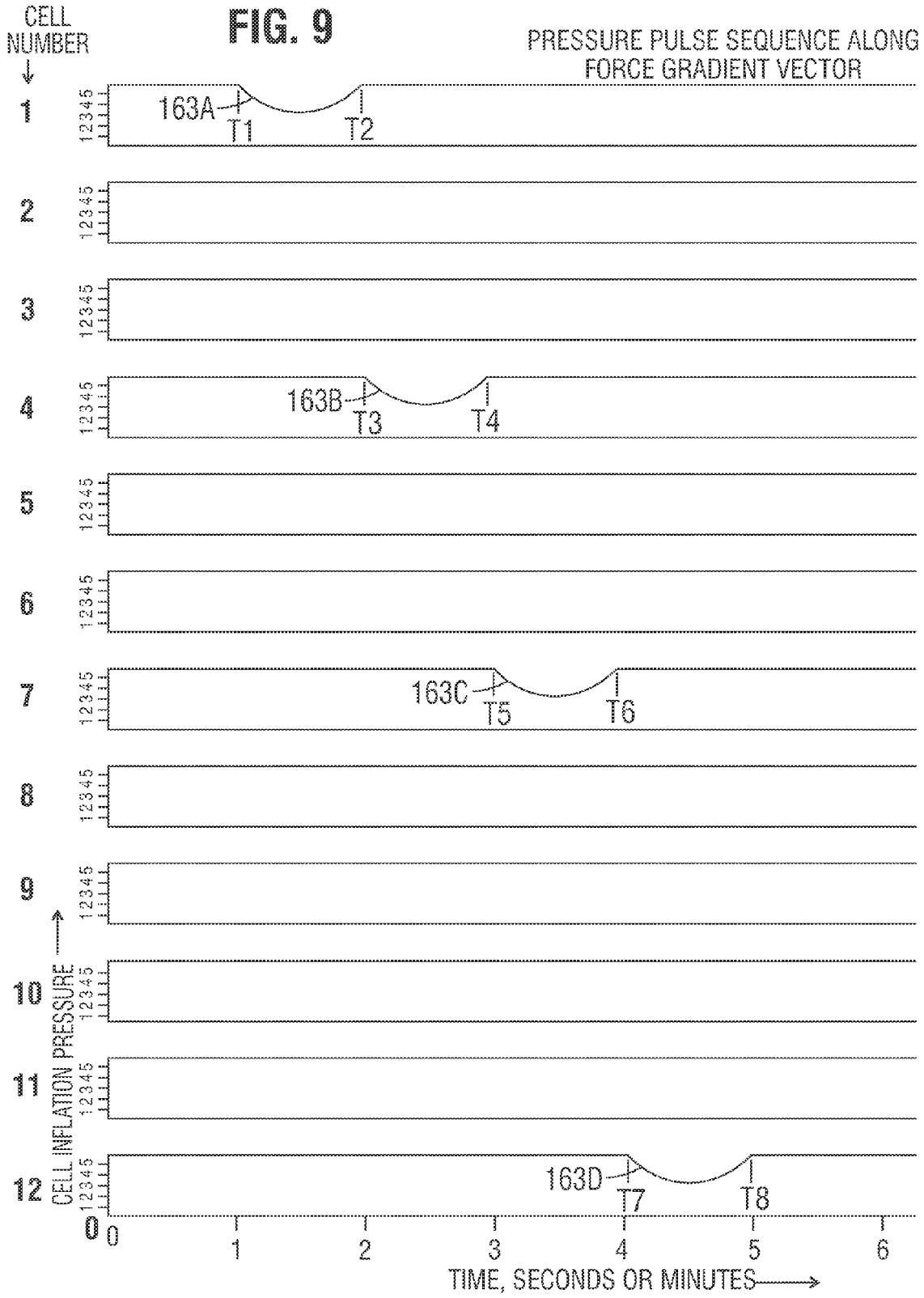
FIG. 9 is timing diagram showing a sequence of negative air pressure pulses applied to the mattress of FIG. 8 in the direction of the reaction force gradient vector.

FIG. 9 illustrates an example of a pressure pulse wave 163 which is applied by wave generator apparatus 144 to traveling wave air mattress 120 along the path of a gradient vector V calculated by computer 152 from reaction forces exerted on a patient's body and measured by sensors 171.

As shown in FIG. 9, traveling pressure pulse ware 164 is created by applying a first pulse 163A of negative pressure created by pressure pulse generator 145 to air bladder cell 122-1 between times T1 and T2. At a time T3 following T1 which optionally precedes T2, a second pulse of negative pressure 163B is applied to air bladder 122-4 and continued until T4. In an exactly analogous fashion, a third negative air pressure pulse 163C is applied to air bladder cell 7 between times T5 and T6, and a fourth and final negative air pressure pulse 163D is applied to air bladder cell 122-12 between times T7 and T8.

As can readily be envisioned by referring to FIGS. 6-9, the sequence of four negative air pressure pulses 163A, 163B, 163C and 163D applied to air bladder cells 122-1, 122-4, 122-7 and 122-12, respectively, creates a traveling wave of patient body support-force reduction. As described above, the air bladder cell air pressure reduction traveling wave is directed to follow the patient reaction support force gradient vector. Accordingly, by temporarily reducing the inflation pressure of air bladder cells which are exerting the greatest support force concentrations on a patient's body, these forces, which could cause decubitus sores if left unabated for long periods of time, will be substantially reduced for time periods proportional to the product of the length of pressure reduction pulse 163 and the number of times per day that the traveling pressure pulse wave cycle is repeated.

In general, during the generation of a traveling body support-force wave by a sequence of pressure reduction pulses applied to air bladder cells 122, pressures exerted on a patient's body by other air bladder cells, in contrast to total support forces, may increase, since the total support-forces are proportional to the fixed weight of a patient supported by the mattress and hence are constant over time intervals. Moreover, the traveling wave of support-force reduction, or patient movement may shift the distribution of body reaction support-forces at the end of a traveling wave cycle. For the foregoing reasons, sensor array 170 would desirably be used to continuously monitor body support reaction forces over the entire surface of mattress 120, to thus determine whether an initially measured force gradient has shifted location, whereupon successive cycles of traveling support force reduction may be propagated along the paths of newly determined body support-force gradient vectors.

Figure 10:
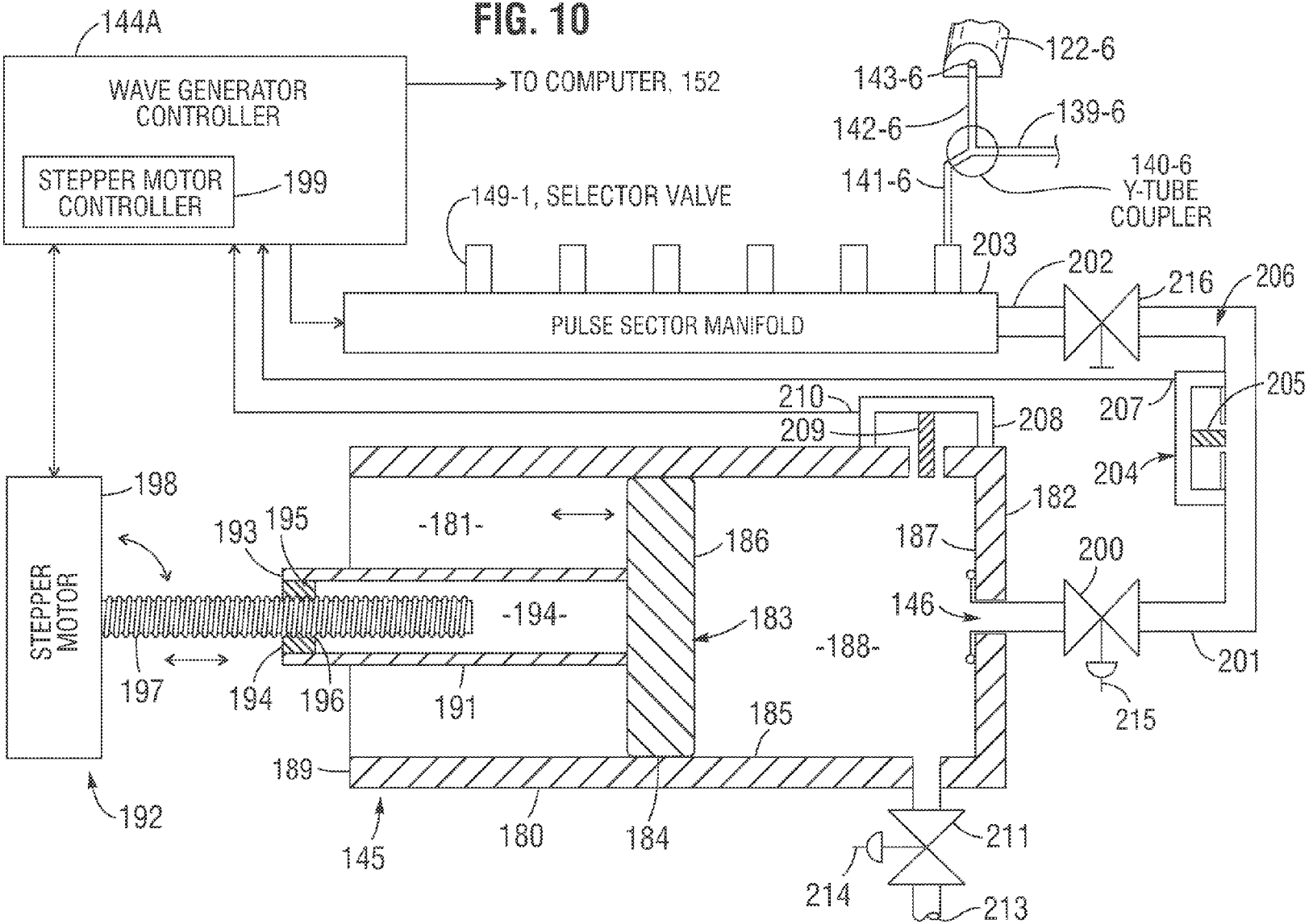
FIG. 10 is a partly diagrammatic view of a wave generator and pressure pulse generator for the apparatus shown in FIG. 6.

FIG. 10 is a partly diagrammatic view of pressure wave generator 144, which may be substantially similar in construction to pressure wave generator 44.

As shown in FIG. 10, pressure wave generator 144 includes a pressure pulse generator 145 that has a longitudinally elongated, hollow circular cross-section cylinder 180 which has disposed through its length a coaxial cylindrical inner bore 181. Bore 181 is sealed at a first, head-end of cylinder 180 by a transversely disposed circular disk-shaped cylinder head 182, which has disposed through its thickness dimension an air passageway which comprises an outlet port 146.

As shown in FIG. 10, bore 181 of pressure wave generator cylinder 180 has therewithin a circular disk-shaped piston 183. Piston 183 has an outer wall surface 184 which longitudinally slidably contacts in a hermetic seal the inner cylindrical wall surface 185 of cylinder 180.

As shown in FIG. 10, that side of cylinder bore 181 located between a head-end transverse surface 186 of piston 183 and the inner surface 187 of cylinder head 182 forms a cylindrically-shaped, head-space active chamber 188 which is positively pressurizable by longitudinal motion of the piston 183 towards the cylinder head 182, and negatively pressurizable by longitudinal motion of the piston towards the transverse base or end wall 189 of cylinder 180.

As shown in FIG. 10, piston 183 of pressure pulse generator 145 has extending longitudinally away from base end surface 190 of the piston a tubular drive shaft 191 which extends longitudinally outwards of lower transverse annular base or end wall 189 of cylinder 180.

Pressure pulse generator 145 includes a force actuator 192 to drive piston drive shaft 191 and piston 183 longitudinally rearward within cylinder 180 to thereby produce within active chamber 188 of the cylinder a negative pressure pulse. Force actuator 192 also has the capability of moving piston drive shaft 191 forward within bore 181 of cylinder 180 to thus restore piston 183 to its original longitudinal location within bore 181 of cylinder 180. Thus, if piston drive shaft 181 is pivotably joined to piston 183, force actuator 192 may consist of a rotary motor coupled to the outer end 193 of piston drive shaft 191 by an eccentric coupler such as a crank. However, in a preferred embodiment of pressure pulse generator 144, force actuator 192 has a different design and construction which provides more control of the characteristics of pressure pulses produced by movement of piston 183 in cylinder 180.

Thus, as shown in FIG. 10, piston drive shaft 191 of pressure pulse generator 145 has a hollow tubular construction which includes an elongated circular cross-section bore 194 that extends through the outer, rear transverse annular end wall 195 of the piston drive shaft. The piston drive shaft 191 has fixed within the lower end of bore 194 thereof a cylindrically-shaped follower or jack screw nut 195 which has through its thickness dimension a coaxial threaded bore 196. Bore 196 of follower or jack screw nut 195 receives threadingly therein an elongated threaded lead-screw or jack-screw 197 which is rotatably driven by a stepper motor 198.

Stepper motor 198 receives drive signals from a stepper motor drive electronic module 199 of a wave generator controller 144A which receives command signals from computer 152. This construction of the pressure wave force actuator facilitates repositioning the rest position of piston 183 within cylinder bore 181 to a rearward or retracted position, so that the piston drive shaft 191 and piston 183 can be extended forward to produce positive pressure pulses in outlet port 146, followed at the end of a pulse by retraction to a rearward quiescent position which reduces pressure in an air bladder cell to its quiescent pressure value.

Preferably, as shown in FIG. 10, pressure pulse generator 145 includes optional components which enable it to introduce negative or positive air pressure pulses into individually selectable air bladder cells 122 that may be initially inflated to different quiescent pressures, and restore the inflation level to the initial quiescent pressure level at the end of a pressure pulse. Thus, as shown in FIG. 10, outlet port 146 of pressure pulse generator 145 is connected through a cylinder isolation valve 200 through a tubular connector fitting 201 to the inlet port 202 of a pulse selector valve array manifold 203. Cylinder isolation valve 200 has a value actuator control input terminal lead 215 which is connected to a command signal output terminal of wave generator controller 144A.

The pressure pulse generator 145 includes a cell pressure sampling pressure transducer 204 which has a pressure probe 205 that communicates with a hollow cylindrical bore space 206 of tubular fitting 201 that is located between pulse selector valve array manifold 203 and cylinder isolation valve 200. Cell pressure transducer 204 has an output terminal lead 207 which is connected to wave generator controller 144A, which has a command signal output terminal I that is connected to stepper motor electronic drive module 199. Wave generator controller 144A. is also connected to a signal input interface port of computer 152, to provide coordination between the computer and wave generator controller.

As shown in FIG. 10, pressure pulse generator 145 also has a pulse generator cylinder pressure sampling transducer 208 which has a pressure probe 209 that communicates with active chamber head space 188 of bore 181 of cylinder 180. Cylinder pressure sampling transducer 208 has an output terminal lead 210 which is connected to a signal input interface port of wave generator controller 144A.

As is also shown in FIG. 10, pressure pulse generator 145 has a cylinder bleed valve 211 which has an inlet port 212 that communicates with active chamber 188 of cylinder 181, an outlet port 213 which communicates with the atmosphere, and an electrical valve actuation control input terminal lead 214 which is connected to a command signal output interface terminal of wave generator controller 144A.

Optionally, as shown in FIG. 10, pulse generator may include a manifold isolation valve 216 between tubular fitting 201 and pulse selector manifold 203.

Operation of pressure pulse generator 145 constructed and configured as shown in FIG. 10 is as follows.

First, computer 152 issues a command which is transmitted through wave generator controller 144A to open a selected one of pulse selector valves 149 that is connected to a selected air bladder cell 122 which is to receive a pulse of air pressure, and to open optional manifold isolation valve 216.

Second, cell pressure sampling transducer 204 is used to measure the value of quiescent air pressure in the selected air bladder cell 122.

Third, cylinder air pressure sampling transducer 208 is used to measure cylinder air pressure in active chamber 188 of cylinder 180.

Fourth, the difference in air pressures measured by air bladder cell pressure transducer 204, and cylinder air pressure measured by cylinder air pressure transducer 208 is computed by wave generator controller 144A or computer 152. If the measured air pressure in cylinder active chamber 188 is less than the quiescent air pressure in a selected air bladder cell 122, a command signal is issued to stepper motor controller 199 which causes piston drive shaft 191 and piston 183 to be extended forward within cylinder 180 to increase air pressure in active chamber 188 of the cylinder until it is equal to the quiescent air pressure in the selected air bladder cell 122.

For example, piston 183 may be extended forward in cylinder bore 181 from position 3 to position 2 in FIG. 10. This longitudinal position of piston 183, where the pressures in cylinder 180 and a selected air bladder cell 122 are equalized, is defined as a first home position for the piston, prior to production of a pulse of pressurized by air pressure pulse generator 145, and introduction of the pulse of pressurized air into a selected air bladder cell 122. Cylinder bleed valve 211 may also receive command signals from wave generator controller 144A to enable air flow between cylinder chamber 188 and the atmosphere, to thus facilitate pressure equalization.

Fifth, as shown in FIG. 10, cylinder isolation valve 200 is opened in response to a command signal issued through waves generator controller 144A by computer 152, which also causes a command signal to issue to stepper motor driver 199. If the command signal from computer 152 is to reduce air pressure in a selected air bladder cell 122 by producing a negative pressure pulse, piston 183 is retracted to a position such as positions 3, 4 or 5. If the command signal from computer 152 is to increase pressure in a selected air bladder cell 122, piston 183 is extended forward to a longitudinal location such as position 1 in FIG. 10. In either case, cylinder isolation valve 200 and optional manifold isolation valve 216 remain open during the initial movement of piston 183.

Sixth, at a predetermined time at which a pulse of air pressure into an air bladder cell is to be terminated, piston 183 is commanded to move in a direction opposite to its direction at the beginning of an air pressure pulse. For example, if the air pressure in a selected air bladder cell is to be restored to the value which it had at the beginning of a pressure pulse, piston 183 would be returned to the initial home position, such as location 2 in FIG. 10. However, if it is desired to return the air pressure in a selected air bladder cell 122 to a new quiescent value different from an original quiescent value, piston 183 is moved to a different location at the end of a pressure-pulse cycle.

Seventh, at a predetermined time period after piston 183 has ceased movement at the end of a pressure pulse cycle, pulse selector valve 149, optional manifold isolation valve 216, and cylinder isolation valve 200 are closed in response to command signals received from wave generator controller 144A.

As shown in FIG. 10, the output port of each pulse selector valve 149 is coupled to the inlet port 143 of an air bladder cell 122 through the input tube 141 and a Y-coupler 140 which also has an input tube 139 which is coupled to an inflation control apparatus 127 that is used to initially inflate the air bladder cells to initial quiescent pressure values which provide comfortable support to a patient. However, pressure pulse generator 145 may optionally be used to inflate and deflate air bladder cells 122 to initial quiescent pressure values prior to initiation of the seven-step wave generation process described above.

With this optional configuration, pulse selector valves 149 perform a dual function, initially adjusting quiescent pressure levels in individual air bladder cells 122, and subsequently introducing a sequence of pressure pulses into the air bladder cells to create a traveling support force wave. Thus, with this optional configuration, the requirement for a separate inflation control apparatus 127 and Y-couplers 140 is eliminated, and each pulse selector valve 149 is connected directly to the port 143 of an air bladder cell 122.

The pressure pulse generator 145 of the pressure wave generator 144 described above requires a piston/cylinder displacement volume at least as large as the maximum volume of air which is intended to be simultaneously input to or removed from one or more air bladder cells 22 or 122 Consequently, pressure pulse generator 145 is ideally suited for use with air mattresses having a relatively large number e.g., 12 to 24 or more, of relatively small air bladder cells. However, for air mattresses which have a relatively small number, e.g., 4 to 6 of relatively large air bladder cells, the displacement requirements for single piston stroke deflation or inflation of one or more air bladder cells may require that the displacement volume and hence size of cylinder 180 of air pulse generator be undesirably large for some applications.

For example, for an air mattresses 20 of the type shown in FIG. 1 which has 6 air bladder cells 22 which have a semi-cylindrical shape when inflated to a normal bias pressure of 14.7 lbs./in$^2$ (101.3 kPascals), i.e., 1 atmosphere, a diameter of 13 inches and a lateral length of 3 feet, the volume of each air bladder cell would be about 1.276 cubic feet. Therefore, the volume of cylinder 180 of air pulse generator 185 shown in FIG. 10 would need to be 1.276 cubic feet or larger, if operation of the pulse generator required complete deflation or re-inflation of a single air bladder cell 22 with a single stroke of piston 183 within cylinder 180. An embodiment of a wave generator of the present invention which is useful for creating traveling support force waves in air mattresses having relatively large air bladder cells is shown in FIGS. 11A and 11B.

Figure 11A:
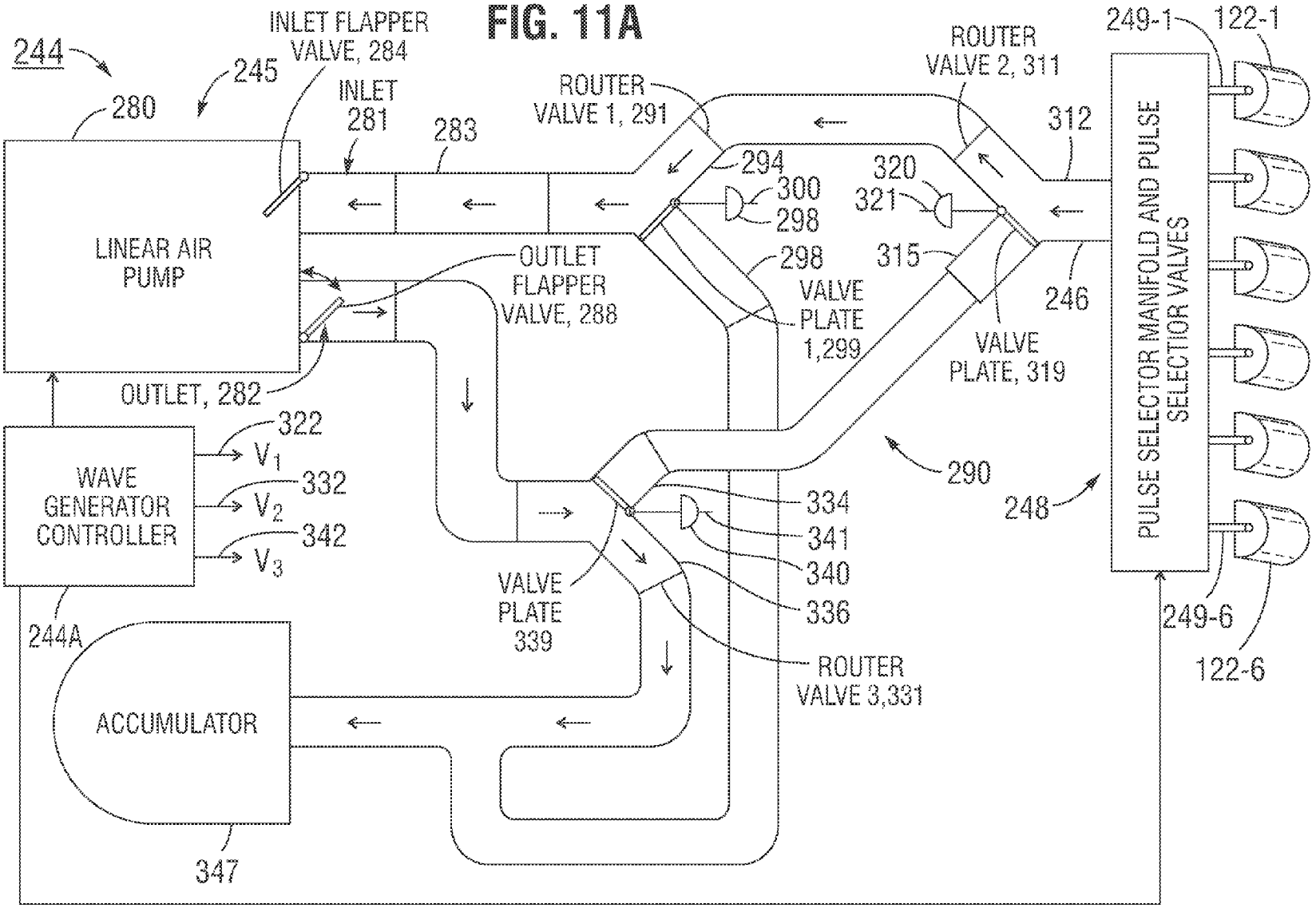
FIG. 11A is a partly diagrammatic view of another embodiment of a traveling wave air mattress apparatus according to the present invention showing valves of the apparatus configured for producing negative air pressure in pulses to air bladder cells of an air mattress.
Figure 11B:
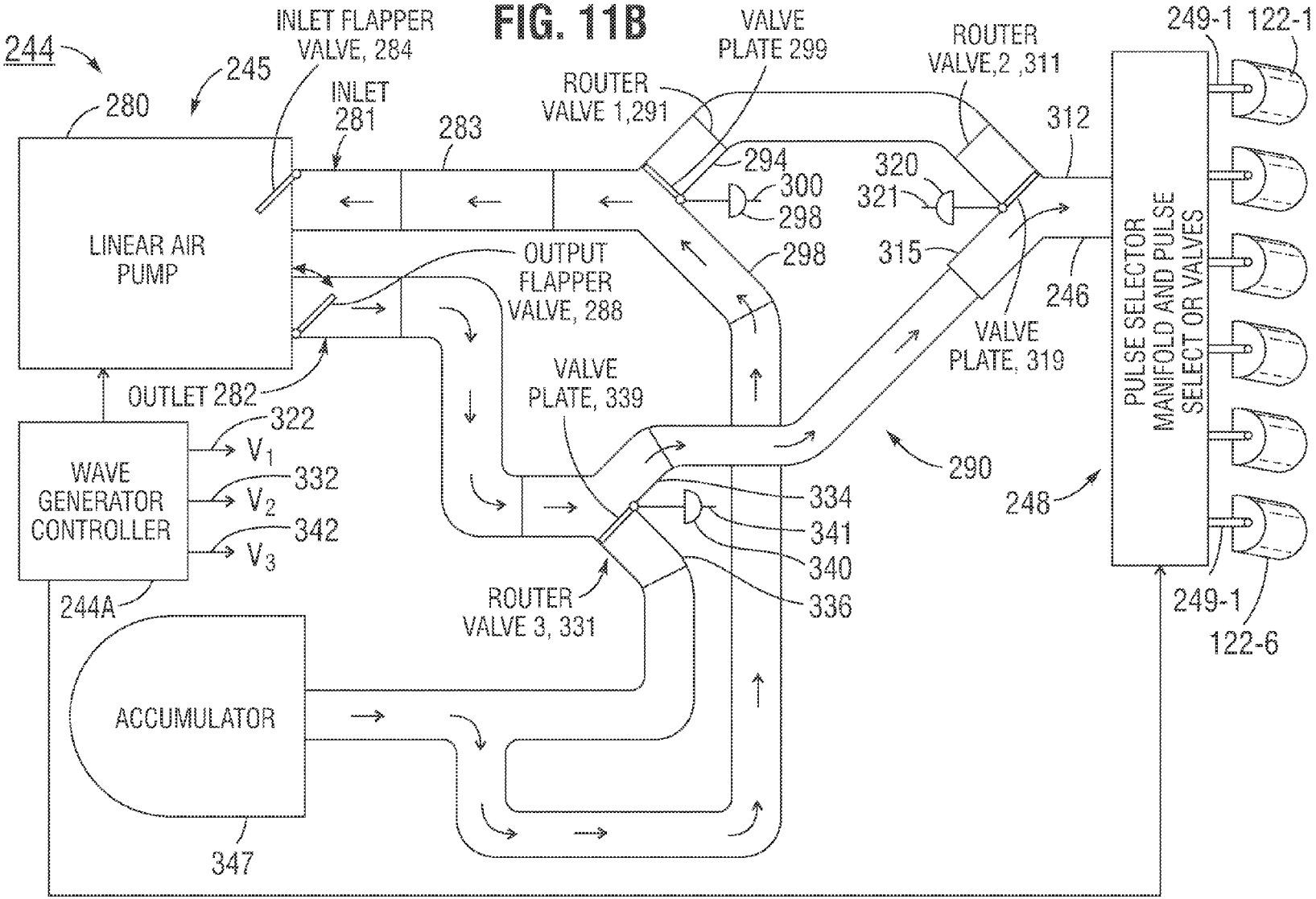
FIG. 11B is a view similar to that of FIG. 11A, but showing valves configured for producing positive pressure variations in air bladder cells.

As shown in FIGS. 11A and 11B, an embodiment of wave generator 244 for deflating and re-inflating air bladder cells 22 of a relatively large air mattress 20 of the type shown in FIG. 1 has an air pulse generator 245 that includes an air pump 280 which has a vacuum inlet port 281 and a pressure output port 282. An example of a suitable type of air pump 280 for use in the present application is a linear air pump which uses a magnet moving in response to time varying electromagnetic force fields produced by an alternating current to drive a piston in a reciprocating motion within a cylinder. Such pumps are described in further detail in "Mechanisms And Mechanical Devices Sourcebook." $5^{th}$ Edition by Neil Sclater, McGraw-Hill, New York 2011, page 374.

As can be envisioned by referring to FIGS. 11A and 11B, when a piston 286 moves inwardly within cylinder 283 of air pump 280 in response to an attractive electromagnetic force, a negative pressure occurs in pump inlet port 281, which may draw air through the inlet port 281 and past an inlet flapper valve 284 into the head-space 285 between the piston 286 and the inlet port. During this first, inlet part of the air pump cycle, negative pressure within head space 285 of air pump 280 also draws an outlet flapper valve 288 inwardly to a closed position which seals off communication between the pump head-space and outlet port 282.

Conversely, when piston 286 moves outwardly in response to a repulsive electromagnetic force, a positive pressure pulse is produced in head space 285 of cylinder 283. The positive pressure closes input flapper valve 284 and opens output flapper valve 287, through which a pulse of air at positive pressure is expelled through outlet port 282 of the air pump.

From the foregoing description, it can be readily understood that powering air pump 280 with alternating current at a 60 Hz line frequency results in 60 pulses per second of negative air pressure occurring in inlet port 281 of the pump, and positive pulses of air pressure occurring in outlet port 282 at the same frequency but shifted 180 degrees in phase from the negative air pulses at inlet port 281.

As shown in FIGS. 11A and 11B, traveling wave generator 244 includes a pressure pulse routing assembly 290 comprised of routing valves and air conduits which are interconnected between linear air pump 280 of air pulse generator 245, and pulse selector valves 249 on pulse selector manifold 246. Pressure-pulse routing assembly 290 connects negative air pressure inlet port 281 of air pump 280 to a selected air bladder cell 22 during the initial, negative-going part of a negative pressure pulse applied to an air bladder cell, and connects the air bladder cell to positive pressure at outlet port 282 of the pump during the final, positive-going part of a negative pressure pulse.

As shown in FIGS. 11A and 11B, pressure-pulse routing assembly 290 includes three 2-way or diverter-type valves which are all similar in construction and function. Thus, as shown in FIGS. 11A and 11B, wave generator apparatus 244 includes a first, pump inlet router valve 291 which has an output port 292 that is connected to inlet port 281 of pump 280 by a tubular pressure-tight tube 293. Pump inlet router valve 291 has a first, upper selector-manifold inlet port 294 which is connected to a second, selector manifold router valve 311. Selector manifold router valve 311 is connected to inlet port 246 of manifold 248 by a tubular pressure-tight tube 297. Pump inlet router valve 291 also has a second, supply-air inlet port 298.

As shown in FIGS. 11A and 11B, pump inlet router valve 291 has an internal valve plate 299 which is pivotably movable by a solenoid actuator 300 in response to an electrical control signal input to an input terminal 301 of the actuator, which is connected by an electrical wire to a first valve control output port 302 of wave generator controller 244A.

As shown in FIGS. 11A and 11B, valve plate 299 has a first pivotable position in which the valve plate is pivoted counterclockwise to block air flow to supply-air inlet port 298, and to permit air flow between selector manifold inlet port 294 and outlet port 292 of the valve. In this position, negative air pressure pulses at inlet port 281 of pump 280 are transmitted through pump inlet router valve 291, through selector manifold router valve 311, and through a pulse selector valve 249 of pulse selector manifold 248 to a selected air bladder cell 22, thus enabling air to be withdrawn from the air bladder cell through the port 43 of the air bladder cell, which is connected to the selector valve during the first, negative going part of a negative pressure pulse produced by air pump 280.

Since, as pointed out above, the air pump 280 produces a sequence of pressure pulses at a line frequency rate, e.g., 60 Hz, a negative pressure pulse selected by wave generator controller 244A to have a length of 1 second, for example, will actually consist of 1 second long pulse modulated at 60 Hz, i.e., a one-second long train of 60 pulses.

As shown in FIG. 11A, air flow from a selected air bladder cell 22 and pulse selector valve 249 is routed through selector manifold router valve 311. Pulse selector manifold router valve 311 has a common outlet port 312 which is connected by a hermetically sealed coupling to input port 246 of pulse selector manifold 248. Pulse selector manifold router valve has a first, upper outlet port 313 which is connected to upper inlet port 294 of pump inlet router valve 201 by a tubular pressure-tight coupler 314. Pulse selector manifold router valve 311 also has a second, lower outlet port 315.

As shown in FIGS. 11A and 11B, pulse selector manifold router valve 311 has an internal valve plate 319 which is pivotably moveable by a solenoid actuator 320 in response to an electrical control signal input to an input terminal 321 of the actuator which is connected by an electrical wire to a second valve control output port 322 of wave generator controller 244A.

As shown in FIGS. 11A and 11B, valve plate 319 has a first pivotable position in which the valve plate is pivoted clockwise to block air flow between lower output pulse selector manifold port 246 and lower port 315 of pulse selector manifold router valve 311. As shown in FIG. 11A, with valve plate 319 in this position, there is an unobstructed air flow path between manifold output port 246, through valve 311 to input port 294 of pump inlet valve 291, and thence into inlet port 281 of pump 280, Referring again to FIG. 11A, it may be seen that pulse routing assembly 290 of wave generator 244 includes a third, pump outlet router valve 331 which has an inlet port 332 that is connected to outlet port 282 of pump 280 by a tubular pressure-tight tube 333. Pump outlet router valve 331 has a first, upper outlet port 334 which is connected by a tubular pressure-tight tube 335 to the lower inlet port 315 of pulse selector manifold router valve 311. Pump outlet router valve 331 also has a second, lower exhaust outlet port 336.

As shown in FIGS. 11A and 11B, pump outlet router valve 331 has an internal valve plate 339 which is pivotably moveable by a solenoid actuator 340 in response to an electrical control signal input to an input terminal 341 of the actuator, which is connected by an electrical wire to a third valve controller output port 342 of wave generator controller 244A.

As shown in FIGS. 11A and 11B, valve plate 339 has a first pivotable position in which the valve plate is pivoted clockwise to block air flow between outlet port 282 of pump 280 and lower input port 315 of pulse selector manifold router valve 311. In this position, there is an unobstructed air flow path between pump outlet port 282 and lower outlet port 336 of pump outlet router valve 331.

As indicated by the arrow-headed lines in FIG. 11A, with the three router valves 291, 311 and 331 configured as shown in FIG. 11A and described above, operation of pump 280 causes air to be withdrawn from a selected air bladder cell 22 into pump inlet 281 and discharged from pump outlet port 282 through output port 336 of pump outlet router valve 331.

Outlet port 336 of pump outlet router valve 331 may optionally open directly to the atmosphere. Preferably, however, as shown in FIGS. 11A and 11B, outlet port 336 is connected to a first port 341 of a three-way tubular Y-junction or T-junction coupler 340. A second port 342 of coupler 340 is coupled through a tube 344 to lower input port 298 of pump inlet router valve 291. A third port of coupler 340 is coupled through a tube 345 to the inlet port 246 of a pneumatic accumulator or receiver 347. Thus, as shown in FIG. 11A, during the initial, negative-going half of a negative air pressure pulse applied to an air bladder cell 22 to withdraw air and reduce the inflation pressure of the cell, withdrawn air is routed into accumulator 347. Optionally, accumulator 347 may consist of one or more separate air bladder cells which are similar in construction to the individual air bladder cells 22 of air mattress 20. The additional air bladder cells which are used as an accumulator may be located remotely from the air mattress or optionally at either or both the head end and foot end of the mattress.

FIG. 11B illustrates valve configuration and resulting air flow paths directed by wave generator controller 244A during the second half of a negative pressure pulse, in which a volume of air is re-introduced into an air bladder cell 22 to thus partially or fully re-inflate the cell to a new or original quiescent value of pressure, respectively.

As may be understood by referring to FIG. 11B, a positive-going part of a pressure pulse applied to an air bladder cell 22 is created by directing air flow from outlet port 282 of pump 280 to inlet port 246 of pulse selector manifold 248, and thence through a selected valve 249 to a selected air bladder cell 22. Thus, as shown in FIG. 11B, valve plate 339 of pump outlet router valve 331 receives a signal from wave generator controller 244A to pivot to a position which allows air flow from pump outlet port 282 and through upper outlet port 334 of valve 331, and thence through inlet port 315 of pulse selector manifold router valve 311 and through the port 312 of the manifold router valve, and finally through a selector valve 249 to a selected air bladder cell 22.

As shown in FIG. 11B, during the positive-going part of an air pressure pulse to be delivered to an air bladder cell 22, valve plate 319 of pulse selector manifold router valve 311 is positioned by a command signal from wave generator 244A to block air flow through port 313 of valve 311. As is also shown in FIG. 11B, during the positive-going part of an air pressure pulse, valve plate 299 of pump inlet routing valve 291 is positioned by a command signal from wave generator 244A to block air flow through port 294 of valve 291. In this position, there is created an unobstructed air flow path for air which was pressurized in accumulator 347 during the negative-going part of an air pressure pulse, through pump inlet router valve 291 and thence into inlet port 281 of pump 280.

Referring to FIGS. 11A and 11B, it may be seen that wave generator 244 preferably includes a pressure transducer 348 which communicates with inlet port 246 of pulse selector manifold 248. With valve plate 319 of selector manifold router valve 311 in a clockwise, closed position as shown in FIG. 11A, and valve plate 249 of pump inlet router valve 299 in a clockwise, closed position as shown in FIG. 11B, opening a selector valve 249 connected to the port 243 of a selected air bladder call 222 results in equalization of pressure between the interior volume of the selected air bladder cell and the much smaller volume of a space located between the valve plate 249 and the input port 246 of the pulse selector manifold. Probe 349 of pressure transducer 348 communicates with this space and thus produces at an output terminal 350 of the transducer an electrical signal which is proportional to air pressure within a selected air bladder cell 222, which signal is conducted by an electrical wire 351 to wave generator controller 244A.

Listed below is a typical sequence of operations of wave generator 244 and configurations of router valves 291, 311 and 331 during the various steps of pulse generator 245 in response to electrical control signals issued by wave generator controller 244A to effect pre-programmed sequences of pressure pulse generation which result in traveling support force waves on the surface of air mattress 20. Table 2 following the operational sequence summary lists the configurations of router valves 291, 311 and 331 during the various steps of a pulse generation sequence.

Wave Generator Operation Sequence

1. Initialize System.
2. Receive command to begin wave.
3. Open selector valve 249 to select a first air bladder cell 22.
4. Measure pressure in selected cell via pressure transducer 348 connected to inlet port 246 of selector manifold 248.
5. Input pressure measurement value to wave generator controller 244A.
6. Open pump inlet router valve 291.
7. Turn vacuum/pressure pump 280 on to withdraw air from selected cell.
8. Leave pump 280 on until negative pressure-peak measured by transducer 348 and input to controller 244A is achieved.
9. Close pump inlet router valve 291.
10. Shut pump 280 off.
11. Allow time period equal to desired negative peak pressure dwell time period to elapse.
12. Open pump outlet router valve 331.

13A. Turn pump on to input air into selected cell 22.

13B. Open selector manifold router valve 311 to input air into selected cell 22.

14. Leave pump on until pressure measured by transducer 348 increases to original or new desired bias level.

15A. Close selector manifold router valve 311.

15B. Close pump outlet router valve 331.

16. Shut pump off.

Repeat steps 3-16 for additional selected air bladder cells in a sequence required for a desired wave cycle.

17. Repeat steps 1-16 for each additional wave cycle commanded by wave generator controller 244A.

TABLE 2

| SEQUENCE STEPS | VALVE 1, PUMP INLET (291) | VALVE 2, SELECTOR MANIFOLD (311) | VALVE 3, PUMP OUTLET (331) |
|---|---|---|---|
| 1-5 | Clockwise (CW), Closed | CW, Closed | CW, Closed |
| 6-8 | Counterclockwise (CCW) Open | CW, Closed | CW, Closed |
| 9-11 | CW, Closed | CW, Closed | CW, Closed |
| 12-14 | CCW, Closed | CCW, Open | CCW, Open |
| 15-16 | CW, Closed | CW, Closed | CW, Closed |

FIGS. 12-24 illustrate the construction of a third embodiment of a traveling wave air mattress apparatus 400 according to the present invention. As will be explained in detail, traveling wave air mattress 400 has a modular construction which facilitates manufacture and use of a range of traveling wave air mattress apparatuses having different degrees of complexity, cost, and features suitable for use both in preventing the formation of bedsores, and for relaxation purposes.

Figure 12:
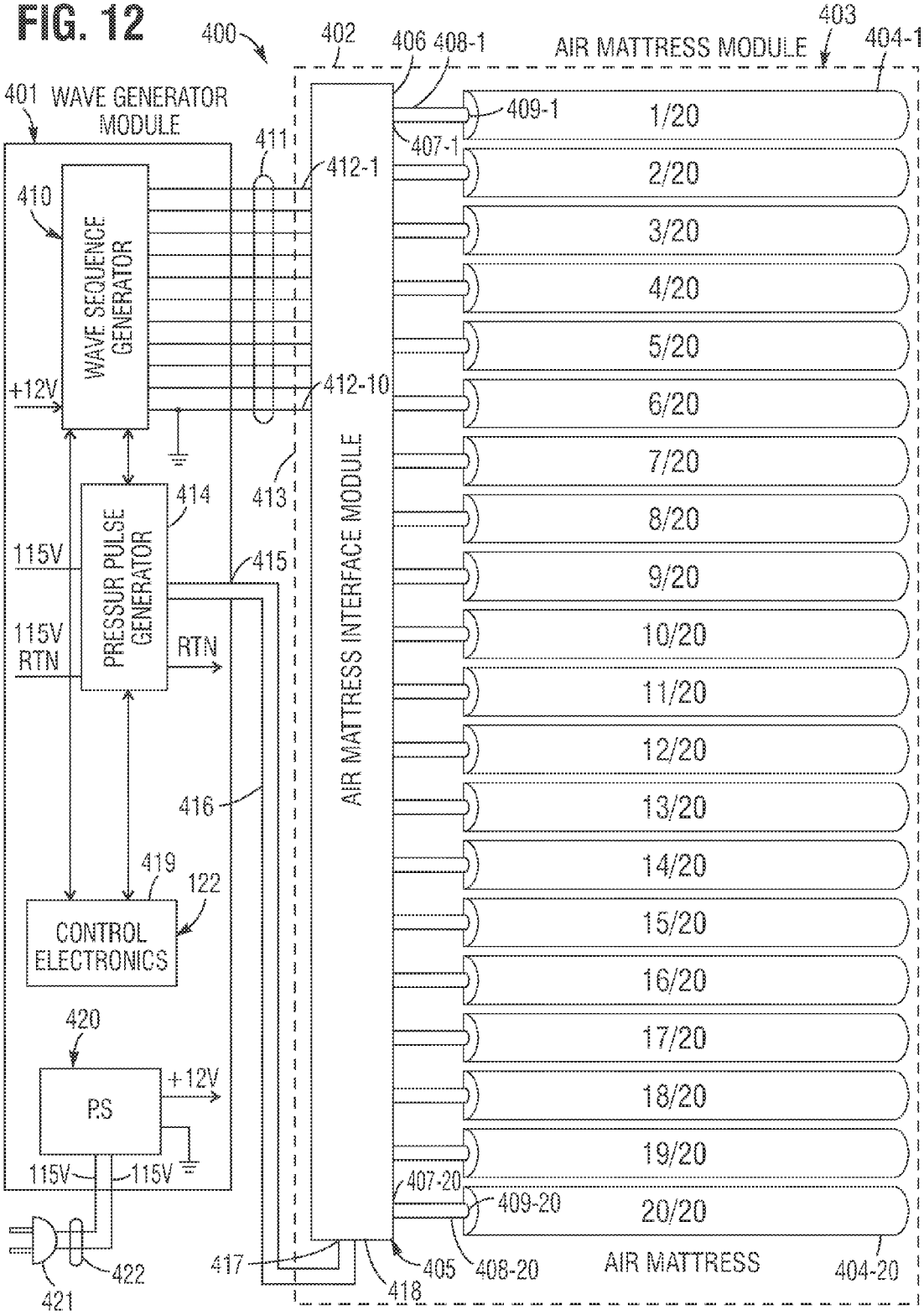
FIG. 12 is a partly diagrammatic view of a third, modular embodiment of a traveling wave air mattress according to the present invention.

Referring to FIG. 12, modular traveling wave air mattress apparatus 400 may be seen to include a wave generator module 401 and an air mattress module 402. The air mattress module 402 includes an air mattress 403 comprised of an array of generally semi-cylindrically shaped, individually inflatable air bladder cells 404, which are made of air impervious material such as thin vinyl plastic sheeting. An example embodiment of mattress 403, which was found suitable for both health care and relaxational applications, consists of 20 laterally disposed tubes that were arranged in a side-by-side array, each of the tubes having a diameter of about 4 inches and a length of about 34 inches. Thus the mattress 403 had a length of about 80 inches and a width of about 34 inches, which is of a suitable size for placement on supporting surfaces such as a standard size bed mattress or a portable air mattress.

As shown in FIG. 12, air mattress module 402 includes an air mattress interface module 405. Air mattress interface module 405 has on an outlet side 406 thereof a row of twenty individual outlet ports 407-1 through 407-20 for pressurized air, which are connected through flexible tubes 408-1 through 408-20 to inlet ports 409-1 through 409-20 of air bladder cells 404-1 through 404-20.

As is also shown in FIG. 12, wave generator module 401 includes a wave sequence generator 410 which is connected through an elongated flexible 15-conductor cable 411 to 15 individual electrical port terminals 412 of an electrical interface port side 413 of air mattress interface module 405.

Referring still to FIG. 12, it may be seen that wave generator module 401 includes an air pressure pulse generator 414 which has an outlet port 415. Air pressure outlet port 415 is connected through a single flexible air tube 416 to an inlet port 417 located on a side 418 of air mattress interface module 403.

As shown in FIG. 12, wave generator module 401 includes a control electronics module 419 which is connected to wave sequence generator module 410 and air pressure pulse generator 414. Wave generator module 401 also includes a power supply 420 for converting 115-volt A.C. power input to the wave generator module 401 on a power cord 422 terminating in a power plug 421 plugged into a mains power source, to 12-volt D.C. power for operating control electronics module 419, pressure pulse generator 414 and wave sequence generator 410.

In a preferred embodiment of apparatus 400, wave generator module 410 may be located some distance from a bed, portable mattress, or other support on which air mattress 403 is placed, and connected to air mattress module 402 by single flexible cable 411 which contains insulated conductors operating at an electrical potential of no more than 12 volts D.C., and by a parallel flexible air tube 416. Desirably, air mattress interface module 405 may be positioned near the foot-end of air mattress 403, and connected to air bladder cells 404-1 through 404-20 of the air mattress by relatively short, flexible electrically insulating air tubes 408-1 through 408-20.

Figure 13:
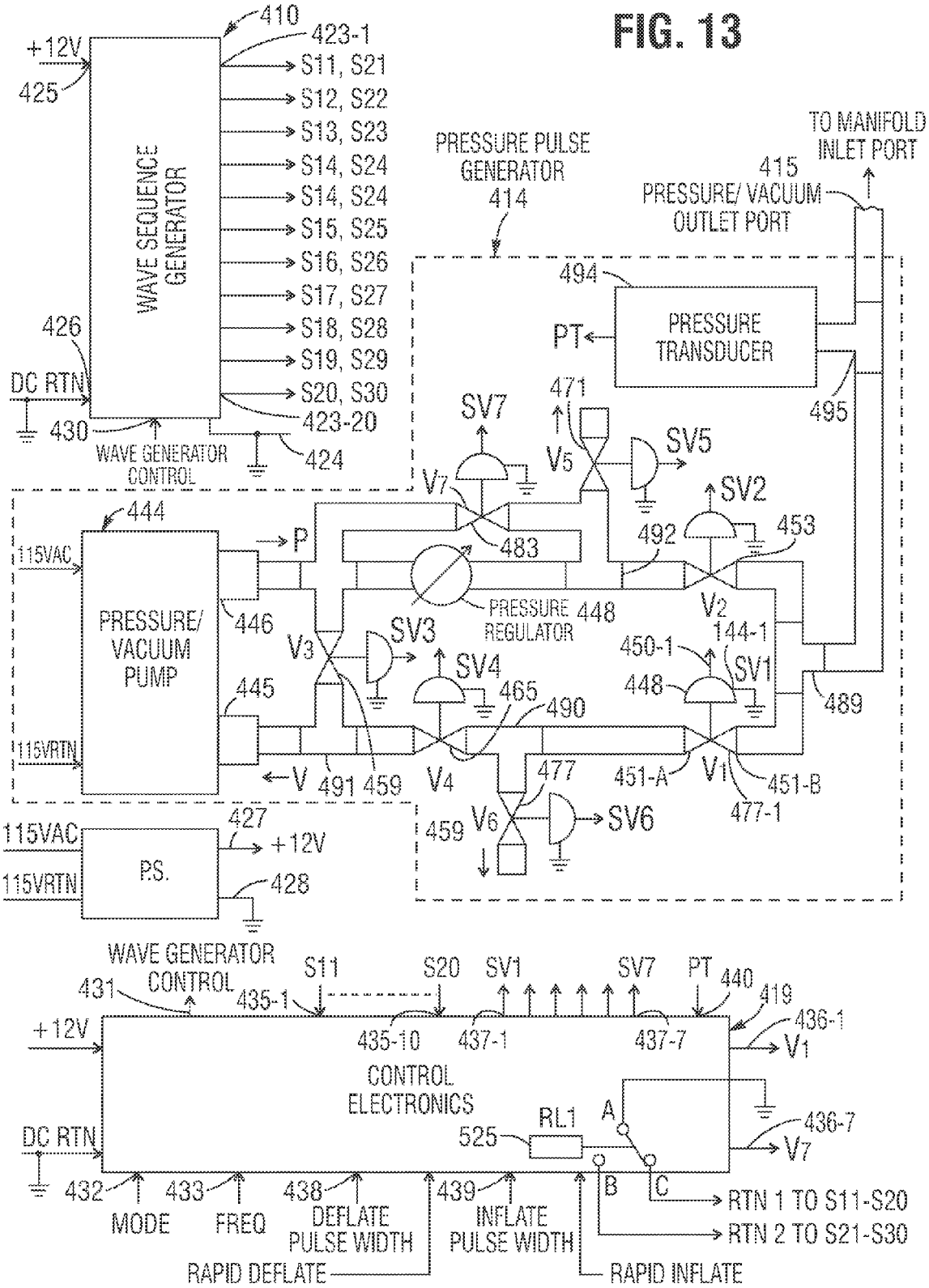
FIG. 13 is a partly diagrammatic view of a wave generator module of the apparatus of FIG. 12.

FIG. 13 illustrates in more detail the construction of wave generator module 401 of traveling wave apparatus 400.

As shown in FIG. 13, wave sequence generator 410 of wave generator module 401 has 10 electrical output terminals 423-1 through 423-10 and a common ground terminal 424. Wave sequence generator 410 contains electronic circuitry which is powered by 12-volt D.C. power supplied to +12-volt and ground terminals 425, 426, respectively, of the wave generator module from +12-volt and ground output terminals 427, 428 of D.C. power supply 420. Wave sequence generator 410 emits sequentially on output terminals 423-1 through 423-10 thereof 12-volt square pulses 429-1 through 429-10, as shown in FIGS. 18 and 19. As shown in FIG. 13, wave sequence generator 410 has an input control port 430 which is connected to an output control port 431 of control electronics module 419. Control electronics module 419 has Mode and Frequency control input ports 432, 433 which may be connected to manually operable switches, or to a data port such as an RS 232 port or a USB port.

In response to Mode and Frequency select control signals input to control electronics module 419 on input terminals 432 and 433 thereof, the frequency and sequencing pattern of square pulses 429 emitted on terminals 423-1 through 423-10 of the wave sequence generator 410 can be varied by a user of apparatus 400. Thus, for example, a first, basic operating mode of apparatus 400 may consist of a first "downward" sequence of square pulses 429-1 through 429-10 emitted sequentially on terminals 423-1 through 423-10 of wave sequence generator 410, as shown in line 1 of FIG. 18.

As indicated by the numbers in parentheses in line 1 of FIG. 18, a second operating mode of wave sequence generator 410 may be selected which causes a second, "upward" sequence of pulses 429 to be emitted sequentially in terminals 423-10 through 423-1 of wave sequence generator 410. As will be described in detail below, wave sequence generator 410 desirably is controllable to output other sequential patterns of pulses 429.

According to the invention, wave sequence generator 410 is also controllable in response to signals input to frequency control port 433 of control electronics module 419 and conveyed to wave generator control port 430 to vary the frequency of square pulses 429 emitted by the wave sequence generator. As will be explained in detail, a typical range of periods of pulses 429-1 through 429-10 on ten output terminals 423-1 through 423-10 of wave sequence generator 410 of apparatus 400 would be from about one to two seconds to about 5 to 10 minutes. Thus, the total time period for emitting a sequence of 10 equal length pulses 429-1 through 429-10 on terminals 423-1 through 423-10 of wave sequence generator 410 may vary over a typical range of about 10 to 20 seconds to 50 to 100 minutes.

From the foregoing description of functions of wave sequence generator 410 and control electronics module 419, those skilled in the art will recognize that those functions may be readily implemented by a suitably programmed microprocessor, micro controller, programmable logic controller (PLC) or similar programmable electronic controller device. In an example embodiment of the present invention which was tested, wave sequence generator 410 included a PIC model 16C58B Programmable Interrupt Controller, the ten output ports of which were connected to input terminals of ten transistor driver switches. As will be described in detail below, square pulses 429 on output terminals 423-1 through 423-10 of wave sequence generator 410 are used to actuate individual solenoid valves to an ON configuration for time periods based on the duration of the square pulses. Thus those skilled in the art will recognize that the current and voltage drive characteristics of wave sequence generator 410 are dependent on the number and electrical characteristics of the solenoid valves used in apparatus 400. The example embodiment of the invention tested used 12-volt solenoid valves having a coil resistance of about 120 ohms.

As shown in FIG. 13, output terminals 423-1 through 423-10 of wave sequence generator 410 are also connected to input ports 435-1 through 435-10 of control electronics module 419. Control electronics module 419 includes electronic circuitry for processing signal pulses 429 emitted from wave sequence generator 410 and input to input terminals 435-1 through 435-10 of the control electronics module and for emitting control signals V1-V7 on output terminals 436-1 through 436-7, and solenoid valve drive signals SV1-SV7 on output terminals 437-1 through 437-7. As shown in FIG. 13, control electronics module 419 has a Deflation Pulse Width-adjust input port 438, and an Inflation Pulse Width-adjust input port 439. As is also shown in FIG. 13, control electronics module 419 may optionally have a pressure transducer signal input port 440, a rapid-deflate command input port 441, and a rapid-inflate command input port 442.

As may be understood by referring to FIGS. 13 and 18, control electronics module 419 produces on output ports thereof electrical control signals, in response to command and status signals input to various input ports of the module. As will be clear from the ensuing discussion of other functions of control electronics module 419, the circuitry of that module may be implemented as a micro controller, microprocessor, or PLC. An embodiment of control electronics module 419 which was constructed to test various embodiments of a traveling wave air mattress apparatus 400 according to the present invention employed a combination of separate integrated circuit modules, relays, and semiconductor logic and driver components.

Referring to FIG. 13, it may be seen that air pulse generator module 414 of traveling wave air mattress apparatus 400 according to the present invention includes a pressure/vacuum pump 444, which has a vacuum inlet port 445, and a pressure outlet port 446. Vacuum inlet port 445 and pressure outlet port 446 are connected through an arrangement of valves V1-V7 and coupling tubes to pressure/vacuum outlet port 415 of air pressure generator module 414 of wave generator module 401, to manifold inlet port 417 of air mattress interface module 405, as shown in FIG. 12.

As shown in FIG. 13, valves V1-V7 of air pressure pulse generator 414 of wave generator module 401 may be identical, normally OFF (NO), two-way solenoid actuated air valves. Thus, for example, valve V1, reference description number 443 in FIG. 13, has a solenoid activator SV1 (448) which has a ground return terminal 449 and a 12-volt actuation terminal 450, which is connected to SV1 drive terminal 437-1 of control electronics module 419. A 12-volt signal level on solenoid valve drive terminal SV1 (437-1) of control electronics module 419 actuates valve SV1 to an ON position, in which air passes freely between first and second opposed ports 451A, 451B of the valve. Conversely, when the 12-volt actuating signal is removed from solenoid terminal SV1, valve V1 returns to a closed, OFF position, in which air flow between the ports of the valve is blocked. Table 3 lists the valves V1-V7 shown in FIG. 13, and identifies the function of each valve.

TABLE 3

| VALVE | ELEMENT NUMBER | FUNCTION |
|---|---|---|
| V1 | 447 | Manifold vacuum |
| V2 | 453 | Manifold pressure |
| V3 | 459 | Pump recirculate |
| V4 | 465 | Pump vacuum inlet |
| V5 | 471 | Pump exhaust to atmosphere |
| V6 | 477 | Vacuum inlet from/exhaust to atmosphere |
| V7 | 483 | Pressure regulator bypass |

As shown in FIG. 13, valves V1-V7 (reference designation numbers 447, 453, 459, 465, 471, 477, 483) are interconnected through an arrangement of Tee-couplers and tubes between pressure/vacuum pump 444 and pressure/vacuum outlet port 415 of air pressure pulse generator 414. The Tee-couplers include five couplers 489, 490, 491, 492, 493. When an optional pressure transducer 494 is included in apparatus 400, it is connected to pressure/vacuum outlet port 415 of wave generator module 401 through a sixth Tee-coupler 495.

Air pressure pulse generator 414 of wave generator module 401 is used to introduce pulses of air into individually selectable air bladder cells 404 of air mattress 403 (see FIG. 12) in a manner which is described in detail below. The construction and functions of apparatus 400 which enable transmission of air pressure pulses to selected air bladder cells 404 may be best understood by referring to FIG. 14 in addition to FIGS. 12, 13, and 18.

Figure 14:
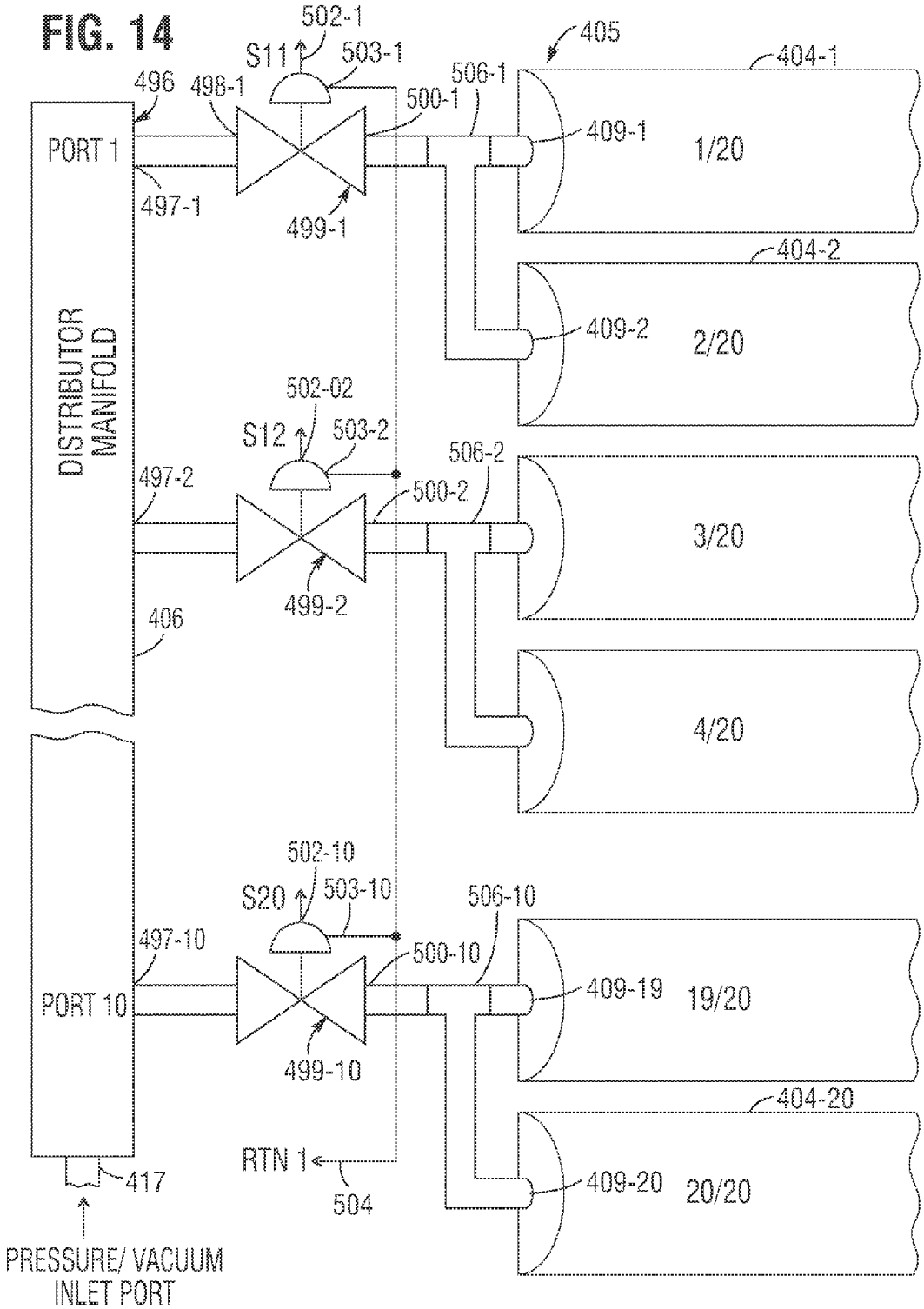
FIG. 14 is a partly diagrammatic view of a first type mattress interface module and inflatable air mattress which together with the wave generator module of FIG. 13 comprise a third embodiment of a traveling wave air mattress according to the present invention.

As shown in FIG. 14, air mattress interface module 405 includes a distributor manifold 496 what has an inlet port 417 for pressurized air which is connected through a single flexible air tube to air pressure pulse generator 414 of wave generator module 401, as shown in FIG. 12 and previously described. Distributor manifold 496 has a series, e.g., ten, of air outlet ports 497-1 through 497-10. Each air outlet port 497 is connected through a flexible air tube to a first port 498 of a solenoid air bladder cell valve 499. Each solenoid air bladder cell valve 499 is a normally OFF valve that permits passage of air between first port 498 and a second port 500 thereof, only when solenoid actuator 501 of the valve is actuated by a 12-volt signal impressed on input terminal 502, and return terminal 503 of the solenoid is connected to a ground return through ground return conductor RTN1 (504).

As may be understood by referring to FIGS. 12 and 13 in addition to FIG. 14, each solenoid drive terminal 502-1 through 502-10 of the solenoid valves 499-1 through 499-10 is connected through a separate insulated conductor 505-1 through 505-10 of interface cable 411 to a separate output terminal 423-1 through 423-10 of wave sequence generator module 410. Also, common ground conductor line 504 of air mattress interface module 405 is connected through a separate conductor of cable 411 to ground return output terminal 424 of wave sequence generator 410.

From the foregoing description, it will be understood that when a 12-volt D.C. actuating signal is emitted from an output terminal, e.g., 423-1 of wave sequence generator 410, a corresponding air bladder cell valve, e.g., 499-1 of air mattress interface module 405, will be actuated to an ON configuration. In this ON configuration, there is pneumatic communication between second port 500 of the valve 499 and pressure/vacuum outlet port 415 of air pressure pulse generator 414 of wave generator module 401. Thus, as shown in FIG. 14, air pressure pulses in pressure/vacuum outlet port 415 of air pressure pulse generator 414 are conducted to outlet port 501-1 of valve 499-1, which may be connected to inlet port 409 of an individual air bladder cell 404.

Optionally, as shown in FIG. 14, the second port of an air bladder cell inflation valve 499 may be coupled to a pair of air bladder cells through a Tee-coupler 506. Thus, as shown in FIG. 14, a first Tee-coupler 506-1 enables air pulses to be conveyed simultaneously to a pair of adjacent air bladder cells 404-1, 404-2. With this arrangement, a 10-outlet port distributor manifold 490 and ten air bladder cell inflation valves 499 may be used to convey air pressure pulses to all 20 of the air bladder cells of a 20-cell air mattress.

Figure 20:
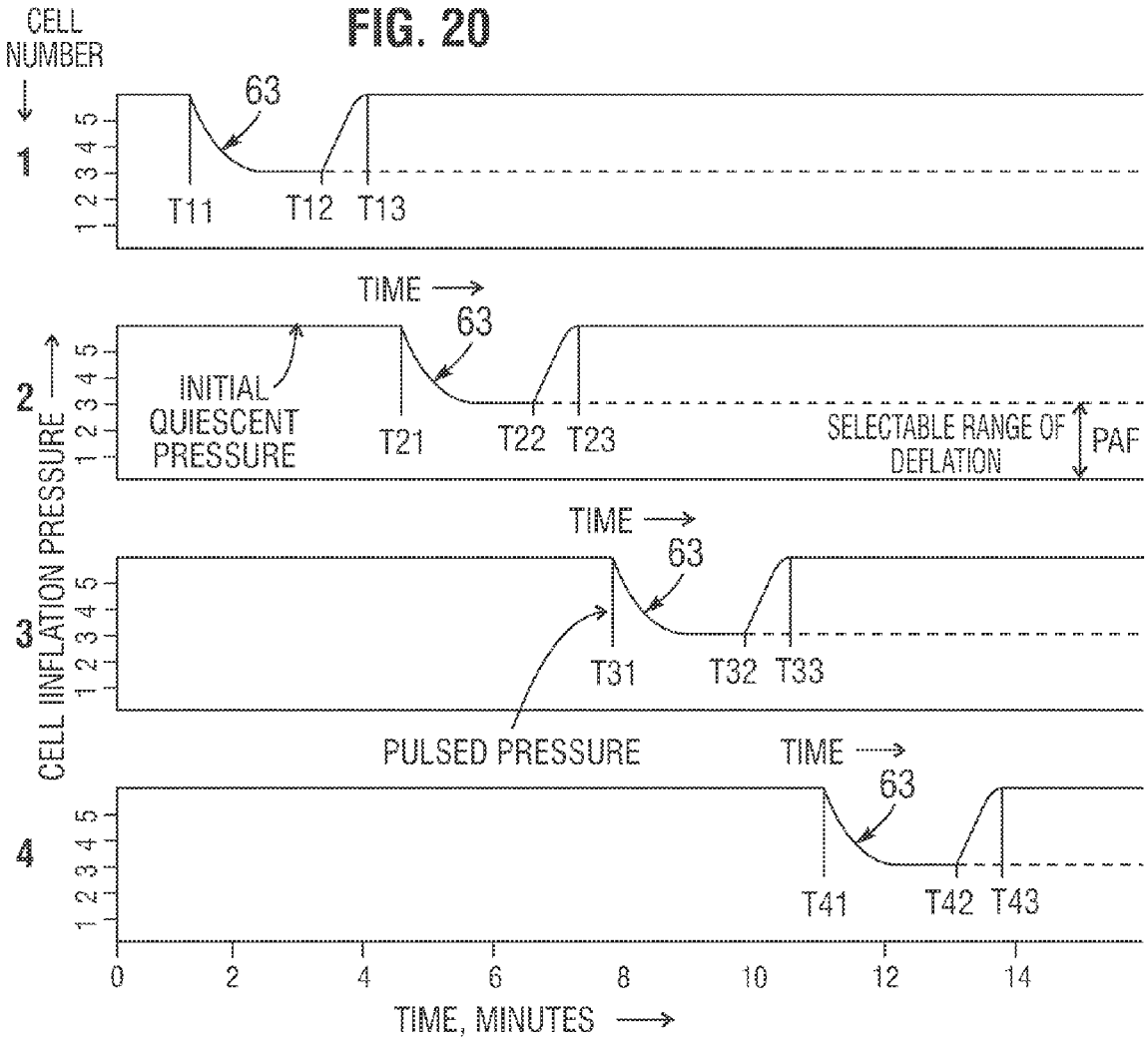
FIG. 20 is a timing diagram showing relative timing and amplitudes of a sequence of air pulses input sequentially into individual air bladder cells of the air mattress of FIG. 17, to thus produce a traveling body support force wave on the upper surface of the air mattress.

As may be understood by referring to FIGS. 12, 13, and 14, in response to electrical control signals input to air pressure pulse generator 414 from wave sequence generator 410 and control electronics module 419, the air pressure pulse generator produces in pressure/vacuum outlet port 415 air pulses which are conveyed through air mattress interface module 405 to selected air bladder cells 404-1 through 404-20. As shown in FIG. 20, each air pulse 510 consists of a negative differential pressure component beginning at time T1 and ending at time T2 of the pulse. The negative differential pressure component T1-T2 here refers to a reduction of pressure at the inlet port 409 of an air bladder cell 404 that causes the air bladder cell to partially or fully deflate.

In a first, active deflation mode of operation of pressure pulse generator 414, pressure reduction component T1-T2 of air pulse 510 is produced by actuating valves of apparatus 400 in a manner which connects the inlet port 409 of an air bladder cell 404 through valves and tubes to the vacuum or suction inlet port 445 of pressure/vacuum pump 444. In a second, passive deflation mode of operation of air pressure pulse generator 414, the deflation component T1-T2 of air pulse 510 is produced by actuating valves of the apparatus 400 in a manner which creates a path for air under pressure in an air bladder to be exhausted to the atmosphere.

As shown in FIG. 20, air pressure pulse 510 includes a second, inflation component during the time interval T2-T3. The inflation component T2-T3 is produced by actuating valves of apparatus 400 in a manner which creates a pathway for pressurized air discharged from pressure outlet port 446 of pressure/vacuum pump 444 to the inlet port 409 of an air bladder cell 404.

Details of the operation of air pressure pulse generator 414 which are effective in producing a sequence of air-pressure pulses 510 of the type shown in FIG. 20, and conveying the pulses to an air mattress 403, of the type shown in FIG. 14 may be best understood by referring to FIGS. 13 and 18.

As may be understood by referring to FIGS. 12 and 18, control electronics 419 contains circuitry which produces a sequence of control signals SV1-SV6 for valves V1-V6 upon receiving a square timing pulse 429 from any one of the ten output ports 423-1 through 423-10 of wave sequence generator 410, which ports are connected to input ports 435-1 through 435-10 of control electronics module 419. For example, as shown in FIG. 18, control electronics module 419 produces in response to the leading, positive-going edge of a first pulse 492-1 on output in terminal 423-1 of wave sequence generator 410 the leading edge of a positive-going, Deflate pulse P1. As shown in FIG. 18, the duration (t12-t11) of deflation pulse P1 is adjustable as indicated by the variable time location of the trailing edge of the pulse at t12. The duration of deflation pulse P1 may be adjusted by a signal on input control terminal 432 of control electronics module, for example, by varying the time constant of a monostable oscillator, or ONE SHOT, triggered by the leading edge pulse 429-1 at time t11.

As shown in FIGS. 13 and 17, pulse V1 is output on solenoid valve drive terminal SV1 (437-1) to thus turn valve V1 ON. As shown in FIG. 18, valve V4 is also ON at the same time as valve V1, thus providing an air path between vacuum inlet port 445 of pump 444, pressure/vacuum outlet port 415 of air pressure pulse generator 414, pressure/vacuum inlet port 417 of the distributor manifold, air bladder cell valve 493-1, and air bladder cell 404-1. At the same time valve signal SV5 is also positive, thus enabling pressurized air discharged from pressure outlet port 446 of pressure/vacuum port to pass through pressure regulator 512 and exhausted into the atmosphere.

Referring still to FIGS. 13, 18, and 20, the negative-going, trailing edge of Deflate pulse V1 triggers the leading edge of an Inflate pulse P2. As shown in FIG. 18, the time location of the trailing edge of inflate pulse P2 is also adjustable to thus adjust the duration of deflate pulse P2. As will be readily understood by those skilled in the art, P2 may be generated by a second one-shot triggered by the trailing edge of deflate pulse P1.

Referring to FIG. 13, it may be seen that when manifold vacuum valve V1 is turned OFF at the end of Deflate pulse P1, manifold pressure valve V2 is turned ON, thus providing an air path from pressure outlet port 446 of pressure/vacuum pump 444 to an air bladder cell, such as a selected air bladder cell 404-1. As may also be understood by referring to FIGS. 13 and 18, during Inflate pulse P2, pump vacuum inlet valve V4 and vacuum atmosphere vent valve V6 are ON, providing inlet air to vacuum inlet port 445 of pressure/vacuum pump 444.

Optionally, an accumulator of the type shown as element 347 in FIG. 11B may be used in a hermetically sealed modification of air pulse generator 414 shown in FIG. 13. In this modification, the exhaust port outlet of pump exhaust vent valve V5 (471) would be connected through a check valve to a first port of an accumulator, and the inlet/exhaust port of vacuum inlet valve V6 (477) would be connected to a second port of the accumulator.

Referring to FIG. 17, it may be seen that after the last square wave pulse in a sequence of square wave pulses 429 has been emitted from wave sequence generator 410, e.g., after a sequence of 10 or 20 pulses, apparatus 400 may selectably continue to cyclically output sequences of control pulse signals, or enter into a rest mode. As indicated by the solid lines at the right-hand side of FIG. 18, during a rest period of apparatus 400, pump recirculate valve V3 (459) may be turned on. Alternatively, as shown in dashed lines, a resting mode may be selected in which valves, V4 (465), V5 (471) and V6 (477) are turned to provide venting to the atmosphere of both vacuum inlet port 445 and pressure outlet port 446 of pressure/vacuum pump 444. Using either of the foregoing rest modes eliminates the necessity for switching pressure/ vacuum pump 444 on and off during operation of apparatus 400. FIG. 18 illustrates a second, passive deflation mode of operation of apparatus 400.

In the passive deflation mode, V4 is closed and valves V1 and V6 are opened during the deflation component of an air pressure pulse, allowing pressurized air from an air bladder cell 404 to escape to the atmosphere through an open port of valve V6, rather than being connected to vacuum inlet port 445 of pressure/vacuum pump 444. As will be explained below, the slower deflation rate of an air bladder cell in a passive deflation mode facilitates a novel and advantageous mode of operation of apparatus 400.

Table 4 summarizes the configuration of valves V1-V6 for the above-described operational modes of wave generator module 401.

TABLE 4

| VALVE | ACTIVE DEFLATE STATE | PASSIVE DEFLATE STATE | INFLATE STATE | REST (RECIRCULATING PUMP) STATE | REST (VENTING PUMP) STATE |
|---|---|---|---|---|---|
| V1 | ON | ON | OFF | OFF | OFF |
| V2 | OFF | OFF | ON | OFF | OFF |
| V3 | OFF | ON | OFF | ON | OFF |
| V4 | ON | OFF | ON | OFF | ON |
| V5 | ON | ON | OFF | OFF | ON |
| V6 | OFF | ON | ON | ON | ON |

Figure 21A:
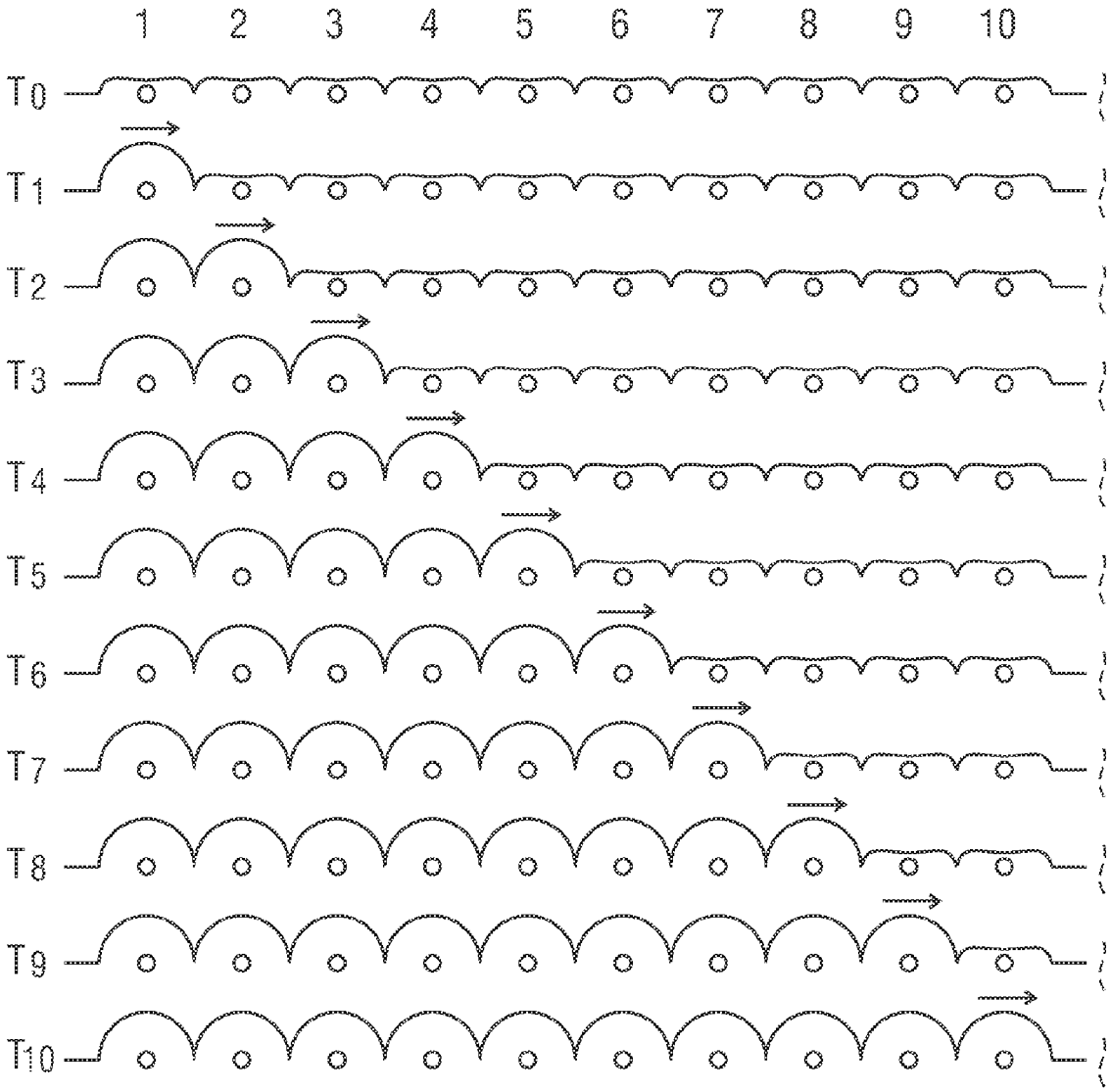
FIG. 21A is a fragmentary, partly diagrammatic side elevation view of the air mattress of FIG. 17, showing the mattress being inflated from an initial deflated state to a fully inflated state by a first sequence of deflating and inflating pulses of the type shown in FIG. 20.
Figure 21B:
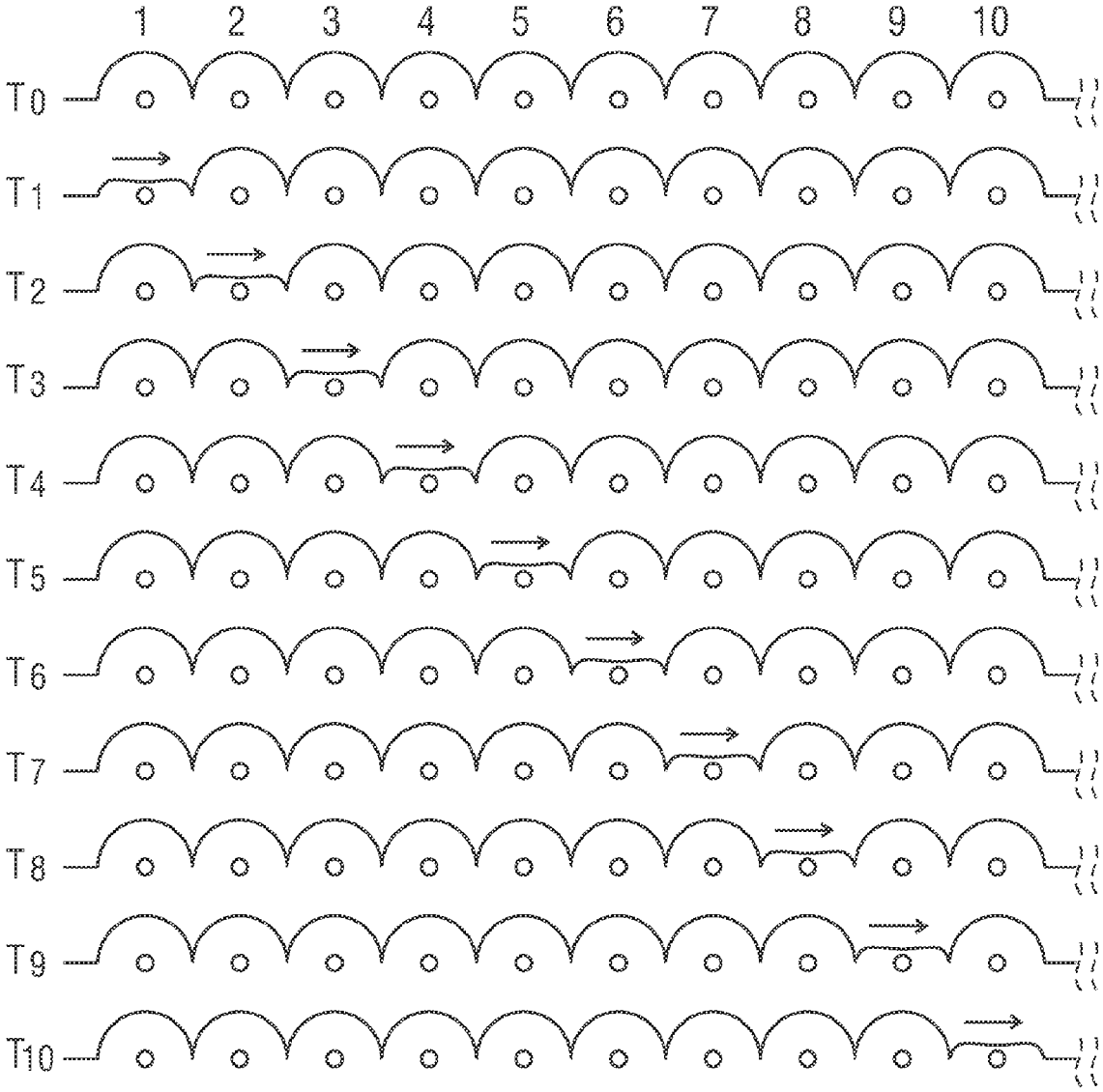
FIG. 21B is a diagrammatic view similar to that of FIG. 21A, showing the progression of a traveling support force-reduction wave traveling in a head-to-foot direction produced on the upper surface of the air bladder cells of the mattress resulting from a sequence of deflating and re-inflating pressure pulses of the type shown in FIG. 20 being input to a line of laterally disposed air bladder cells of the air mattress beginning at the left, head-end of the mattress and ending at the right, foot-end of the air mattress.

FIGS. 20, 21A, and 21B illustrate how apparatus 400 produces traveling waves of body support forces on the surface of air mattress 403.

As shown in line 1 of FIG. 21A, before apparatus 400 is powered on, an air mattress 403 having, for example, 20 air bladder cells (only the first 10 are shown) may be in a deflated state. At time T1, a first pulse of air 510 (see FIG. 20) is input to first air bladder cell 404-1 of the air mattress 403.

As shown in FIG. 20 and has been described above, air pulse 510 has a first, deflation component beginning at time T1 and ending at time T2. Since all of the air bladder cells 404 of air mattress 404 were presumed to be deflated, there will be no change in the contour of air bladder cell 404 during the period T1-T2. However, if an air bladder cells were partially deflated, it will be fully deflated by the deflation component of air pulse 510 during the period T1 to T2.

At time T2, the inflation component of air pulse 510 begins to inflate first air bladder cell 404-1. The inflation component of air pulse 510 continues until time T3. The duration of inflation pulse component T3-T2 of air pulse 510, and the maximum inflation pressure, which is adjusted by adjusting pressure regulator 511, are selected to inflate air bladder cell 404-1 to a pre-determined steady-state pressure PS, which causes the upper body support surface 512 of the air bladder cell to assume the generally semi-cylindrically shaped contour shown in line 2 of FIG. 21A Referring to lines 3 through 10 of FIG. 21A, it may be seen that successive air bladder cells 404-2 through 404-20 are sequentially selected and inflated by wave generator module 401, resulting in a fully inflated air mattress 403 as shown in the last line of FIG. 21A.

FIG. 21B illustrates how apparatus 400 produces a traveling wave of body support force on the upper surface 512 of air mattress 403.

As shown in FIG. 21B, after a first cycle of 10 or 20 pulses emitted by wave sequence generator 410 to initialize an air mattress 403 to a fully inflated state as shown in the last line of FIG. 21B, a second and successive cycles of wave sequence pulses are effective in producing a traveling body support force production wave on the upper surface 512 of air mattress 403. Thus, as shown in line 2 of FIG. 21B, during the deflation period T1-T2 of a first, head-end air bladder cell 404-1, that air bladder cell is deflated to thus reduce the support force exerted by the air bladder cell on a body part. The duration of this deflation component T1-T2 of the air pulse 510 may be adjusted to any suitable value, such as 5 minutes.

At time T2 of a first deflation pulse, air bladder cell 404-1 is re-inflated to a pre-determined quiescent pressure, during the time interval T2 to T3. The duration of inflation component T2 to T3 of air pulse 510 is typically determined by how long it takes to inflate an individual air bladder cell 404 to a desired pressure, which for a relatively small pressure/vacuum pump having an outlet pressure of 36 PSI and an air flow rate of 5.5 lpm would be about 30 seconds to one minute.

As shown in lines 3-11 of FIG. 21B, sequentially deflating and re-inflating the remaining air bladder cells 404-2 through 404-10 or 404-20 of a 10 or 20 bladder mattress causes a traveling wave of body support force reduction to progress from one end to the other end of air mattress 403. For example, if the first air bladder cell 404-1 located at the head-end of a bed, a traveling wave of body support force reduction 513 will be propagated from left to right a shown in FIG. 21B, i.e., from the head-end to the foot-end of air mattress 403.

As may be understood by referring to FIG. 21B, deflation of each air bladder cell 404 is initiated at the times T1, - - - T10 coinciding with the beginning of a wave sequence generator pulses 429-1 through 429-10, as shown in FIG. 18. At the end of each wave sequence generator pulse, the selected air bladder cell is left in a fully inflated state. Thus, at the time T1, coincident with a first wave sequence generator pulse 429-1, air bladder cell 404-1 becomes deflated, and at the end of pulse 429-1, is fully re-inflated.

In a basic embodiment of the apparatus 400 according to the present invention shown in FIGS. 12, 13, and 14, a wave sequence generator 410 having ten output ports, and a distributor manifold having ten outlet air ports in a simplified, low-cost configuration, are used to control a 20-air bladder cell air mattress. This configuration also utilizes only ten air bladder cell valves 499 to minimize cost and complexity.

Figure 21C:
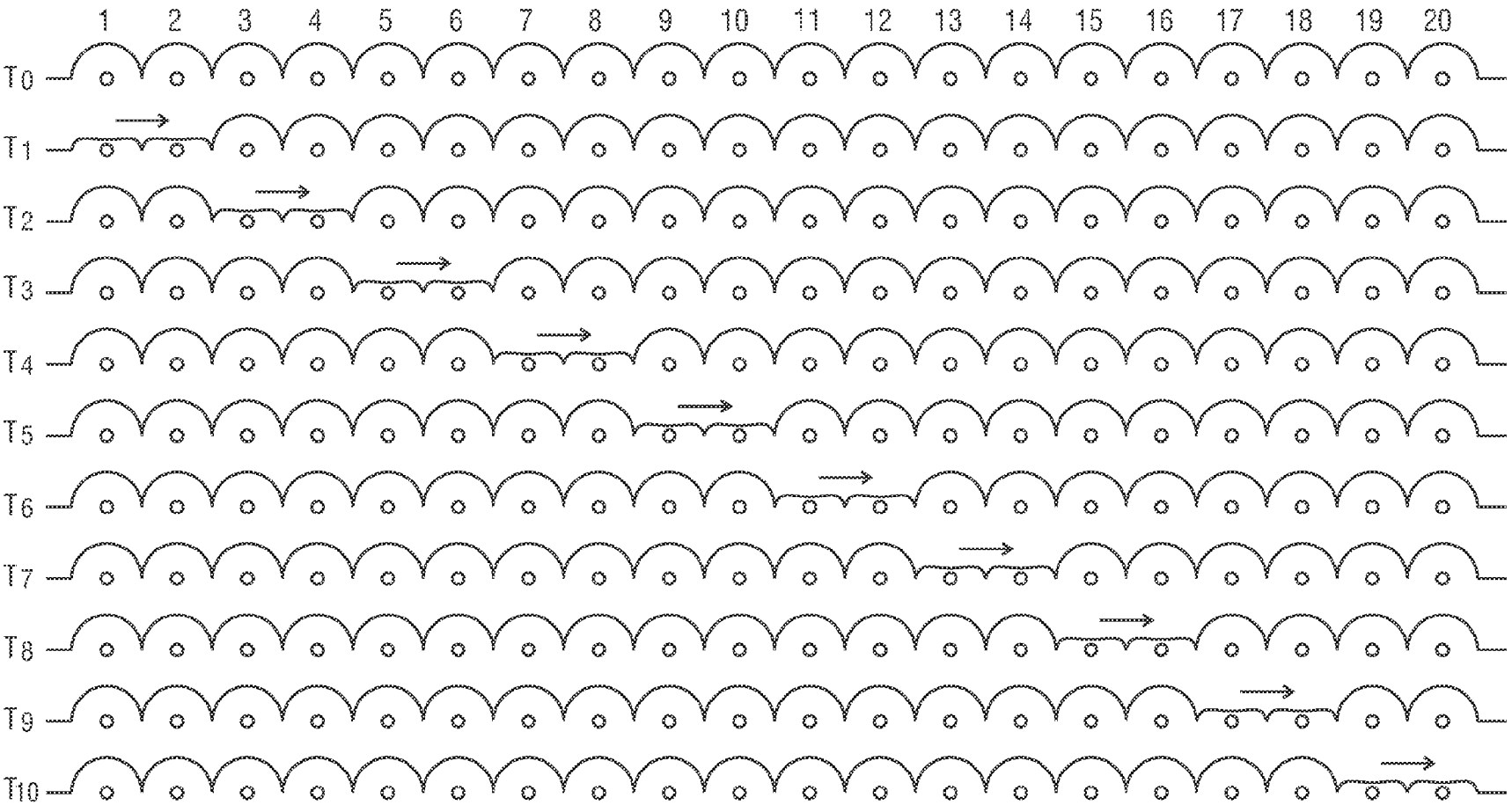
FIG. 21C is a partly diagrammatic view showing a body support force-reduction wave produced on the surface of the air mattress of FIG. 17 by introducing a sequence of air pressure pulses of the type shown in FIG. 20 to a line of pairs of adjacent air bladder cells of the air mattress, beginning at the left, head-end of the air mattress and ending at the right, foot-end of the air mattress.

As shown in FIG. 14, the ten-port wave sequence generator 410, ten port distributor manifold 490, and ten air bladder cell valves 499 are enabled to control an air mattress 403 which has 20 air bladder cells 404-1 through 404-20, by driving a pair of air bladder cells 404 from each distributor outlet port using a single air bladder cell valve 499 connected to each port. FIG. 21C illustrates generation of a traveling body support force wave in which adjacent pairs of air bladder cells 404 are sequentially deflated and re-inflated to produce a head-to-foot traveling body force support wave on an air mattress 403 having 20 air bladder cells 404.

Figure 15:
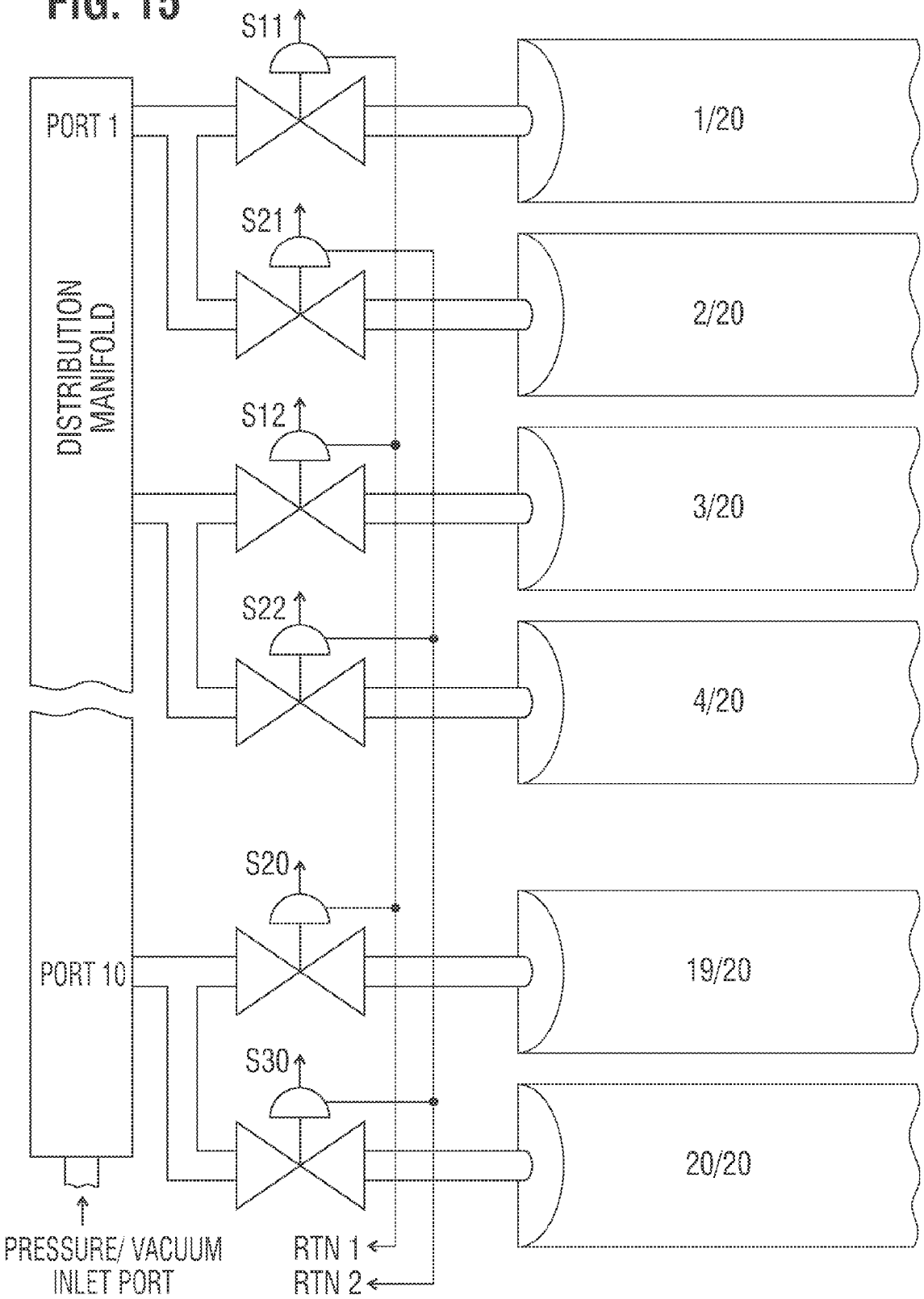
FIG. 15 is a partly diagrammatic view of a second type mattress interface module and inflatable air mattress which together with the wave generator module of FIG. 13 comprise a first variation of a third embodiment of a traveling wave air mattress according to the present invention.
Figure 21D:
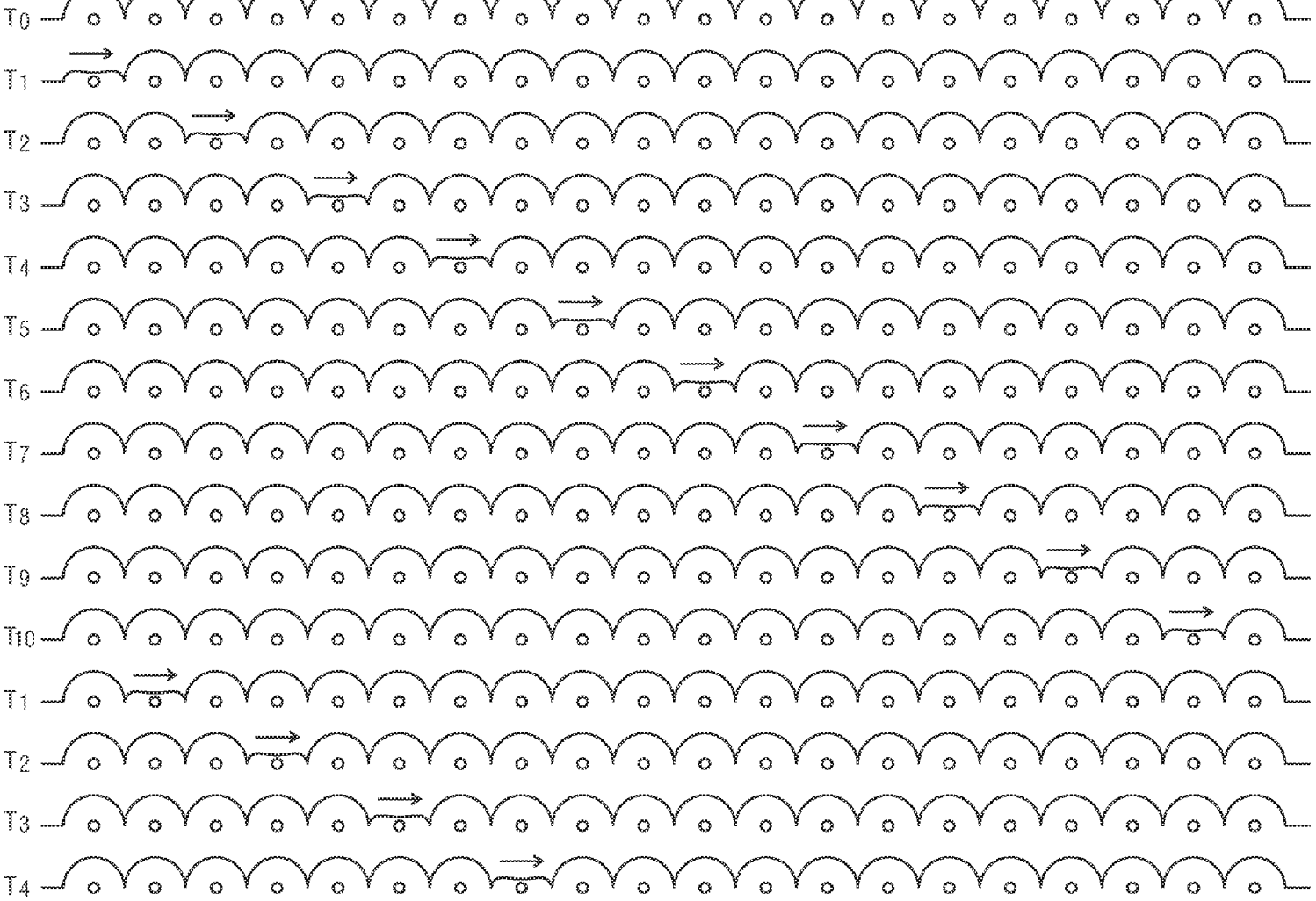
FIG. 21D is a view showing a downward, head-to-foot body support force-production wave produced on the surface of the air mattress of FIG. 17 in which odd number air bladder cells 1, 3, . . . through 19 are deflated and re-inflated in a first force-reduction wave, and even number air bladder cells 2, 4, . . . through 20 are deflated and re-inflated in a body support force-reduction wave.

FIGS. 13, 15, and 21D illustrate a modification of apparatus 400 which uses a 10-output port wave sequence generator 410, a 10-outlet port distributor manifold 490, and 20 air bladder cell valves 499 to individually inflate and deflate 20 air bladder cells. As shown in FIG. 15, each of the 10 output ports 497-1 through 497-10 of ten-output port distributor manifold 490 is coupled through a Tee coupler 515-1 through 515-10 to a pair of air bladder cell valves 517A-517B to a pair of air bladder cells 404-1, 404-2 through 404-19, 404-20. Each air bladder cell valve 517A has a solenoid actuator which has a 12-volt input terminal 519A and a ground return input terminal 520A. Similarly, each second bank air bladder cell valve 517B has a solenoid actuator which has a 12-volt input terminal 519B and ground return input terminal 520B.

As shown in FIGS. 13 and 15, the 12-volt solenoid actuator input terminals 519A, 519B of each pair of air bladder cell valves 517A, 517B are connected to a single output terminal 423 of wave sequence generator 410 through a single insulated conductor 521 of cable 411. The ground return terminal 520A of the solenoid actuator of each air bladder cell valve 517A is connected to a first common return conductor RTN1 (522). Also, the ground return terminal 520B of each air bladder cell valve 517B is connected to a second common return conductor RNT2 (523).

As shown in FIGS. 13 and 15, RTN1 and RTN2 conductors are deployed from air mattress module 402 to control electronics module 419 of wave generator module 401. As shown in FIG. 13, RTN1 conductor 522 and RTN2 conductor 523 are connected to the B and C contacts of a SPDT relay 525. Relay 525 is driven by a toggle flip-flop FF2 (not shown) in control electronics module 419. As may be understood by referring to FIG. 18, toggle FF2 is triggered alternately between SET and RESET states at the end of each 10 inflation pulses P2. With this arrangement, it will be understood that when power is first applied to control electronics module 419, either RTN1 line or RTN2 line will be connected to ground through contacts of relay 525. In this first position of relay 525, a sequence of 10 pulses 429-1 through 429-10 will actuate air bladder cells valves 517A-1 through 517-10, or 517B-1 through 517B-10. After the 10th pulse 429-10 is input to control electronics module 419, flip-flop FF2 will be toggled to a different state as shown in the last line of FIG. 18. With the foregoing arrangement, a sequence of deflating and re-inflating only the 10 odd-number air bladder cells 404 of an air mattress 403 alternating with a sequence of deflating and re-inflating only even-number air bladder cells 404, results in the generation of alternating odd and even head-to-toe body support force waves, as shown in FIG. 21D.

Figure 16:
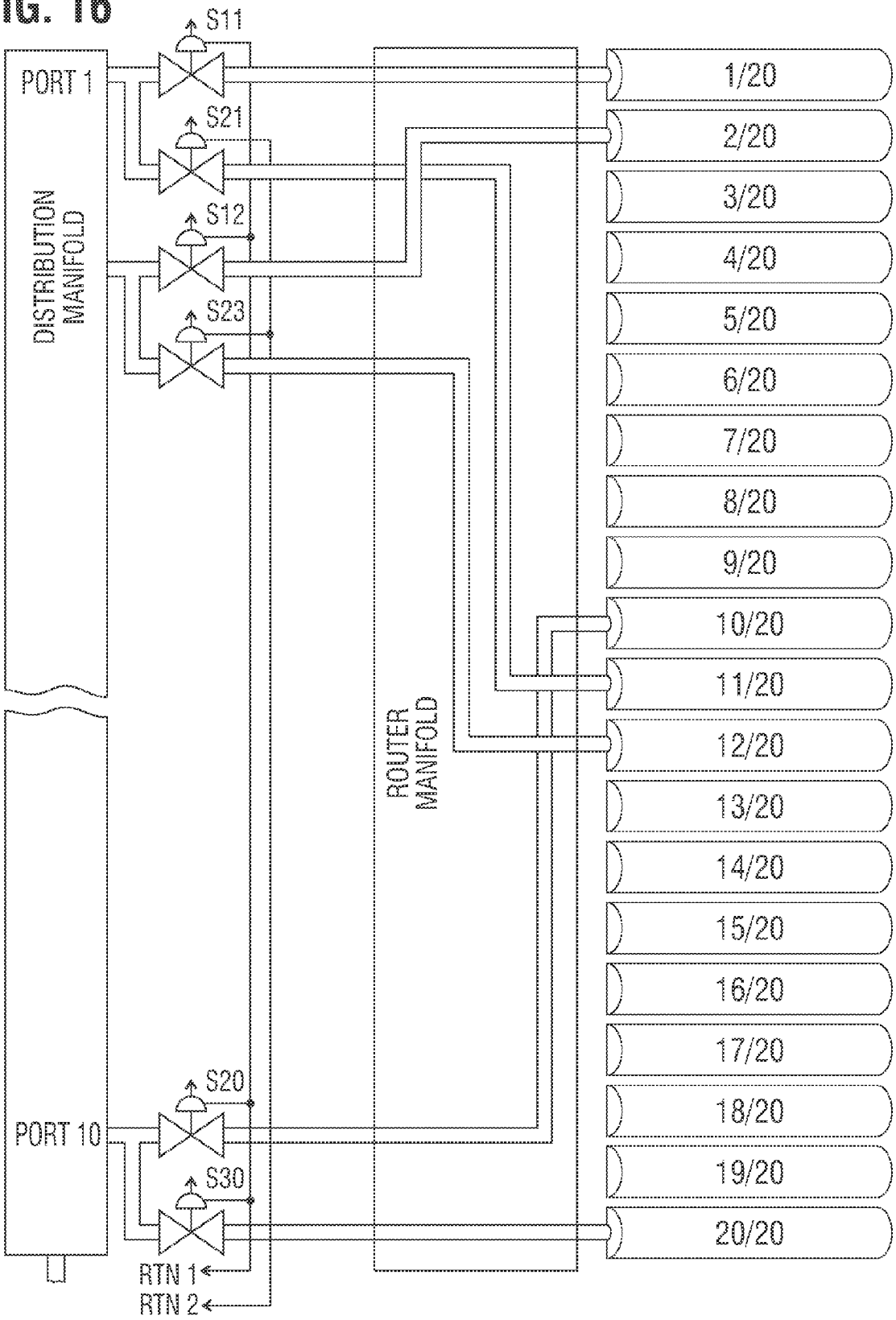
FIG. 16 is a partly diagrammatic view of a third type of an air mattress interface module and inflatable air mattress which together with the wave generator module of FIG. 13 comprise a second variation of a third embodiment of a traveling wave air mattress according to the present invention.

FIG. 16 illustrates another variation of the traveling wave air mattress 400 according to the present invention. This variation employs a router manifold interposed between the distributor manifold and air bladder cells shown in FIG. 15 and enables creating a non-alternating, consecutive sequence of air bladder cell deflation and re-inflation cycles in an air mattress 403 having 20 air bladder cells 404 using a ten-output port distributor manifold.

FIG. 17 illustrates another variation of the apparatus 400 which uses a pair of 10 output port distributor manifold 490A, 490B, 20 air bladder cell valves, and a ten-output terminal wave sequence generator to produce traveling body support force waves on an air mattress 403, using the toggle flip-flop FF2 as described above.

Figure 21E:
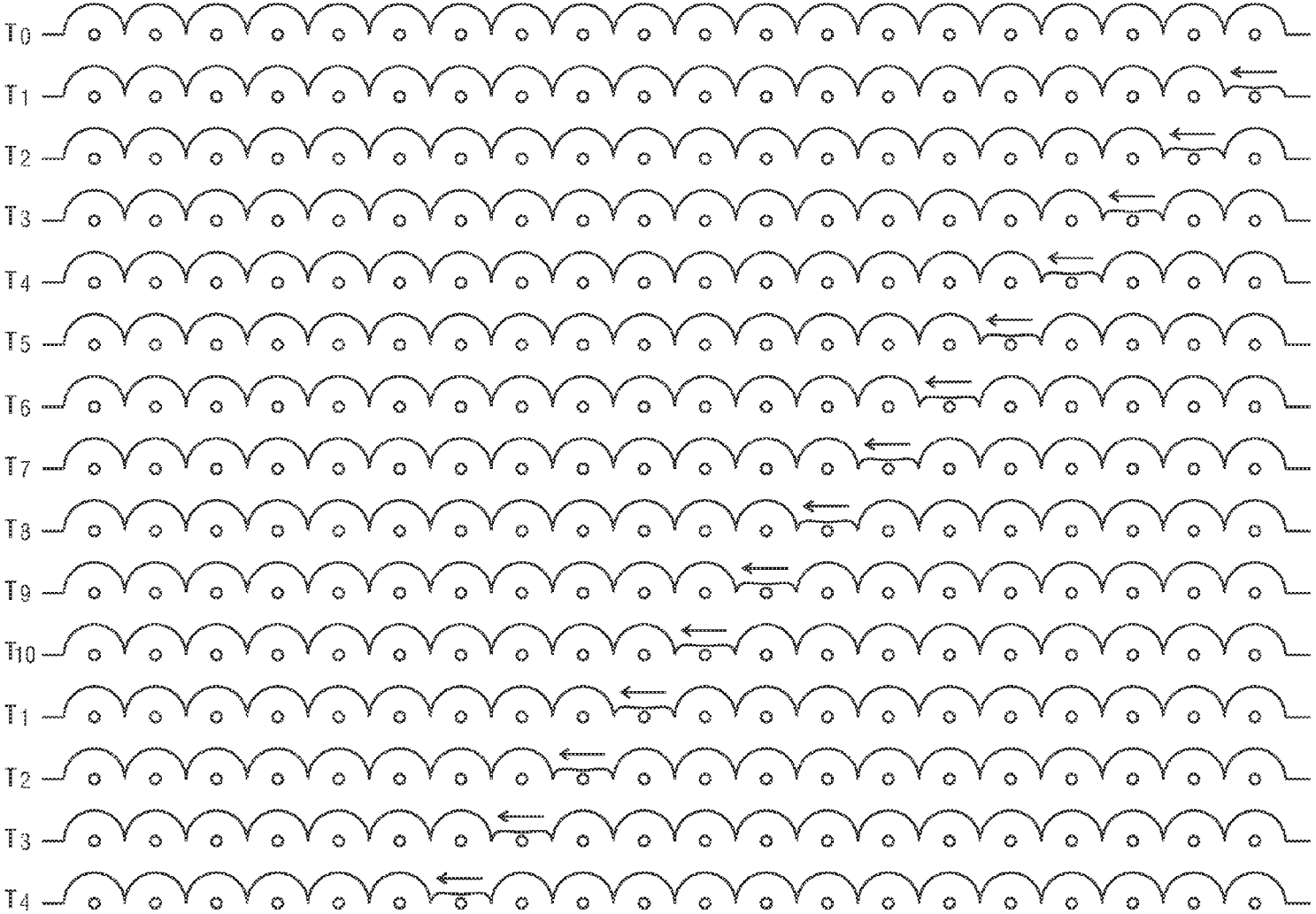
FIG. 21E is a view similar to FIG. 21B but showing a body support force wave traveling in a toe-to-head direction produced on the surface of the air mattress by sequentially deflating and re-inflating air bladder cells by pressure pulses beginning at the foot-end of the air mattress, and ending at the head-end of the air mattress.

FIG. 21E illustrates the formation of a backward, foot-end towards head-end traveling body support force wave which may be generated using the traveling wave apparatus of FIGS. 12-17.

Figure 21F:
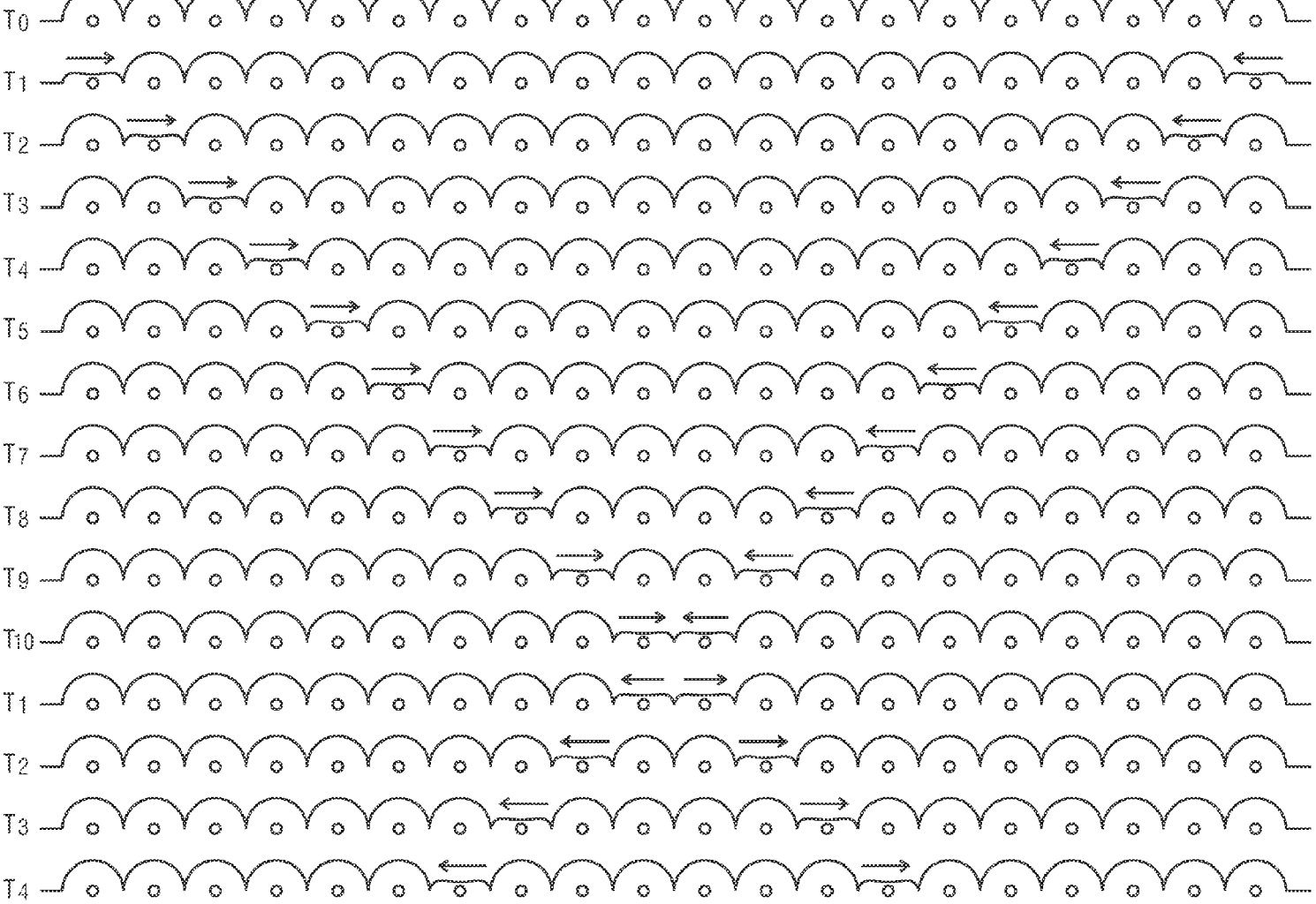
FIG. 21F is a view similar to FIG. 21A, showing upwardly and downwardly traveling body support force waves being produced on the surface of the air mattress by simultaneously introducing upwardly and downwardly traveling waves of air pressure deflation/re-inflation pulses into the air bladder cells of the air mattress.

FIG. 21F illustrates another type of body support force wave which can be produced by the apparatus 400 according to the present invention, in which the operating mode of the wave sequence generator is selected to produce simultaneous up and down traveling waves of pulses 429. It should be noted that wave sequence generator 410 may be programmed to enable production of a virtually unlimited variety of wave sequences. Also, as shown in FIG. 13, control electronics module 419 optionally includes Rapid Inflate and Rapid Deflate input ports, which would be used to command wave generator module 410 to output inflate only or deflate only signals 429 simultaneously on all 10 output ports 423 of the wave generator module, and a command signal turn on pressure regulator bypass valve V7 (483).

Figure 22:
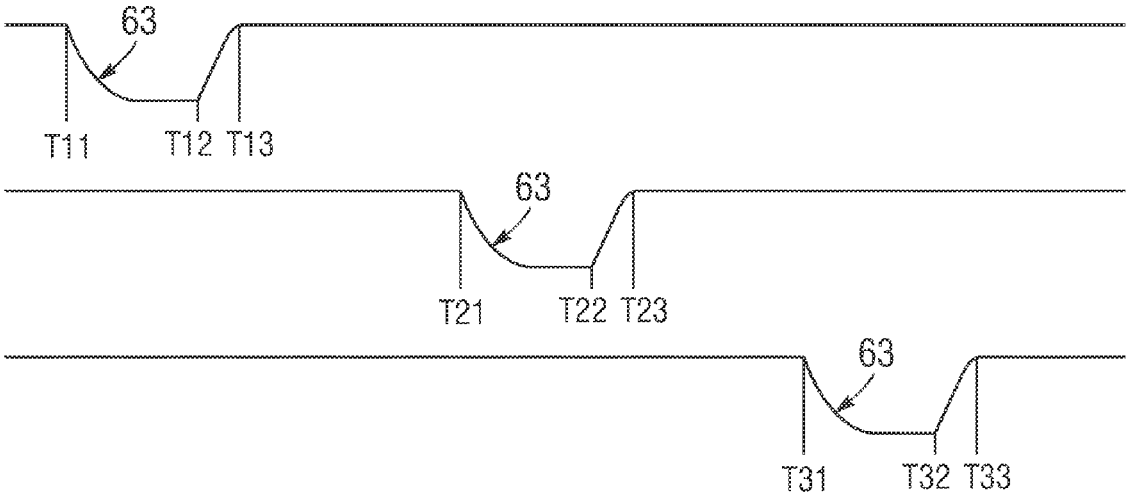
FIG. 22 is a diagram showing plots of pressure versus time for deflation/re-inflation cycles of a series of air bladder cells of the traveling wave air mattress of FIG. 12.
Figure 23:
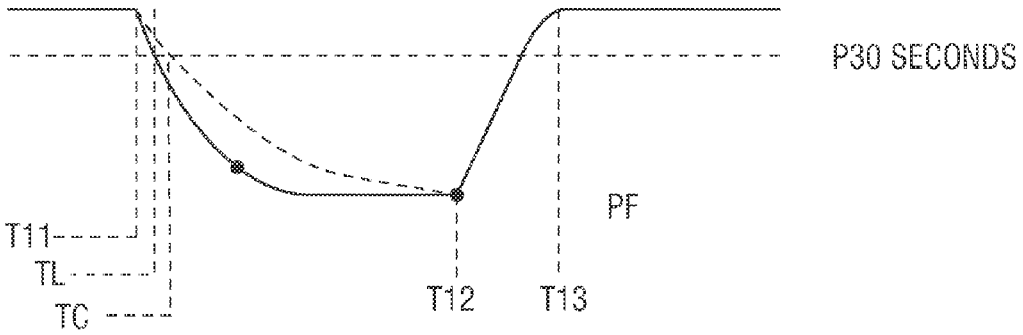
FIG. 23 is a diagrammatic view showing deflation pressure versus time curves of an air bladder cell loaded with different body weights.
Figure 24:
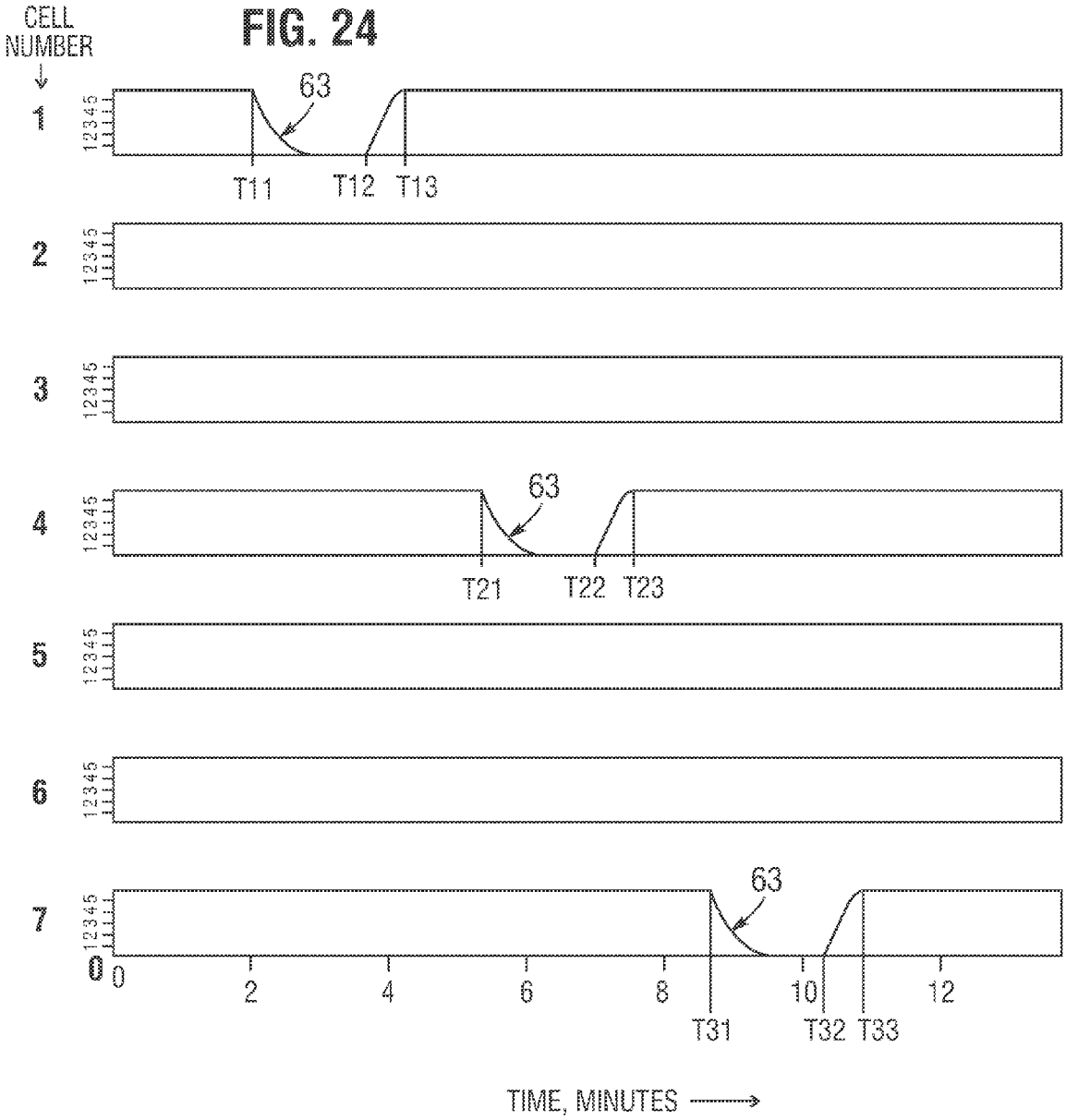
FIG. 24 is a timing diagram showing a sequence of negative pressure pulses applied to a sequence of air bladder cells of the air mattress of FIGS. 12 and 18, in which certain individual air bladder cells that have been determined during a previous traveling wave pulse sequence to have been subjected to weight load forces below a pre-determined minimum value are omitted from the sequence of air bladder cells to which negative air pressure pulses are applied, thus decreasing the time intervals between which air bladder cells that support pre-determined minimum weight loads are deflated.

FIGS. 22-24 illustrate a modification of traveling wave air mattress 400. As may be understood by referring to FIGS. 20 and 22, the square wave pulses 429 output sequentially from wave sequence generator 410 are typically used to generate a pattern of deflation and re-inflation pulses 510 which travel sequentially from each air bladder cell 404 to the next adjacent cell, each pair of air bladder cells to the next adjacent pair, each odd air bladder cell to the next odd air bladder cell, and each even air bladder cell to the next even air bladder cell. However, it should be recognized that it may in some cases be desired to omit certain air bladder cells from the deflation/re-inflation sequence. For example, if certain bladder cells 404 of the air mattress are very lightly loaded, or simply not loaded at all because a short person is lying on the air mattress, it may be desired to skip the lightly loaded or unloaded air bladder cells, affording the possibility of decreasing the times between which loaded air bladder cells are pulsed.

Therefore, apparatus 400 according to the present invention optionally includes elements which provide a novel and efficient means of monitoring average loading of individual air bladder cells, and utilizing that information to provide command signals to wave sequence generator module 410 to omit inputting air-pulse command signals 429 to air bladder cells 404 which are subjected to average weight load forces below a predetermined threshold value.

The novel structure and method of periodically sensing minimum weight loads of individual air bladder cells 404, and responding to the sensing of minimum loading by periodically omitting application of force-reducing deflation/inflation pulses to such cells may be best understood by referring to FIGS. 13, 18, 19, 22, 23, and 24.

As shown in FIG. 23, when an air pressure pulse 510 is applied to an air bladder cell 404 that is subjected to a significant weight load of, for example, 5 to 10 pounds, that air bladder cell will deflate relatively rapidly to a pre-determined pressure PT at a time T.L., as indicated by the solid line in FIG. 23.

On the other hand, an unloaded or lightly loaded air bladder cell will take longer until time TU to deflate, as indicated by the dashed line in FIG. 23. Consequently, by measuring the air pressure in pressure/vacuum outlet port 415 of air pulse generator by pressure transducer PT (485) at a time TL after the initiation of the deflation component of air pulse 510, and determining that it has not yet been reduced below the threshold pressure PT, it can be concluded that there is little or no load on that particular air bladder cell. Accordingly, the wave sequence generator 410 is commanded by a signal from control electronics module 419 to skip issuing a square wave signal 429 to deflate that air bladder cell, during the next sequence of pulses 429 emitted by the wave sequence generator.

The time difference between loaded and unloaded reduction of inflation pressure crossing the PT threshold my be enhanced by utilizing the passive deflation mode described previously. Thus, as shown in FIGS. 18 and 19, flip-flop FF2 may be toggled at the end of each 10 or 20 pulses 429 to thus switch between active and passive deflation modes as desired to thereby increase resolution in determination of the of differences in weight loading of the air bladder cells 404.

FIG. 24 illustrates a sequence of air bladder cell deflation/re-inflation pulses 510, in which pulses to air bladder cells 2, 3, 5, and 6 have been omitted because they have been determined in a previous sequence of deflation/inflation pulses to have been subjected to an average weight loaded below a predetermined value which is insufficient to result in those cells to deflate to or below a threshold pressure PT on or before time TL.

What is claimed is:

1. A traveling wave air mattress apparatus comprising in combination;

a. an air mattress which includes an array of N flexible individually inflatable and deflatable air bladder cells, where N is at least three, said air bladder cells spanning a first area dimension of said air mattress and being arranged in a series which spans a second area dimension of said air mattress, said air bladder cells having upper surfaces which in combination comprise a body support surface for a human body, and b. a soliton wave generator apparatus including an air pressure pulse generator for cyclically introducing timed sequences of pulses of air pressure variation into a predetermined series of said air bladder cells, each said sequence comprising at least a first train of pulses in which a first pulse is introduced into at least a first selected first-end air bladder cell proximate a first end of said array, and subsequent pulses of air pressure variation introduced into successive air bladder cells of said series, said sequence of pulses of air pressure variation producing a solution traveling wave of body support force variation which traverses said body support surface of said air mattress in a direction parallel to the second dimension of said air mattress, said solution traveling wave having a wave-front width which spans the first dimension of said air mattress and a length less than one half the second dimension of said air mattress spanned by said air bladder cells.

2. The traveling wave air mattress apparatus of claim 1 wherein said air mattress is further defined as including a base panel which supports said array of air bladder cells.

3. The traveling wave air mattress apparatus of claim 1 wherein said array of air bladder cells includes at least three air bladder disposed laterally between opposite longitudinal sides of said mattress at different longitudinal locations of said array.

4. The traveling wave air mattress apparatus of claim 1 wherein said array of air bladder cells includes at least three air bladder cells which are disposed longitudinally between opposite lateral ends of said array at different lateral locations of said array.

5. The traveling wave air mattress apparatus of claim 1 wherein said array of air bladder cells is further defined as comprising a matrix of at least P×Q individual air bladder cells consisting of P rows of laterally disposed air bladder cells, each consisting of Q individual air bladder cells where both P and Q are at least three.

6. The traveling wave air mattress apparatus of claim 1 further including a mattress inflation level control apparatus for inflating and deflating said air bladder cells to selectable quiescent air pressure levels.

7. The traveling wave air mattress apparatus of claim 6 wherein said inflation control apparatus includes said wave generator apparatus.

8. The traveling wave air mattress apparatus of claim 1 wherein said air pressure pulse generator of said wave generator apparatus has an output port which is selectably coupleable to selected individual air bladder cells of said array of air bladder cells.

9. The traveling wave air mattress apparatus of claim 1 wherein said solution wave generator apparatus includes a wave generator controller for issuing command signals to said air pressure pulse generator which cause said air pressure pulse generator to introduce pulses of air pressure into selected air bladder cells in a sequence that causes a wave of inflation pressure variation to travel over selectable paths of said air bladder cells and a corresponding traveling wave of body support force variations to travel over said paths.

10. The traveling wave air mattress apparatus of claim 9 further including individual surface reaction force sensors associated with at least some of said air bladder cells, each of said sensors producing a sensor output signal which is proportional to a surface reaction force exerted on a patient's body by an associated air bladder cell.

11. The traveling wave air mattress apparatus of claim 10 further including an electronic memory for storing measured values of reaction force concentrations measured by said surface reaction force sensors, an electronic computer for creating a list of air bladder cells ordered from larger to smaller of said reaction force values measured by said sensors to thereby produce a force gradient vector, and an electronic controller for directing said pressure pulse generator to apply air pressure-pulses sequentially to a first air bladder cell of said list on which a larger reaction force was measured, and sequentially to air bladder cells of said list on which successively smaller reaction forces were measured along said force gradient vector.

12. The traveling wave air mattress apparatus of claim 9 wherein said solution wave generator apparatus is further defined as including a wave generator controller for issuing command signals to said air pressure-pulse generator which controls at least one of air bladder cell selection, pressure-pulse magnitude, sign shape, duration and relative sequencing.

13. The traveling wave air mattress apparatus of claim 1 wherein said solution wave generator apparatus includes;

a. a pulse polarity router assembly for selectably conducting positive or negative pressure air pulses produced by said air pressure pulse generator to a pulse selector-manifold, b, a pulse selector manifold for receiving said positive or negative pressure air pulses and conducting said pulses to one of a selected air bladder cell and a group of air bladder cells, and c. a wave generator controller responsive to programmed commands in causing said air pulse generator to emit air pressure pulses, controlling said pulse polarity router assembly, and controlling said selector manifold to thereby select air bladder cells which are to receive air pressure pulses.

14. The apparatus of claim 13 wherein said pressure pulse generator is further defined as being an air pump having an inlet port for providing negative pressure pulses of air and an outlet port for producing positive pressure pulses of air.

15. The apparatus of claim 14 wherein said router assembly includes a multiplicity of valves and air conduits for alternately and selectably connecting said inlet and outlet ports of said air pump to an inlet port of said pulse selector manifold.

16. The apparatus of claim 15 wherein said multiplicity of valves includes a pump inlet router valve which has an output port connected by a pump inlet conduit to said to pump inlet port, a first inlet port for communication with said inlet port of said pulse selector manifold, and a pump inlet valve element actuable between a first, open position to enable air flow from said inlet port of said pulse selector manifold to said pump inlet port, and a second, closed position to block air flow from said inlet of said pulse selector manifold to said pump inlet port.

17. The apparatus of claim 16 wherein said pump inlet router valve is further defined as having a second inlet port which communicates with said outlet port of said pump inlet router valve when said pump inlet valve element is actuated to a second, closed position.

18. The apparatus of claim 16 wherein said second inlet port of said pump inlet router valve communicates with an air supply.

19. The of apparatus of claim 18 wherein said air supply is the atmosphere.

20. The apparatus of claim 18 wherein said air supply is a pneumatic accumulator.

21. The apparatus of claim 16 further including a selector manifold router valve which has an output port connected by an air conduit to said inlet port of said pump inlet router valve, a first inlet port connected to said inlet port of said pulse selector manifold, and a selector manifold valve element actuable between a first open position to enable air flow from said first input port of said pulse selector manifold to said first inlet port of said pump inlet router valve, and a second, closed position to block air flow from said pulse selector manifold to said first inlet port of said pump inlet router valve.

22. The apparatus of claim 21 wherein said selector manifold router valve is further defined as having a second inlet port which communicates with said outlet port of said selector manifold router valve when said selector manifold valve element is actuated to said closed position.

23. The apparatus of claim 22 further including a pump outlet router valve which has an input port connected by a pump outlet conduit to said pump outlet port, a first outlet port connected by an air conduit to said second outlet port of said pulse selector router valve, and a pump outlet valve element actuable between a first open position to enable air flow from said inlet port of said pump outlet router valve to said first outlet port of said pump outlet router valve, and a second, closed position to block air flow from said inlet port of said inlet port to said first outlet port of said pump inlet router valve.

24. The apparatus of claim 23 wherein said pump output router valve is further defined as having a second outlet port which communicates with said inlet port of said pump outlet router valve when said pump output valve element is actuated to a second, closed position.

25. The apparatus of claim 24 wherein said second outlet port of said pump outlet router valve communicates with an air exhaust space.

26. The apparatus of claim 25 wherein said air exhaust space is the atmosphere.

27. The apparatus of claim 26 wherein said exhaust space is an internal volume of an accumulator which is connected to said second outlet port of said pump outlet router valve by a first outlet conduit.

28. The apparatus of claim 27 further including a second output conduit which connects said second outlet port of said pump outlet router valve to said second input port of said pump inlet router valve.

29. The apparatus of claim 13 further including and exhaust rate sensor device for monitoring exhaust rate of air from a deflating air bladder cell and varying at least one of occurrence time, duration, and magnitude of a subsequent deflation and re-inflation cycle of that air bladder cell if the exhaust rate is below a predetermined threshold value.

30. The apparatus of claim 29 wherein said exhaust rate sensor device comprises in combination a pressure sensor for pneumatically communicating with a said deflating air bladder cell, a pressure sensor, and a timed threshold device for interrogating said pressure sensor at a predetermined time to assess whether or not pressure in said air bladder cell is below a predetermined threshold value at said predetermined time.

31. The improved air mattress of claim 30 wherein said exhaust rate sensor device comprises in combination a pressure sensor for pneumatically communicating with a said deflating air bladder cell, a pressure sensor, and a timed threshold device for interrogating said pressure sensor at a predetermined time to assess whether or not pressure in said air bladder cell is below a predetermined threshold value at said predetermined time.

32. The traveling wave air mattress of claim 1 wherein said successive air bladder cells of said series are spaced successively further from said first selected first-end air bladder cell.

33. The traveling wave air mattress apparatus of claim 32 wherein said sequence of pulses of air pressure variation includes a second train of pulses in which a first pulse is introduced into at least a first selected second-end air bladder cell proximate a second end of said array and subsequent pulses of air pressure variation into successive air bladder cells of said series, said sequence of pulses of air pressure variation producing a solution wave of body support force variation which traverses said body support surface of said air mattress in a direction perpendicular to said air bladder cells, said solution wave having a wave-front width which spans the first dimension of said air mattress and a length less than one half the second dimension of said air mattress spanned by said air bladder cells.

34. The traveling wave air mattress of claim 33 wherein said successive air bladder cells of said series are spaced successively further from said first selected second-end air bladder cell.

35. The traveling wave air mattress of claim 34 wherein said second train of pulses of air pressure variation is initiated after the end of a time interval in which said first train of pulses of air pressure variation occurred.

36. The traveling wave air mattress of claim 34 wherein said second train of pulses of air pressure variation is initiated during a time interval in which said first train of air pulses occurs.

37. A traveling wave air mattress apparatus comprising;

a. an array of flexible air bladder cells having upper surfaces for supporting a human body, said air bladder cells being hermetically isolated from one another and individually inflatable and deflatable, and b. a wave generator apparatus including an air pressure pulse generator for sequentially introducing pulses of air pressure into a selectable sequence of said air bladder cells to thereby introduce a traveling wave of air pressure variation in said cells from static pressure values and hence cause a traveling wave of variation in support force for a body to traverse upper surfaces of at least some of said air bladder cells, said air pressure pulse generator including;

i. a hermetically sealable pressure chamber which communicates with said outlet port of said air pressure pulse generator and a movable member within said chamber which is movable away from said outlet port in a first retracted direction from a first, rest position to a second, active position to withdraw air from a selected air bladder cell through said outlet port and into said chamber, to thus decrease air pressure within the selected cell from an initial quiescent pressure, and movable in a second, extended direction towards said outlet port to expel air through said output port and back into said selected air bladder cell to increase pressure in said selected air bladder cell, and ii. an actuator responsive to an actuator driver signal to thus move said movable member.

38. The traveling wave air mattress apparatus of claim 37 wherein said movable member is one of a diaphragm and a piston.

39. The traveling wave air mattress apparatus of claim 38 wherein said air pressure pulse generator is further defined as including a force actuator for moving said movable member.

40. A traveling wave air mattress apparatus for decreasing the magnitude and duration of reaction force concentrations exerted on the body of a patient, said apparatus comprising;

a. an inflatable air mattress including a base panel having protruding upwards therefrom a multiplicity of flexible individually inflatable and deflatable air bladder cells which are hermetically isolated from one another, said air bladder cells being disposed in a direction which spans a first area dimension of the base panel and being arranged in a series which spans a second area dimension of the bases panel, each of said air bladder cells having at least a first hermetically sealable port through which pressurized air may be introduced to and removed from a hollow interior space of said air bladder cell, b. an inflation control apparatus for introducing and removing air into said air bladder cells to thus inflate and deflate each air bladder cell to adjustable quiescent air pressure levels, and c. a solution wave generator apparatus including an air pressure pulse generator for cyclically introducing timed sequences of pulses of air pressure variation into a predetermined series of said air bladder cells, each said sequence comprising at least a first train of pulses in which a first pulse is introduced into at least a first selected first-end air bladder cell proximate a first end of said array, and subsequent pulses of air pressure variation into successive air bladder cells of said series, said sequence of pulses of air pressure variation producing a solution traveling wave of body support force variation which traverses said body support surface of said air mattress in a direction parallel to the second dimension of the base panel, said solution traveling wave having a wave-front width which spans the first dimension of said air mattress and a length less than one half the second dimension of said air mattress spanned by said air bladder cells.

41. The traveling wave air mattress apparatus of claim 40 further including an array of surface reaction force sensors, each sensor being associated with individual ones of said air bladder cells, each of said sensors producing a sensor output signal which is proportional to a surface reaction support force exerted on a patient's body by said air bladder cells associated with said sensors.

42. The traveling wave air mattress apparatus of claim 41 further including an electronic memory for storing measured values of reaction force concentrations measured by said surface reaction force sensors, an electronic computer for creating a list of air bladder cells ordered from larger to smaller of said reaction force values measured by said sensors to thereby produce a force gradient vector, and an electronic controller for directing said pressure pulse generator to apply air pressure pulses sequentially to at least some of said air bladder cells along said force gradient vector.

43. The traveling wave air mattress apparatus of claim 40 wherein said wave generator apparatus is further defined as including a wave generator controller for issuing command signals to said air pressure pulse generator which controls at least one of air bladder cell selection, pressure-pulse magnitude, sign, shape, duration and relative sequencing.

44. The traveling wave air mattress of claim 40 wherein said successive air bladder cells of said series are spaced progressively further from said first selected first-end air bladder cell.

45. The traveling wave air mattress of claim 44 wherein said sequence of pulses of air pressure variation includes a second train of pulses in which a first pulse is introduced into at least a first selected second-end air bladder cell proximate a second end of said array and subsequent pulses of air pressure variation into successive air bladder cells of said series, said sequence of pulses of air pressure variation producing a solution wave of body support force variation which traverses said body support surface of said air mattress in a direction perpendicular to said air bladder cells, said solution wave having a wave-front width which spans the first dimension of said air mattress and a length less than one half the second dimension of said air mattress spanned by said air bladder cells.

46. The traveling wave air mattress of claim 45 wherein said successive air bladder cells of said series are spaced successively further from said first selected second-end air bladder cell.

47. The traveling wave air mattress of claim 46 wherein said second train of pulses of air pressure variation is initiated after the end of a time interval in which said first train of pulses of air pressure variation occurred.

48. The traveling wave air mattress of claim 46 wherein said second train of pulses of air pressure variation is initiated during a time interval in which said first train of air pulses occurs.

49. In an air mattress which includes an array of N flexible individually inflatable and deflatable air bladder cells, having surfaces which provide a body support force, the improvement comprising a solution wave generator operably interconnected to said air mattress, said solution wave generator apparatus comprising an air pressure pulse generator for cyclically introducing timed sequences of pulses of air pressure variation into a predetermined series of said air bladder cells, each said sequence comprising at least a first train of pulses in which a first pulse is introduced into at least a first first-end selected air bladder cell proximate a first end of said array, and subsequent pulses of air pressure variation into successive air bladder cells of said series, said sequence of pulses of air pressure variation producing a solution traveling wave of body support force variation which traverses said surfaces of said air bladder cells in a direction parallel to a second area dimension of said array, said solution traveling wave having a wave-front width which spans a first dimension of said air mattress and a length less than one half a second dimension of said air mattress spanned by said air bladder cells.

50. The improvement of claim 49 wherein said wave generator apparatus includes a wave generator controller for issuing command signals to said air pressure pulse generator which cause said air pressure pulse generator to introduce pulses of air pressure into selected air bladder cells in a sequence that causes a wave of inflation pressure variation to travel over selectable paths of said air bladder cells and a corresponding traveling wave of body support force variations to travel over said paths.

51. The improvement of claim 49 wherein said sequence of pulses of air pressure variation includes a second train of pulses in which a first pulse is introduced into at least a first selected second-end air bladder cell proximate a second end of said array and subsequent pulses of air pressure variation into successive air bladder cells of said series, said sequence of pulses of air pressure variation producing a solution traveling wave of body support force variation which traverses said body support surface of said air mattress in a direction parallel to a second area dimension of said array, said solution traveling wave having a wave-front width which spans a first dimension of said air mattress and a length less than one half the second dimension of said air mattress spanned by said air bladder cells.

52. The improvement of claim 51 wherein said second train of pulses of air pressure variation is initiated after the end of a time interval in which said first train of pulses of air pressure variation occurred.

53. The improvement of claim 51 wherein said second train of pulses of air pressure variation is initiated during a time interval in which said first train of air pulses occurs.

* * * * *